United States Patent [19]

Yamashita et al.

[11] Patent Number: 4,735,882

[45] Date of Patent: Apr. 5, 1988

[54] TRISAZO PHOTSENSITIVE MEMBER FOR ELECTROPHOTOGRAPHY

[75] Inventors: Masataka Yamashita, Kawasaki; Takao Takiguchi, Tokyo; Shoji Umehara, Fuchu; Masakazu Matsumoto; Shozo Ishikawa, Yokohama, all of Japan

[73] Assignee: Canon Kabushiki Kaisha, Tokyo, Japan

[21] Appl. No.: 846,900

[22] Filed: Apr. 1, 1986

[30] Foreign Application Priority Data

| | | | |
|---|---|---|---|
| Apr. 2, 1985 | [JP] | Japan | 60-069723 |
| Apr. 2, 1985 | [JP] | Japan | 60-069724 |
| Apr. 26, 1985 | [JP] | Japan | 60-090453 |
| May 15, 1985 | [JP] | Japan | 60-101514 |

[51] Int. Cl.[4] ..... G03G 5/06

[52] U.S. Cl. ..... 430/58; 430/59; 430/72; 430/73; 430/75; 430/76; 430/77; 430/78; 430/79; 534/689; 534/691; 534/754; 534/755; 534/809

[58] Field of Search ..... 430/58, 59, 72, 73, 430/75, 76, 77, 78, 79

[56] References Cited

U.S. PATENT DOCUMENTS

| | | | |
|---|---|---|---|
| 4,279,981 | 7/1981 | Ohta et al. | 430/73 |
| 4,390,611 | 6/1983 | Ishikowa et al. | 430/59 |
| 4,436,800 | 3/1984 | Ohta et al. | 430/59 |
| 4,439,506 | 3/1984 | Ohta et al. | 430/58 |
| 4,551,404 | 11/1985 | Hiro et al. | 430/59 |

*Primary Examiner*—Roland E. Martin

*Attorney, Agent, or Firm*—Fitzpatrick, Cella, Harper & Scinto

[57] ABSTRACT

An electrophotographic photosensitive member comprises a photosensitive layer containing an azo pigment selected from the following general formulae (1) to (5):

(1)

(2)

(3)

(4)

(5)

wherein groups Ar are arylene groups and divalent heterocyclic groups, each of which may contain a substituent; n is 0 or 1; and group A is a coupler residue group having a phenolic OH group.

4 Claims, No Drawings

TRISAZO PHOTSENSITIVE MEMBER FOR ELECTROPHOTOGRAPHY

BACKGROUND OF THE INVENTION

1. Field of the Invention

This invention relates to a photosensitive member for electrophotography, and particularly to a photosensitive member for electrophotography with a photosensitive layer containing a specific azo pigment.

2. Related Background Art

Photosensitive members for electrophotography utilizing inorganic photoconductive substances such as selenium, cadmium sulfide, zince oxide, etc. as a photoconductive component have been so far well known. On the other hand, since specific photoconductive organic compounds were found, many organic photoconductive substances have been developed. For example, organic photoconductive polymers such as poly-N-vinylcarbazole, polyvinylanthracene, etc.; low molecular weight organic photoconductive compounds such as carbazole, anthracene, pyrazolines, oxadiazoles, hydrazones, polyarylalkanes, etc.; and organic pigments and dyes such as phthalocyanine pigment, azo pigment, cyanine pigment, polycyclic quinone pigment, perylene-based pigment, indigo dye, thio indigo dye, and squarilium dyes, etc. are known. Particularly, the photoconductive organic pigments and dyes can be more readily synthesized than the inorganic substances, and have variations in selecting a suitable compound showing a photoconductivity for a desired wavelength range. Thus, many photoconductive organic pigments and dyes have been proposed. For example, photosensitive members for electrophotography utilizing a photoconductive disazo pigment as a charge-generating material in a photosensitive layer having a charge generation layer and a charge transport layer as functionally separated are known, as disclosed in U.S. Pat. Nos. 4,123,270; 4,247,614; 4,251,613; 4,251,614; 4,256,821; 4,260,672; 4,268,596; 4,278,747; 4,293,628, etc.

The photosensitive members for electrophotography utilizing such organic photoconductive compounds can be produced by coating when an appropriate binder is selected, that is, can be produced with a very high productivity at a low cost, and also have such an advantage that the photosensitive wavelength range can be controlled as desired by selecting an appropriate organic pigment. However, these photosensitive members have poor sensitivity and durability and thus only a few of them have been practically utilized.

SUMMARY OF THE INVENTION

An object of the present invention is to provide a novel photosensitive member for electrophotography.

Another object of the present invention is to provide a photosensitive member for electrophotography with commercially utilizable sensitivity and durability.

A further object of the present invention is to provide a photosensitive member for electrophotography capable of stably forming good images in repeated image formations.

The photosensitive member for electrophotography according to the present invention is characterized by a photosensitive layer containing one member selected from azo pigments represented by the following general formulae (1)–(5):

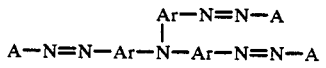

(1)

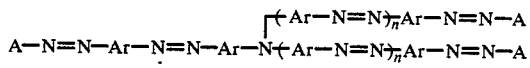

(2)

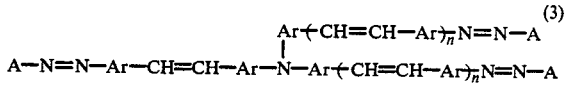

(3)

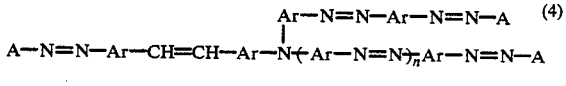

(4)

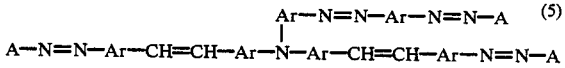

(5)

wherein Ar represents an arylene group or a divalent heterocyclic group, each of which can have a substituent; n is 0 or 1; A is a coupler residue having a phenolic OH group. In the general formulae (1)–(5), the arylene group for the definition of Ar may include, for example, phenylene, biphenylene, naphthylene and anthrylene. The substituent which may be attached to those groups may include, for example, hydroxy group, halogen such as chlorine, bromine, iodine, etc.; alkyl such as methyl, ethyl, propyl, butyl, etc.; alkoxy such as methoxy, ethoxy, propoxy, butoxy, etc.; aryoxy such as phenyloxy, etc.; substituted amino such as dimethylamino, diethylamino, dibenzylamino, pyrrolidino, piperidino, morpholino, etc.; nitro; cyano; and acyl such as acetyl, benzoyl, etc. Further, the heterocyclic group represented by Ar is a divalent group, including for example, those derived from benzoxazole, benzothiazole, pyridine, quinoline, thiophene, carbazole, etc. Those groups may be substituted by the above-mentioned substituent. At least one of the Ar groups in said general formula (1) is preferably an arylene group selected from biphenylene, naphthylene, and anthrylene, each of which can have a substituent. At least one of the three Ar groups bonded to the amine (—N—) in said general formula (3) is preferably a group selected from biphenylene, naphthylene and anthrylene. Furthermore, the coupler residue having a phenolic OH group in the A groups in said general formulae (1) to (5) can be represented, for example, by the general formulae (6) to (12):

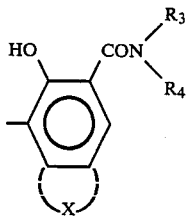

(6)

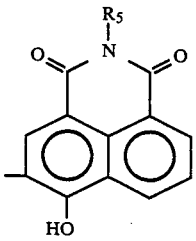

(7)

-continued (8)

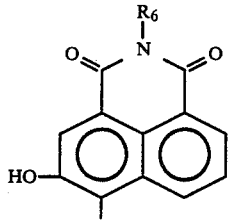

(9)

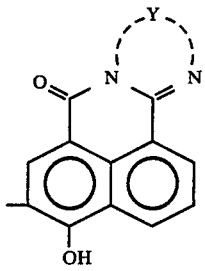

(10)

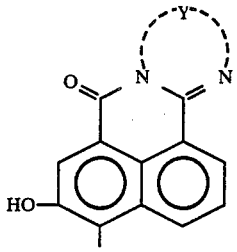

(11)

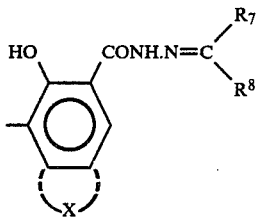

(12)

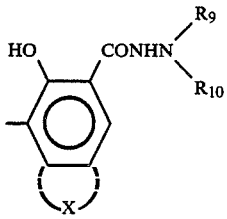

wherein X is a residue capable of forming a polycyclic aromatic ring or a heterocyclic ring through condensation with a benzene ring; $R_3$ and $R_4$ are hydrogen atoms, alkyls, aralkyls, and aryls, each of which may have a substituent, or form a cyclic amino group therewith through a nitrogen atom; $R_5$ and $R_6$ are alkyls, aralkyls, and aryls, each of which may have a substituent; Y is a divalent aromatic hydrocarbon group or forms a divalent heterocyclic group therewith through a nitrogen atom; $R_7$ and $R_8$ are aryls and heterocyclic groups, each of which may have a substituent, or are residues forming a 5 or 6-membered ring together with a centeral carbon atom, where the 5 or 6-membered ring may have a condensed aromatic ring, or $R_7$ may be a hydrogen atom; $R_9$ and $R_{10}$ are hydrogen atoms, alkyls, aralkyls, aryls or heterocyclic groups, each of which may have a substituent.

The polycyclic aromatic ring represented by said X includes, for example, naphthalene, anthracene, carbazole, benzcarbazole, dibenzofuran, benzonaphthofuran, diphenylene sulfide, etc., and may be substituted by said substituent. The condensed ring formed by the benzene ring through X is desirably naphthalene, anthracene, and benzcarbazole. In case of $R_3$ and $R_4$, the alkyls include, for example, methyl, ethyl, propyl, butyl, etc.; the aralkyls include, for example, benzyl, phenethyl, naphthylmethyl, etc.; the aryls include, for example, phenyl, diphenyl, naphthyl, anthryl, etc. Particularly preferable are compounds whose $R_3$ is hydrogen atom and whose $R_4$ is a phenyl group having an electron-attractive group such as a halogen atom, nitro, cyano, trifluoromethyl, acyl, etc. at the O-position. They may have said substituent. The heterocyclic group includes, for example, carbazole, dibenzofuran, benzimidazolone, benzthiazole, thiazole, pyridine, etc.

Examples of $R_5$ and $R_6$ are the same as given in said exemplification of $R_3$ and $R_4$ excluding the examples of heterocyclic groups; and may be substituted by a substituent given in said exemplification of Ar.

In the definition of Y, the divalent aromatic hydrocarbon group includes, for example, monocyclic aromatic hydrocarbon groups, such as o-phenylene, and condensed polycyclic aromatic hydrocarbon groups such as o-naphthylene, perinaphthylene, 1,2-anthrylene, 9,10-phenanthrylene, etc. Examples of the divalent heterocyclic group formed together with the nitrogen atom are divalent, 5 or 6-membered heterocyclic groups such as 3,4-pyrazolediyl group, 2,3-pyridinediyl group, 4,5-pyrimidinediyl group, 6,7-indazolediyl group, 5,6-benzimidazolediyl group, 6,7-quinolinediyl group, etc.

The aryls or heterocyclic groups represented by said $R_7$ and $R_8$ include, for example, phenyl, naphthyl, anthryl, pyrenyl, etc.; and pyridyl, thienyl, furyl, carbazolyl, etc., and may be substituted by the foregoing substituents. The substituents on the aryls and the heterocyclic groups represented by said $R_7$ and $R_8$ include halogen atoms such as fluorine, chlorine, bromine, iodine, etc.; alkyl group such as methyl, ethyl, propyl, butyl, etc.; alkoxy groups such as methoxy, ethoxy, propoxy, butoxy, etc.; nitro; cyano; substituted amino groups such as dimethylamino, diethylamino, dipropylamino, dibenzylamino, diphenylamino, morpholino, piperidino, pyrrolidino, etc. Furthermore, $R_7$ and $R_8$ represent residues forming 5 or 6-membered rings together with the central carbon atom, and the 5 or 6-membered ring may have a condensed aromatic ring. Examples of the residues include cyclopentylidene, cyclohexylidene, 9-fluorenylidene, 9-xanthenylidene, etc.

$R_9$ and $R_{10}$ in the formula (12) represent hydrogen atoms, alkyl groups such as methyl, ethyl, propyl, butyl, etc.; aralkyl groups such as benzyl, phenethyl, naphthylmethyl, etc.; aryl groups such as phenyl, naphthyl, anthryl, diphenyl, etc.; and heterocyclic groups such as carbazole, dibenzofuran, benzimidazolone, benzthiazole, thiazole, pyridine, etc., all of which may have a substituent.

Substitutents on the alkyls, aralkyls, aryls, and heterocyclic groups represented by $R_9$ and $R_{10}$ include halogen atoms such as fluoride, chlorine, bromine, iodine, etc.; alkyl groups such as methyl, ethyl, propyl, butyl, etc.; alkoxy groups such as methoxy, ethoxy, propoxy, butoxy, etc.; nitro; cyano; and substituted amino groups such as dimethylamino, dipropylamino, dibenzylamino, diphenylamino, morpholino, piperidino, pyrrolidino, etc.

In the present invention, it seems that conjugation can be maintained between the azo groups and between the vinylene groups of the azo pigments given by said general formulae (1)-(5) by virtue of the lone pair of nitrogen atom in the $$-Ar-\overset{\overset{\displaystyle Ar}{|}}{N}-Ar-$$

structure as the skeleton of the azo pigments, and the charge generated by light has a freely movable extension by virtue of the elongation of conjugated chains by the azo group and the vinylene group, and also the charge migration between the pigment molecules can be improved, though not theoretically restricted.

Either carrier generation efficiency or carrier transport efficiency, or both can be improved by using the azo pigments shown by said general formulae (1)-(5), and consequently the sensitivity or potential stability in a prolonged use can be assured. Thus, a higher sensitivity can be obtained, and application of the present photosensitive member to a high speed copying machine, a laser beam printer, an LED printer, a liquid crystal printer, etc. becomes possible, and a stable potential can be assured, irrespective of the previous use of photosensitive members. That is, a stable, beautiful image can be obtained.

Typical examples of the azo pigments for use in the present invention will be given below.

Table 1 exemplifies azo pigments having the formula:

$$A-N=N-Ar_1-\overset{\overset{\displaystyle Ar_2-N=N-A}{|}}{N}-Ar_3-N=N-A$$

included in the general formula (1).

Table 2 shows typical examples of azo pigments having the formula:

$$A-N=N-Ar_2-N=N-Ar_1-\overset{\overset{\displaystyle (Ar_3-N=N)_l Ar_4-N=N-A}{|}}{N}(Ar_5-N=N)_m Ar_6-N=N-A$$

included in the general formula (2).

Table 3 shows typical examples of azo pigments having the formula:

$$A-N=N-Ar_1-CH=CH-Ar_2-\overset{\overset{\displaystyle Ar_5(CH=CH-Ar_6)_m N=N-A}{|}}{N}-Ar_3(CH=CH-Ar_4)_n N=N-A$$

included in the general formula (3).

Table 4 exemplifies azo pigments having the formula:

$$A-N=N-Ar_1-CH=CH-Ar_2-\overset{\overset{\displaystyle Ar_5-N=N-Ar_6-N=N-A}{|}}{N}(Ar_3-N=N)_n Ar_4-N=N-A$$

included in the general formula (4).

Table 5 shows typical examples of azo pigments having the formula:

$$A-N=N-Ar_7-CH=CH-Ar_8-\overset{\overset{\displaystyle Ar_{11}-N=N-Ar_{12}-N=N-A}{|}}{N}-Ar_9-CH=CH-Ar_{10}-N=N-A$$

included in the general formula (5).

TABLE 1

| Azo pigment No. | $Ar_1$ | $Ar_2$ | $Ar_3$ | A |
|---|---|---|---|---|
| 1-1 | 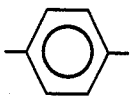 | 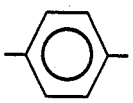 | 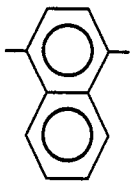 | 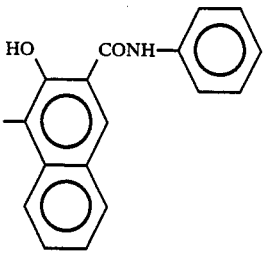 |

TABLE 1-continued
| Azo pigment No. | $Ar_1$ | $Ar_2$ | $Ar_3$ | A |
|---|---|---|---|---|
| 1-2 | 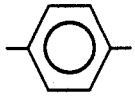 | 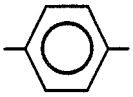 | 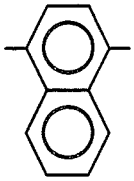 | 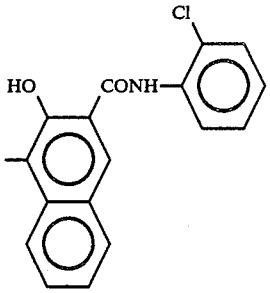  |
| 1-3 | 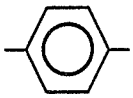 | 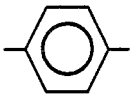 | 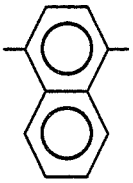 | 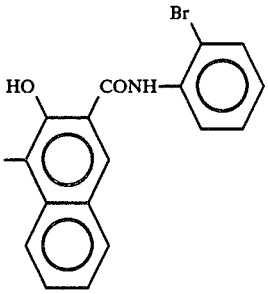  |
| 1-4 | 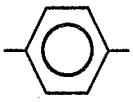 | 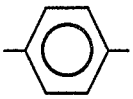 | 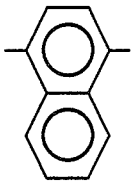 | 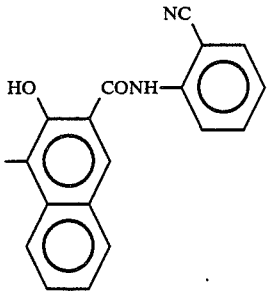  |
| 1-5 | 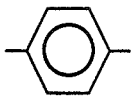 | 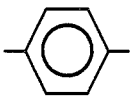 | 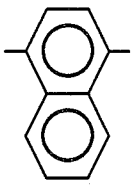 | 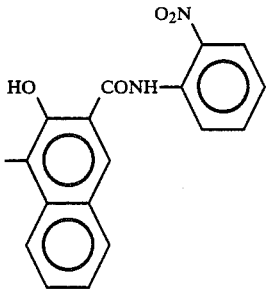  |
| 1-6 | 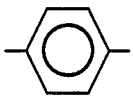 | 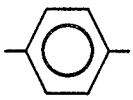 | 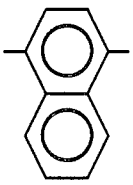 | 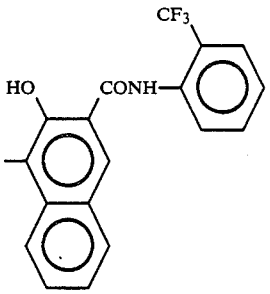  |

TABLE 1-continued
| Azo pigment No. | $Ar_1$ | $Ar_2$ | $Ar_3$ | A |
|---|---|---|---|---|
| 1-7 | 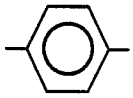 | 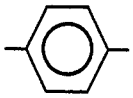 | 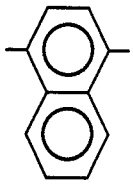 | 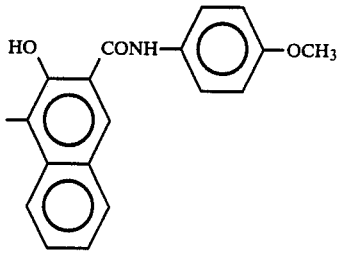  |
| 1-8 | 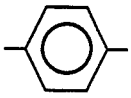 | 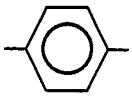 | 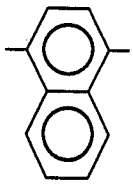 | 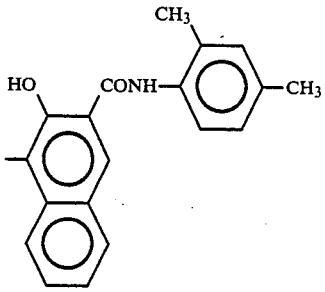  |
| 1-9 | 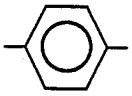 | 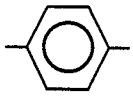 | 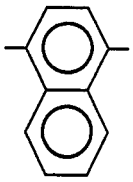 | 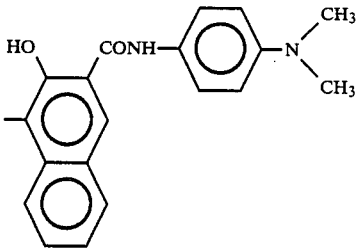  |
| 1-10 | 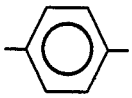 | 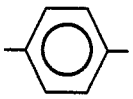 | 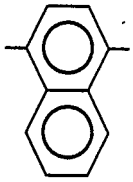 | 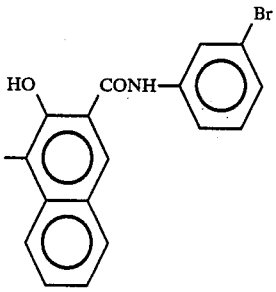  |
| 1-11 | 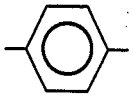 | 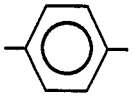 | 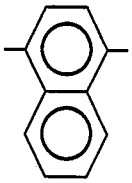 | 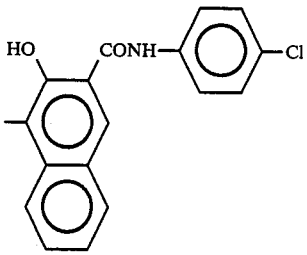  |

TABLE 1-continued
| Azo pigment No. | $Ar_1$ | $Ar_2$ | $Ar_3$ | A |
|---|---|---|---|---|
| 1-12 | 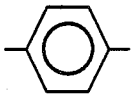 | 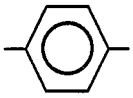 | 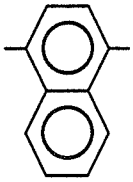 | 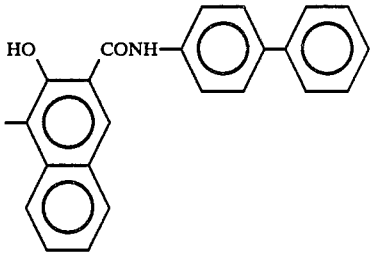 |
| 1-13 | 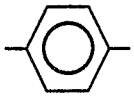 | 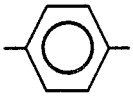 | 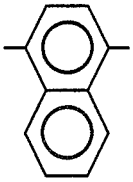 | 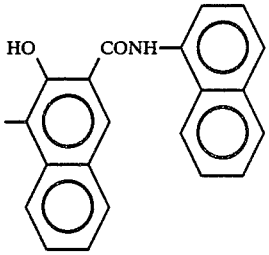 |
| 1-14 | 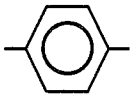 | 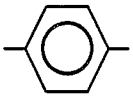 | 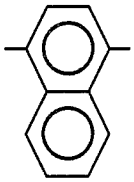 | 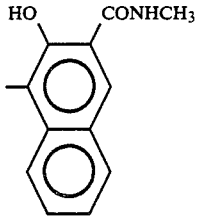 |
| 1-15 | 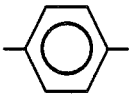 | 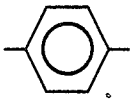 | 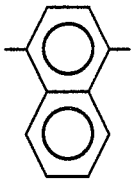 | 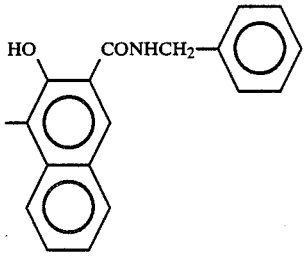 |
| 1-16 | 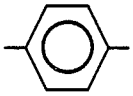 | 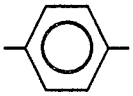 | 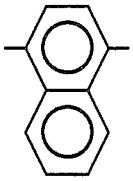 | 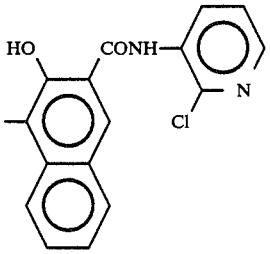 |

TABLE 1-continued
| Azo pigment No. | $Ar_1$ | $Ar_2$ | $Ar_3$ | A |
|---|---|---|---|---|
| 1-17 | 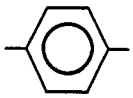 | 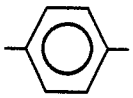 | 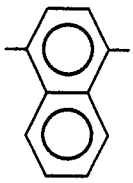 | 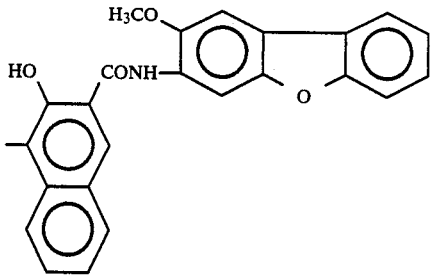 |
| 1-18 | 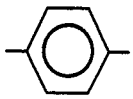 | 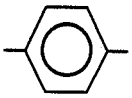 | 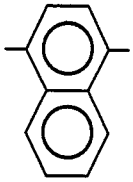 | 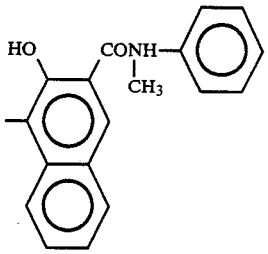 |
| 1-19 | 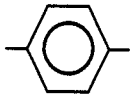 | 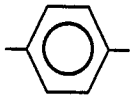 | 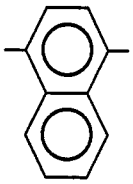 | 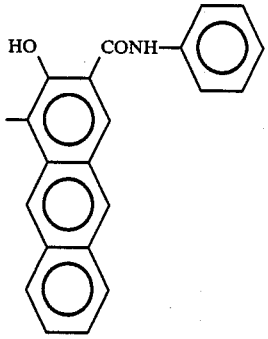 |
| 1-20 | 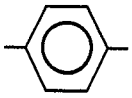 | 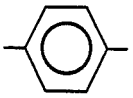 | 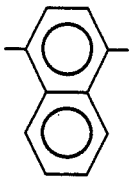 | 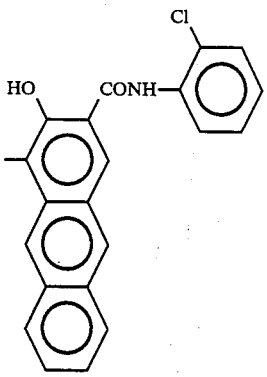 |

TABLE 1-continued
| Azo pigment No. | $Ar_1$ | $Ar_2$ | $Ar_3$ | A |
|---|---|---|---|---|
| 1-21 | 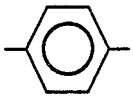 | 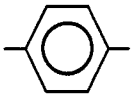 | 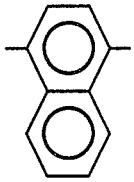 | 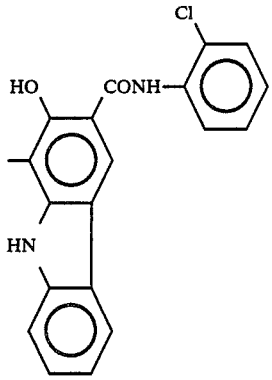  |
| 1-22 | 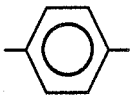 | 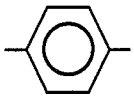 | 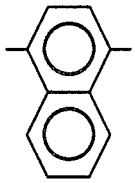 | 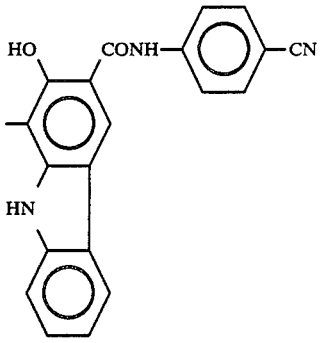  |
| 1-23 | 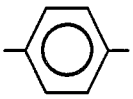 | 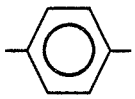 | 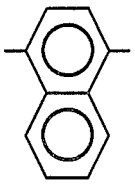 | 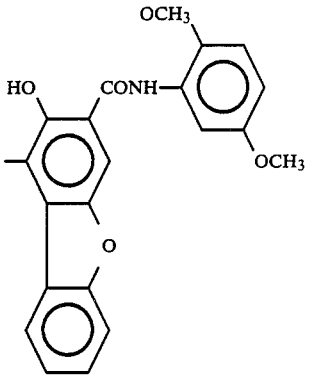  |
| 1-24 | 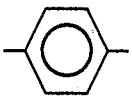 | 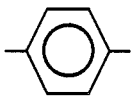 | 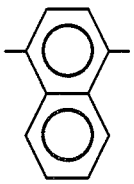 | 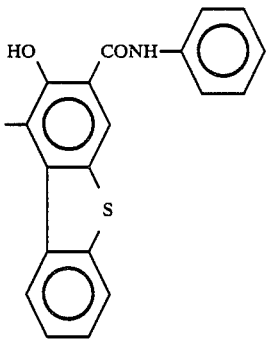  |

TABLE 1-continued
| Azo pigment No. | $Ar_1$ | $Ar_2$ | $Ar_3$ | A |
|---|---|---|---|---|
| 1-25 | 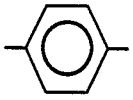 | 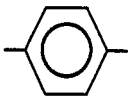 | 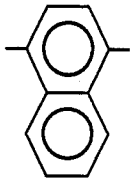 | 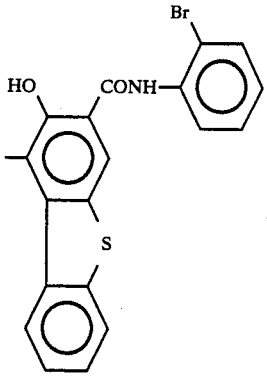  |
| 1-26 | 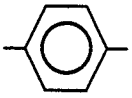 | 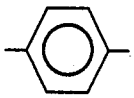 | 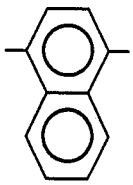 | 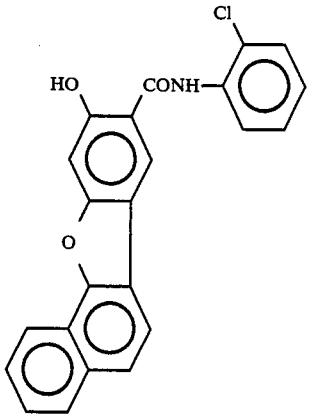  |
| 1-27 | 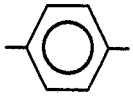 | 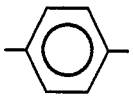 | 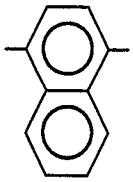 | 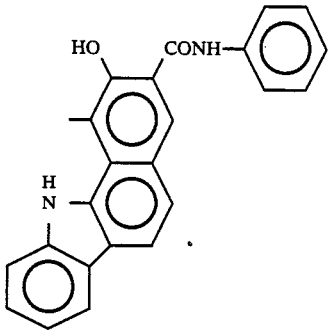  |
| 1-28 | 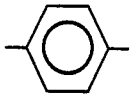 | 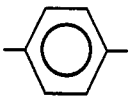 | 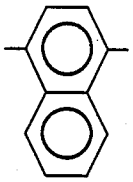 | 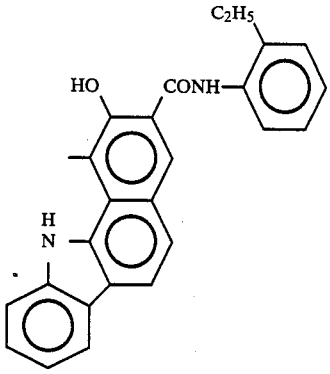  |

TABLE 1-continued
| Azo pigment No. | $Ar_1$ | $Ar_2$ | $Ar_3$ | A |
|---|---|---|---|---|
| 1-29 | 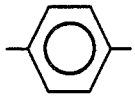 | 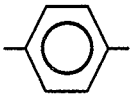 | 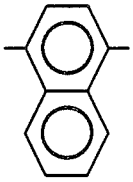 | 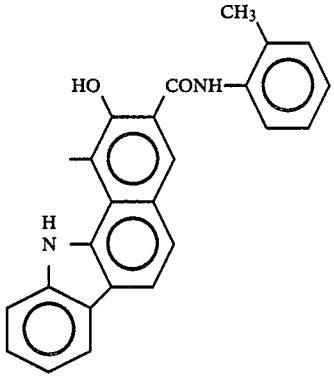 |
| 1-30 | 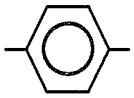 | 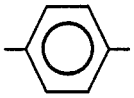 | 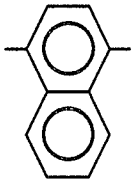 | 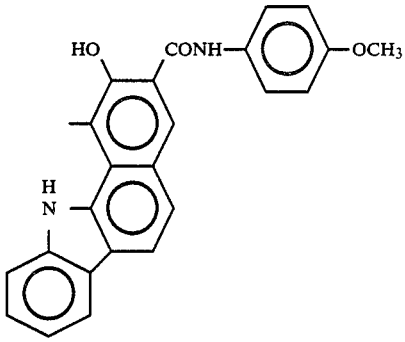 |
| 1-31 | 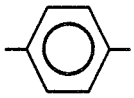 | 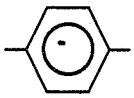 | 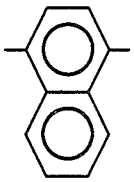 | 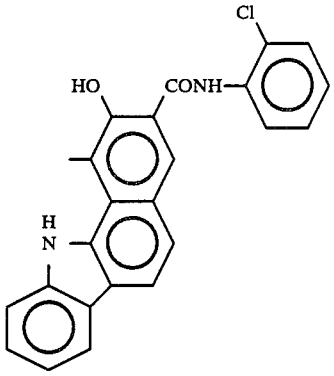 |
| 1-32 | 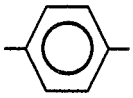 | 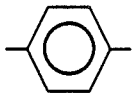 | 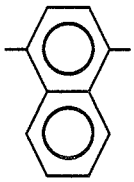 | 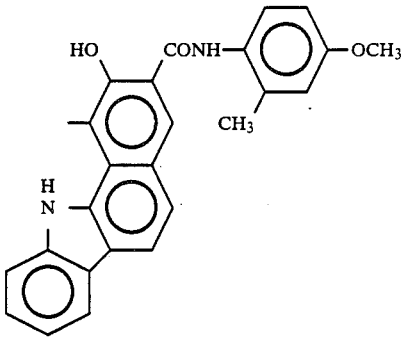 |

TABLE 1-continued
| Azo pigment No. | $Ar_1$ | $Ar_2$ | $Ar_3$ | A |
|---|---|---|---|---|
| 1-33 | 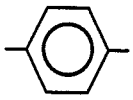 | 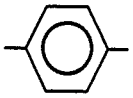 | 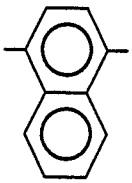 | 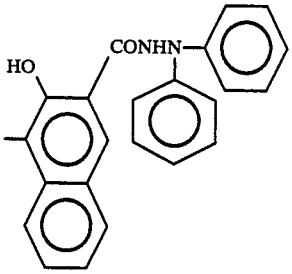 |
| 1-34 | 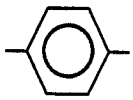 | 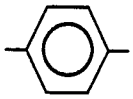 | 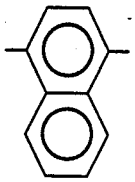 | 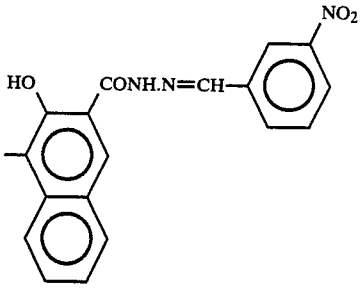 |
| 1-35 | 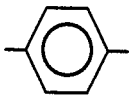 | 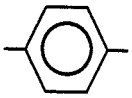 | 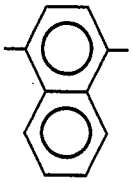 | 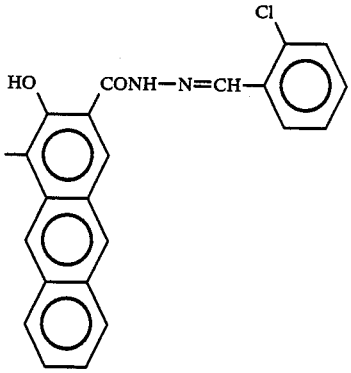 |
| 1-36 | 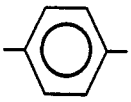 | 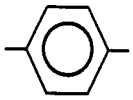 | 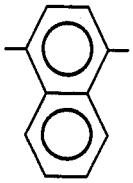 | 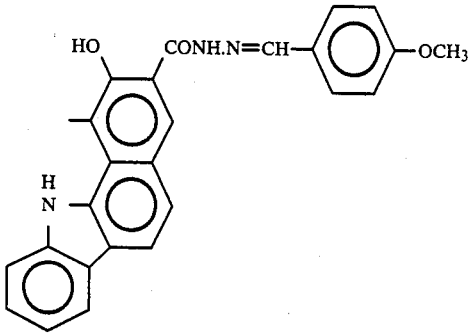 |

TABLE 1-continued
| Azo pigment No. | $Ar_1$ | $Ar_2$ | $Ar_3$ | A |
|---|---|---|---|---|
| 1-37 | 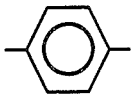 | 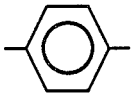 | 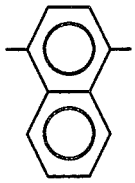 | 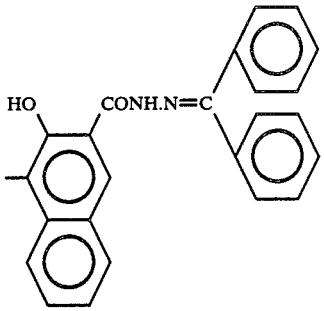  |
| 1-38 | 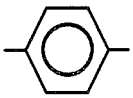 | 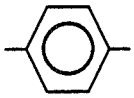 | 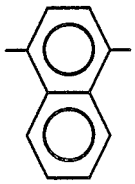 | 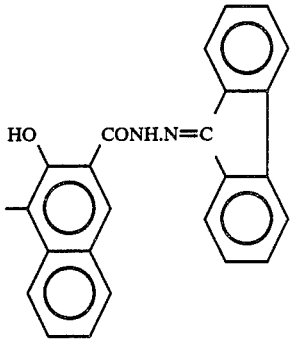  |
| 1-39 | 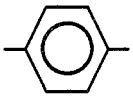 | 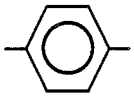 | 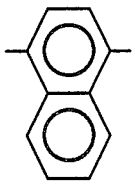 | 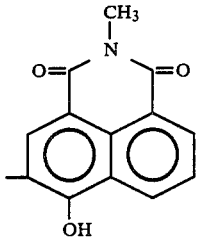  |
| 1-40 | 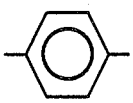 | 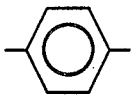 | 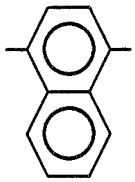 | 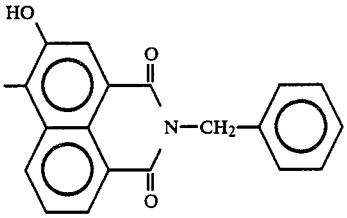  |
| 1-41 | 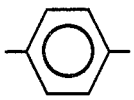 | 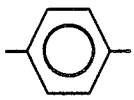 | 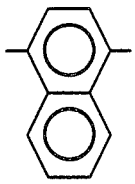 | 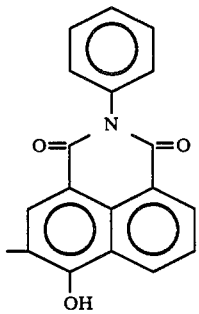  |

TABLE 1-continued
| Azo pigment No. | $Ar_1$ | $Ar_2$ | $Ar_3$ | A |
|---|---|---|---|---|
| 1-42 | 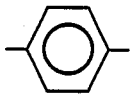 | 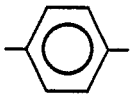 | 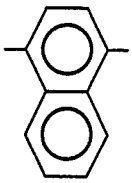 | 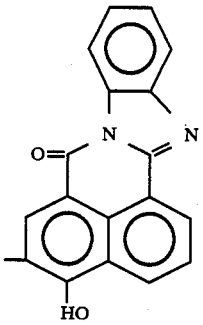 |
| 1-43 | 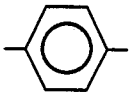 | 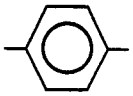 | 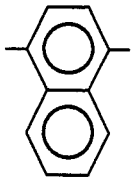 | 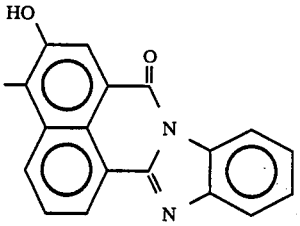 |
| 1-44 | 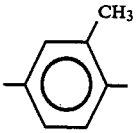 | 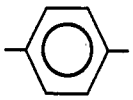 | 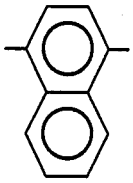 | 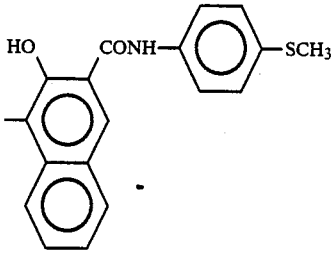 |
| 1-45 | 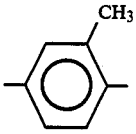 | 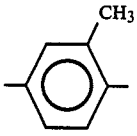 | 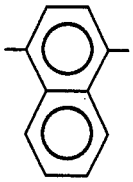 | 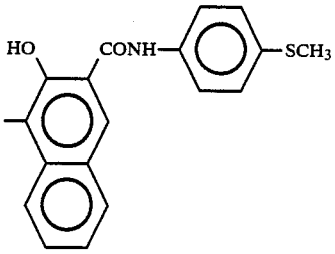 |
| 1-46 | 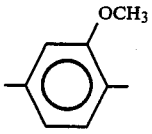 | 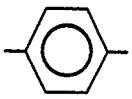 | 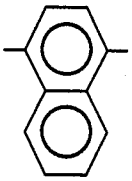 | 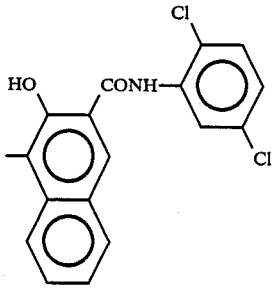 |

TABLE 1-continued
| Azo pigment No. | $Ar_1$ | $Ar_2$ | $Ar_3$ | A |
|---|---|---|---|---|
| 1-47 | 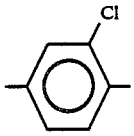 | 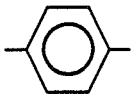 | 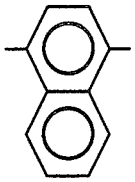 | 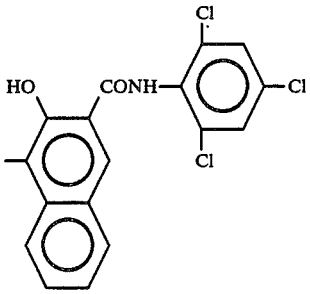 |
| 1-48 | 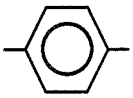 | 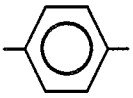 | 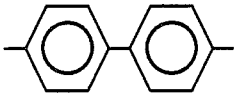 | 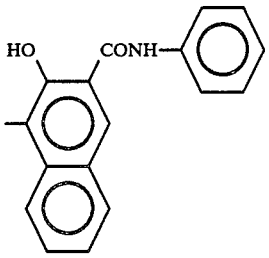 |
| 1-49 | 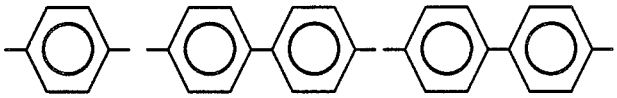 | | | 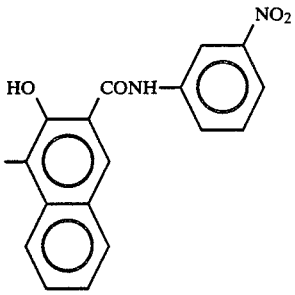 |
| 1-50 | 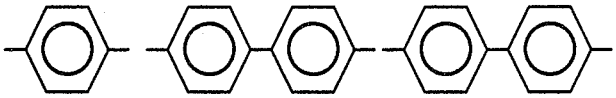 | | | 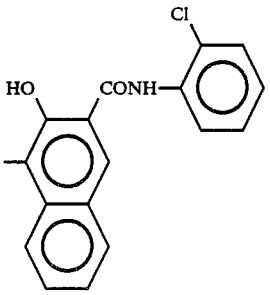 |
| 1-51 | 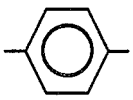 | 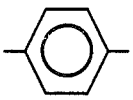 | 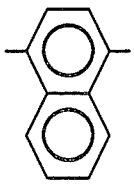 | 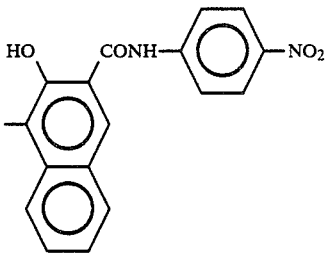 |

TABLE 1-continued
| Azo pigment No. | $Ar_1$ | $Ar_2$ | $Ar_3$ | A |
|---|---|---|---|---|
| 1-52 | 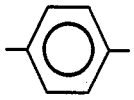 | 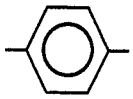 | 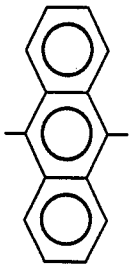 | 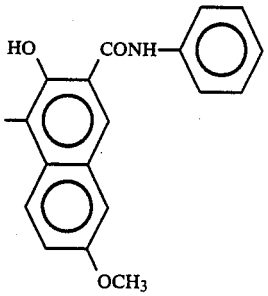  |
| 1-53 | 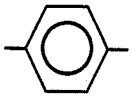 | 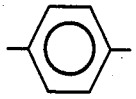 | 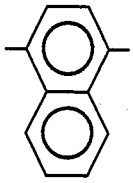 | 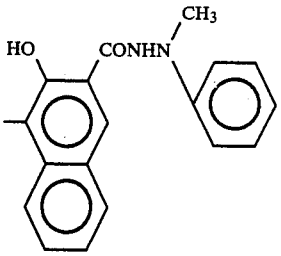  |
| 1-54 | 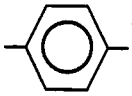 | 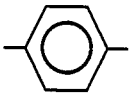 | 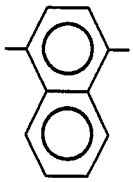 | 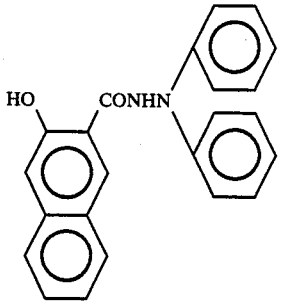  |
| 1-55 | 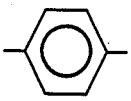 | 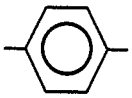 | 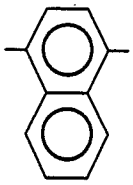 | 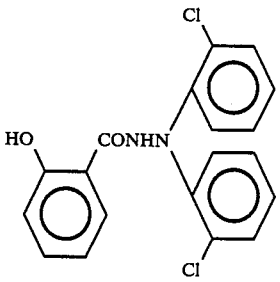  |

TABLE 1-continued
| Azo pigment No. | $Ar_1$ | $Ar_2$ | $Ar_3$ | A |
|---|---|---|---|---|
| 1-56 | 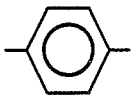 | 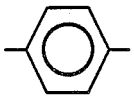 | 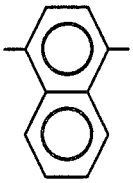 | 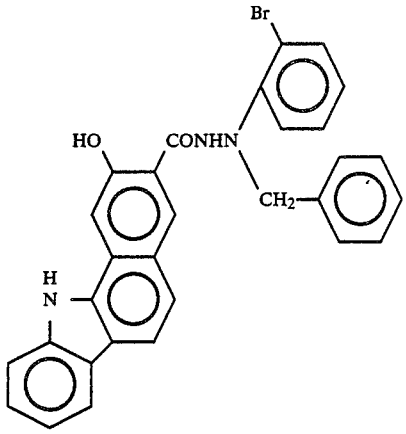  |
| 1-57 | 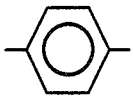 | 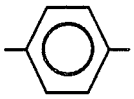 | 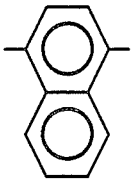 | 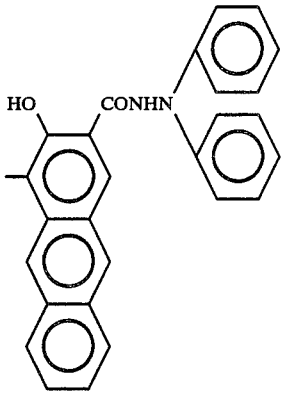  |

TABLE 2
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-1 | 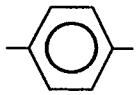 | 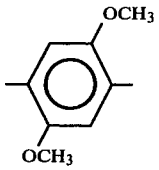 | 0 | None | 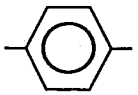 | 0 | None | 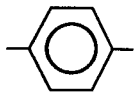 | 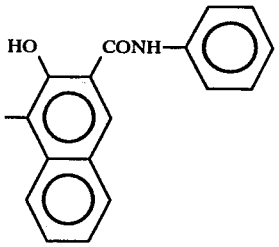 |
| 2-2 | 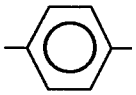 | 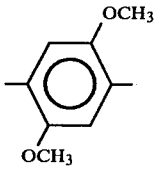 | 0 | None | 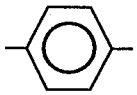 | 0 | None | 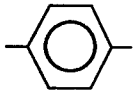 | 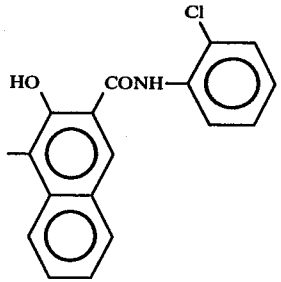 |
| 2-3 | 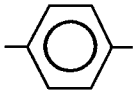 | 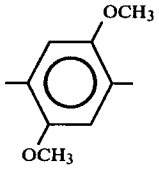 | 0 | None | 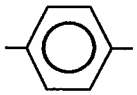 | 0 | None | 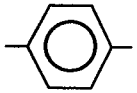 | 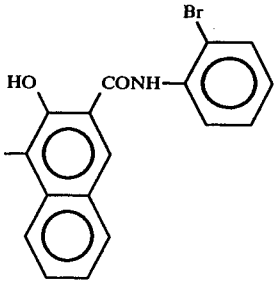 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-4 | 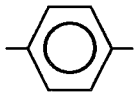 | 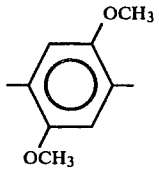 | 0 | None | 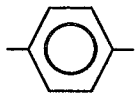 | 0 | None | 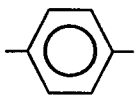 | 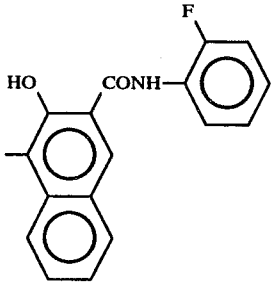 |
| 2-5 | 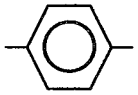 | 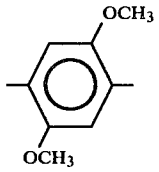 | 0 | None | 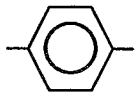 | 0 | None | 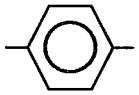 | 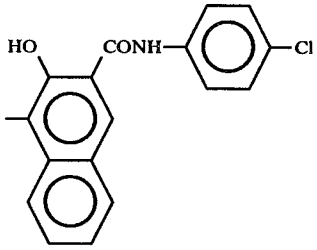 |
| 2-6 | 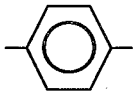 | 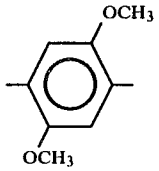 | 0 | None | 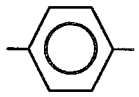 | 0 | None | 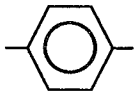 | 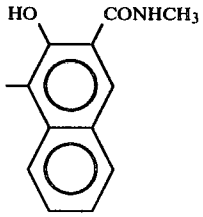 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-7 | 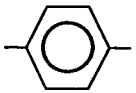 | 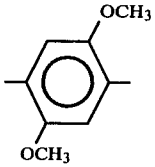 | 0 | None | 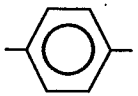 | 0 | None | 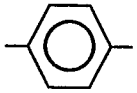 | 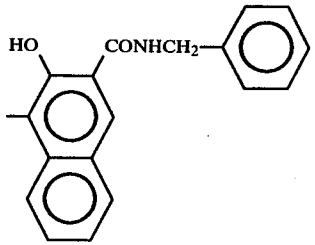 |
| 2-8 | 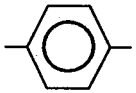 | 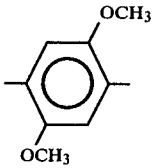 | 0 | None | 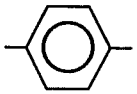 | 0 | None | 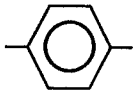 | 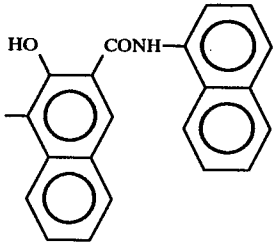 |
| 2-9 | 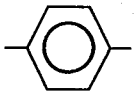 | 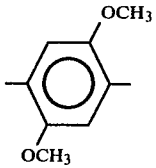 | 0 | None | 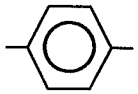 | 0 | None | 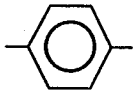 | 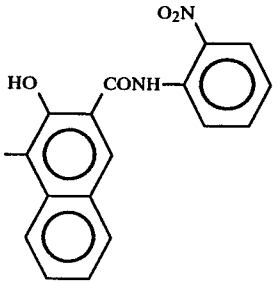 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-10 | 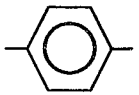 | 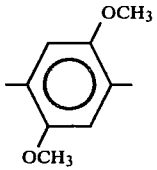 | 0 | None | 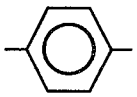 | 0 | None | 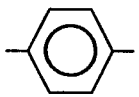 | 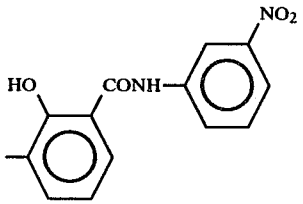 |
| 2-11 | 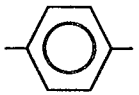 | 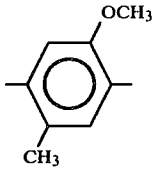 | 0 | None | 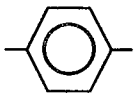 | 0 | None | 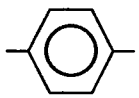 | 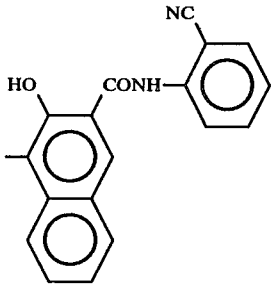 |
| 2-12 | 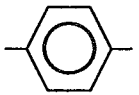 | 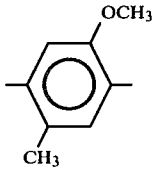 | 0 | None | 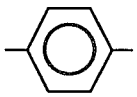 | 0 | None | 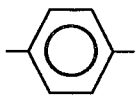 | 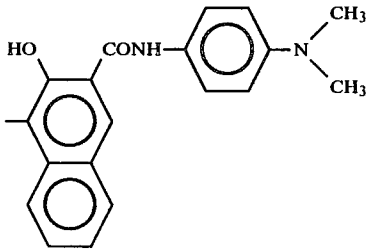 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-13 | 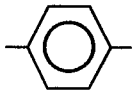 | 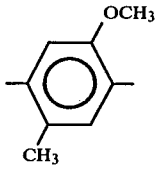 | 0 | None | 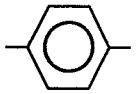 | 0 | None | 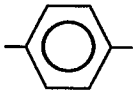 | 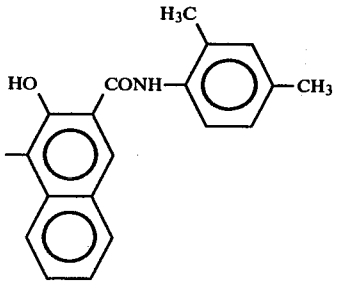 |
| 2-14 | 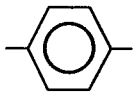 | 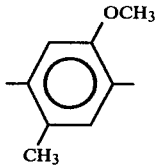 | 0 | None | 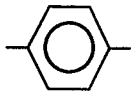 | 0 | None | 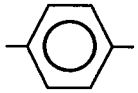 | 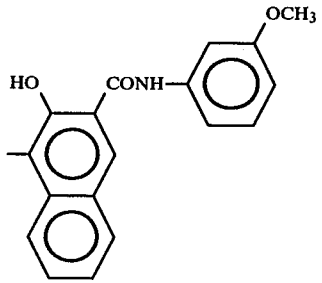 |
| 2-15 | 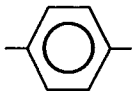 | 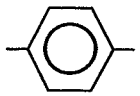 | 0 | None | 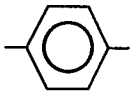 | 0 | None | 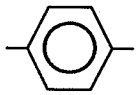 | 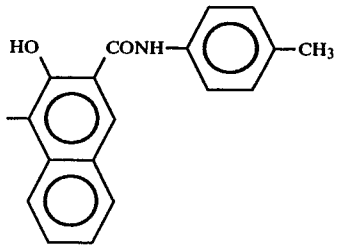 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-16 | 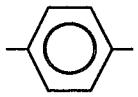 | 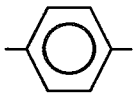 | 0 | None | 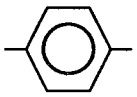 | 0 | None | 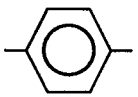 | 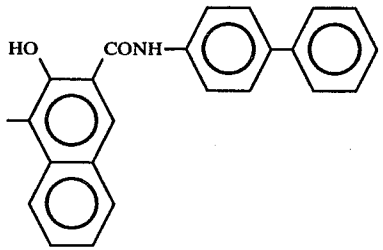  |
| 2-17 | 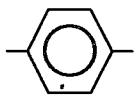 | 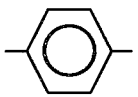 | 0 | None | 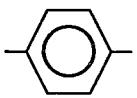 | 0 | None | 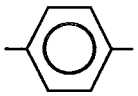 | 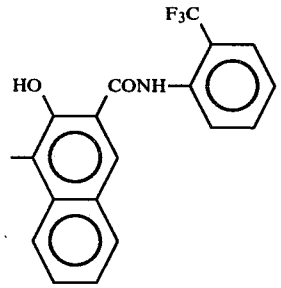  |
| 2-18 | 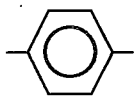 | 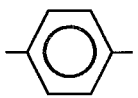 | 0 | None | 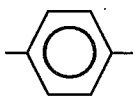 | 0 | None | 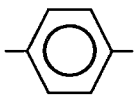 | 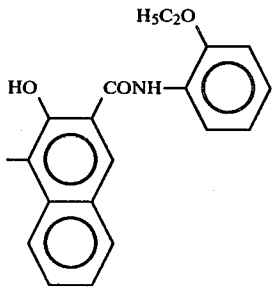  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-19 | 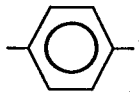 | 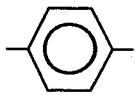 | 0 | None | 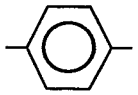 | 0 | None | 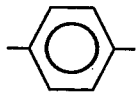 | 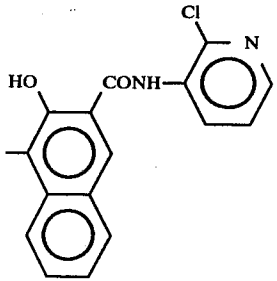 |
| 2-20 | 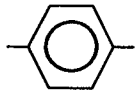 | 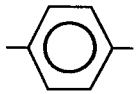 | 0 | None | 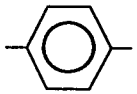 | 0 | None | 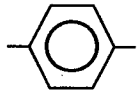 | 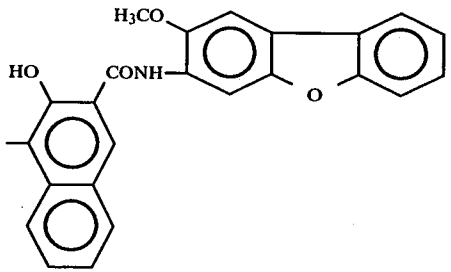 |
| 2-21 | 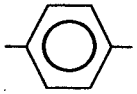 | 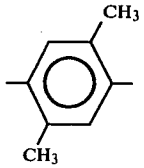 | 0 | None | 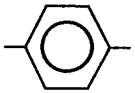 | 0 | None | 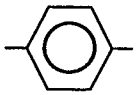 | 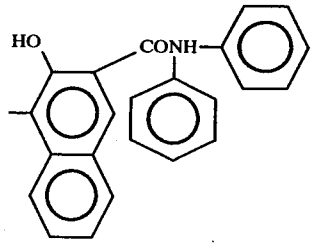 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-22 | 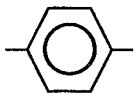 | 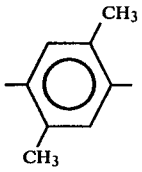 | 0 | None | 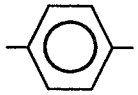 | 0 | None | 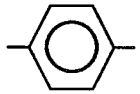 | 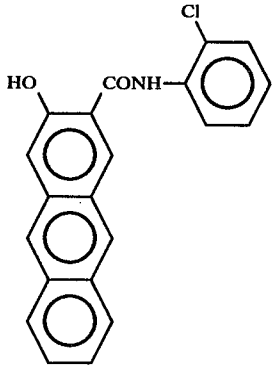 |
| 2-23 | 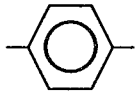 | 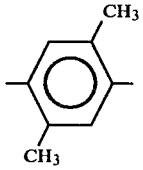 | 0 | None | 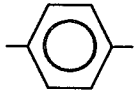 | 0 | None | 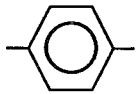 | 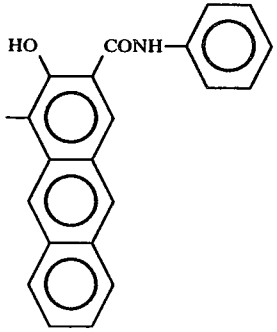 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-24 | 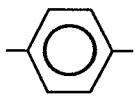 | 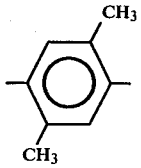 | 0 | None | 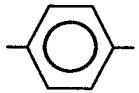 | 0 | None | 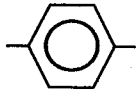 | 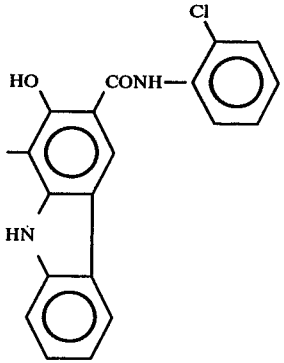 |
| 2-25 | 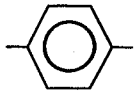 | 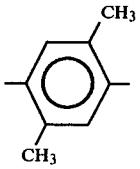 | 0 | None | 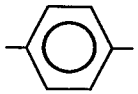 | 0 | None | 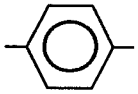 | 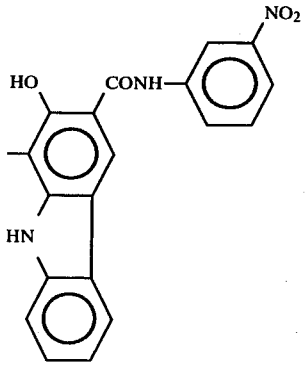 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-26 | 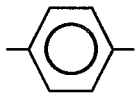 | 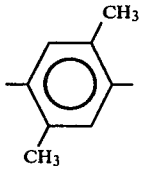 | 0 | None | 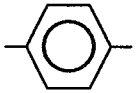 | 0 | None | 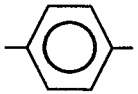 | 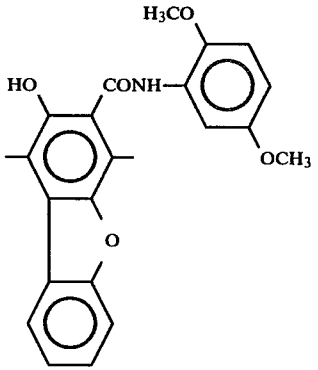 |
| 2-27 | 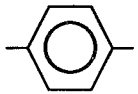 | 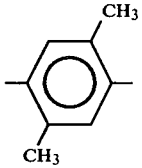 | 0 | None | 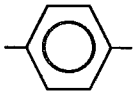 | 0 | None | 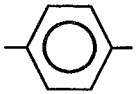 | 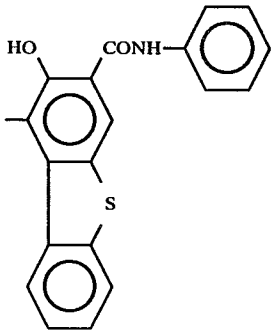 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-28 | 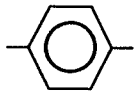 | 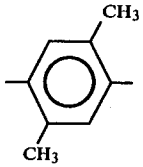 | 0 | None | 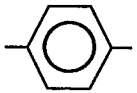 | 0 | None | 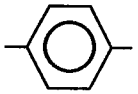 | 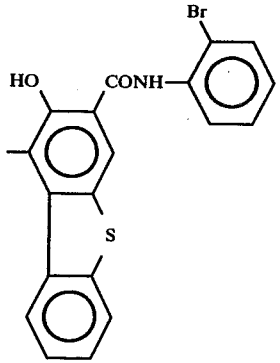 |
| 2-29 | 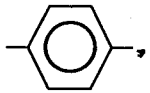 | 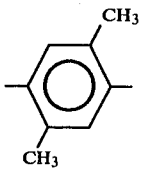 | 0 | None | 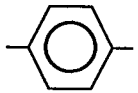 | 0 | None | 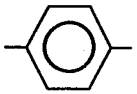 | 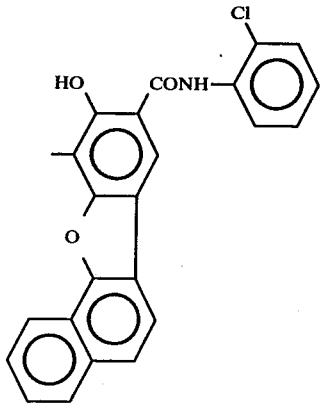 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-30 | 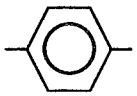 | 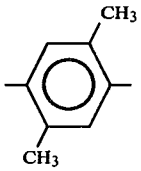 | 0 | None | 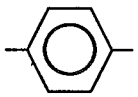 | 0 | None | 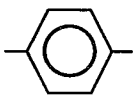 | 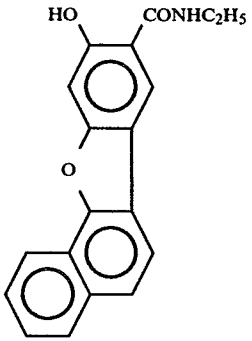 |
| 2-31 | 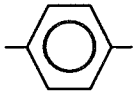 | 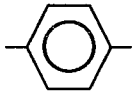 | 1 | 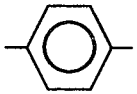 | 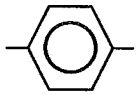 | 1 | 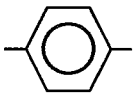 | 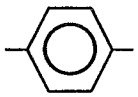 | 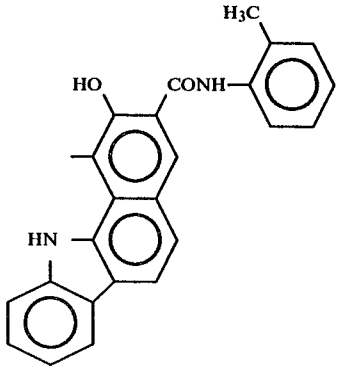 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-32 | 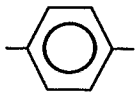 | 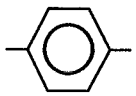 | 1 | 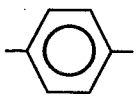 | 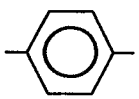 | 1 | 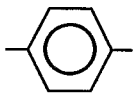 | 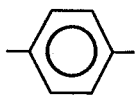 | 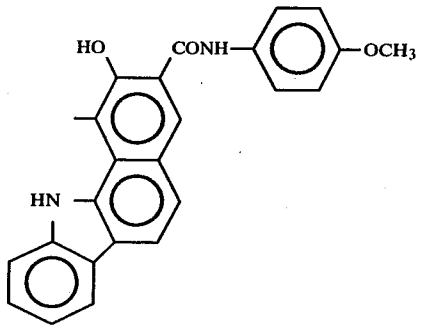 |
| 2-33 | 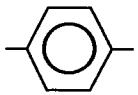 | 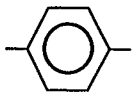 | 1 | 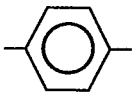 | 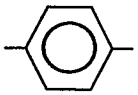 | 1 | 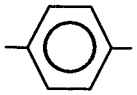 | 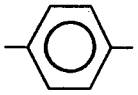 | 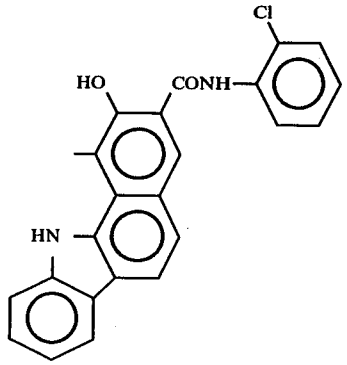 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-34 | 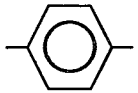 | 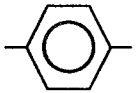 | 1 | 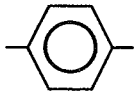 | 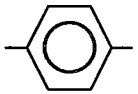 | 1 | 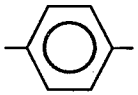 | 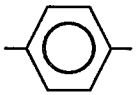 | 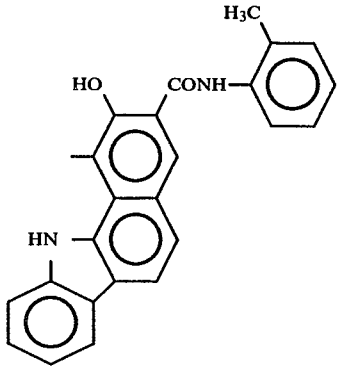 |
| 2-35 | 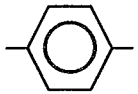 | 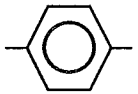 | 1 | 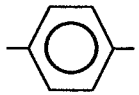 | 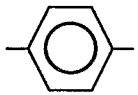 | 1 | 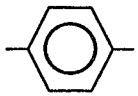 | 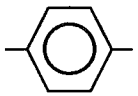 | 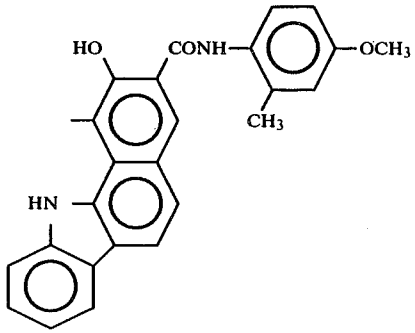 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-36 | 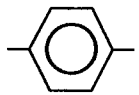 | 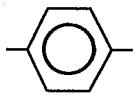 | 1 | 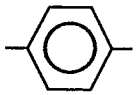 | 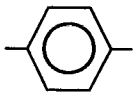 | 1 | 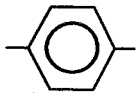 | 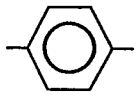 | 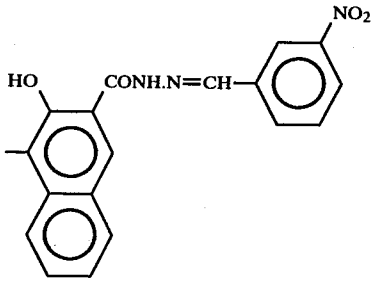  |
| 2-37 | 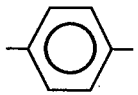 | 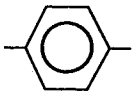 | 1 | 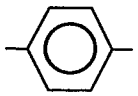 | 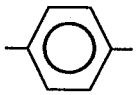 | 1 | 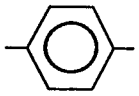 | 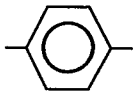 | 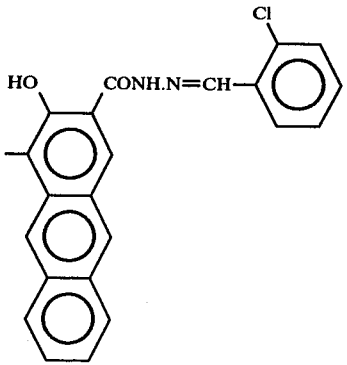  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-38 | 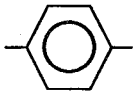 | 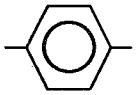 | 1 | 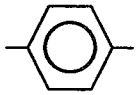 | 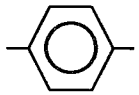 | 1 | 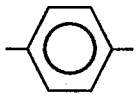 | 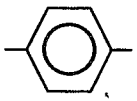 | 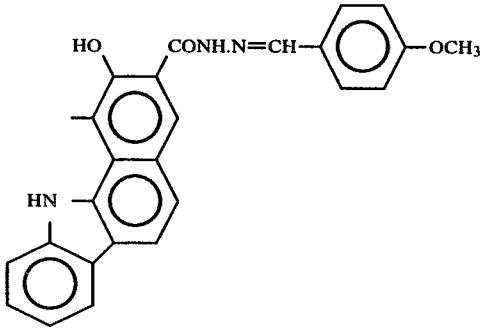  |
| 2-39 | 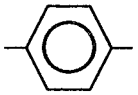 | 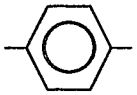 | 1 | 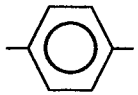 | 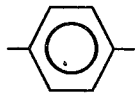 | 1 | 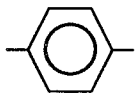 | 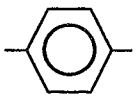 | 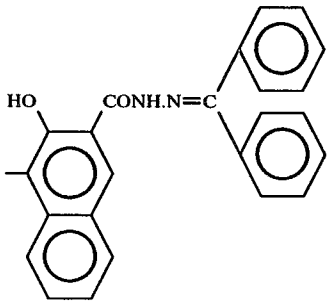  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-40 | 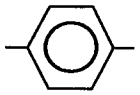 | 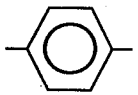 | 1 | 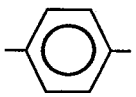 | 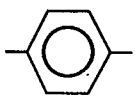 | 1 | 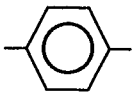 | 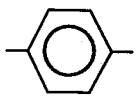 | 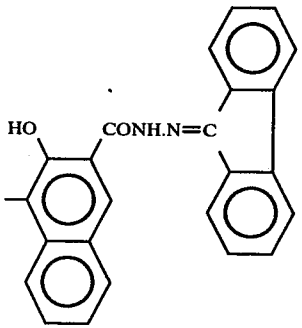  |
| 2-41 | 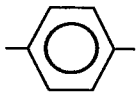 | 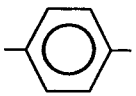 | 0 | None | 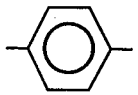 | 0 | None | 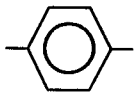 | 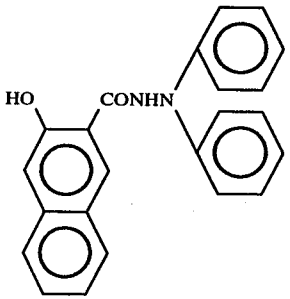  |
| 2-42 | 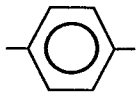 | 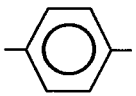 | 0 | None | 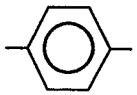 | 0 | None | 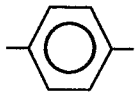 | 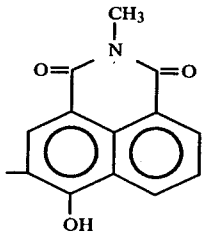  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-43 | 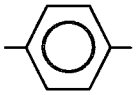 | 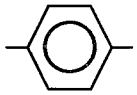 | 0 | None | 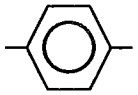 | 0 | None | 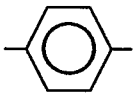 | 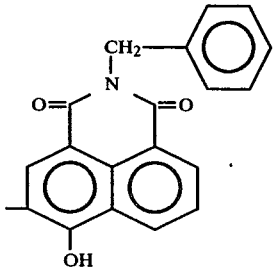 |
| 2-44 | 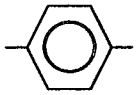 | 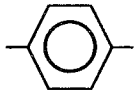 | 0 | None | 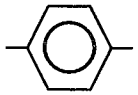 | 0 | None | 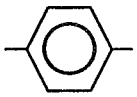 | 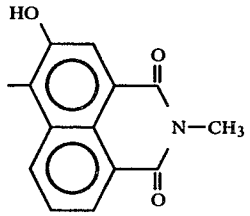 |
| 2-45 | 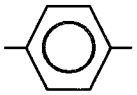 | 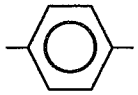 | 0 | None | 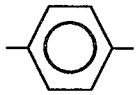 | 0 | None | 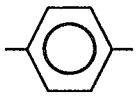 | 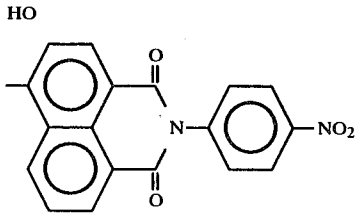 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-46 | 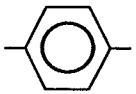 | 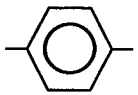 | 0 | None | 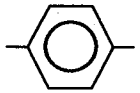 | 0 | None | 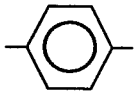 | 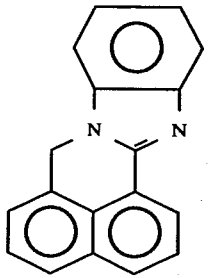 |
| 2-47 | 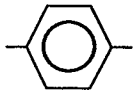 | 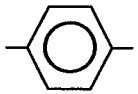 | 0 | None | 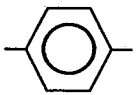 | 0 | None | 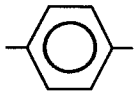 | 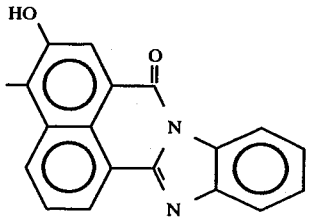 |
| 2-48 | 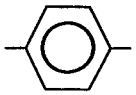 | 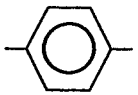 | 0 | None | 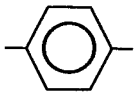 | 0 | None | 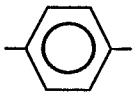 | 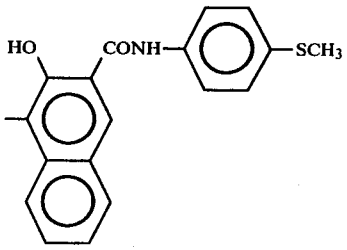 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-49 | 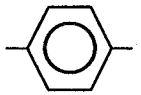 | 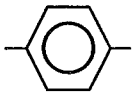 | 0 | None | 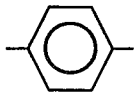 | 0 | None | 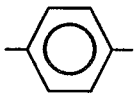 | 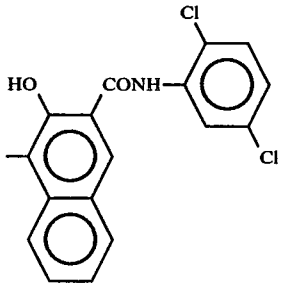 |
| 2-50 | 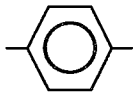 | 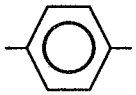 | 0 | None | 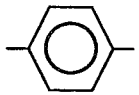 | 0 | None | 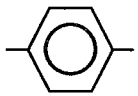 | 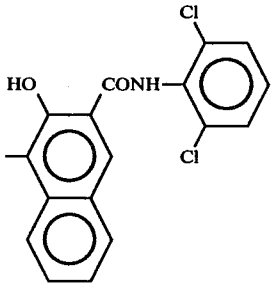 |
| 2-51 | 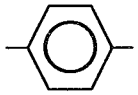 | 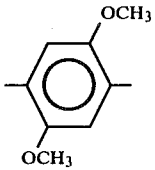 | 1 | 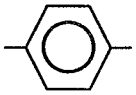 | 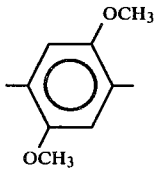 | 0 | None | 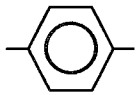 | 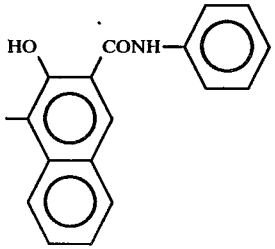 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-52 | 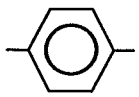 | 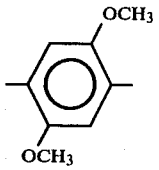 | 1 | 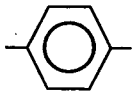 | 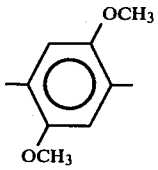 | 1 | 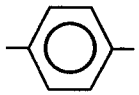 | 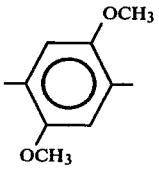 | 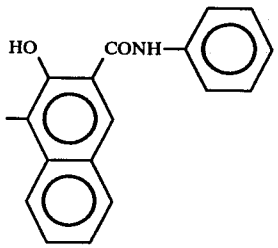 |
| 2-53 | 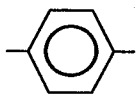 | 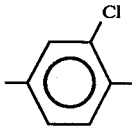 | 1 | 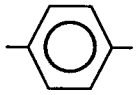 | 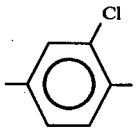 | 1 | 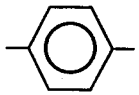 | 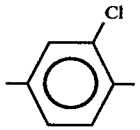 | 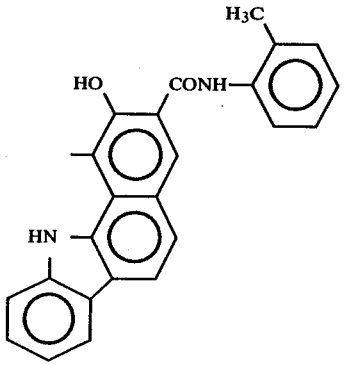 |
| 2-54 | 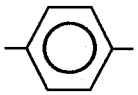 | 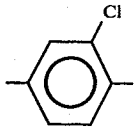 | 1 | 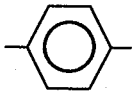 | 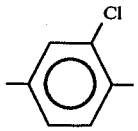 | 1 | 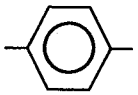 | 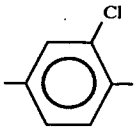 | 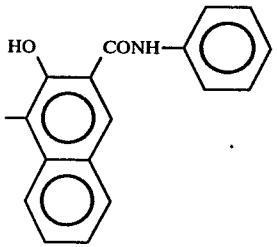 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-55 | 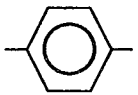 | 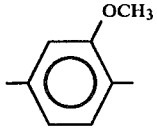 | 1 | 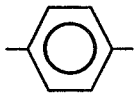 | 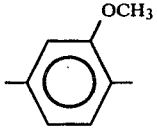 | 1 | 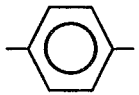 | 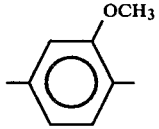 | 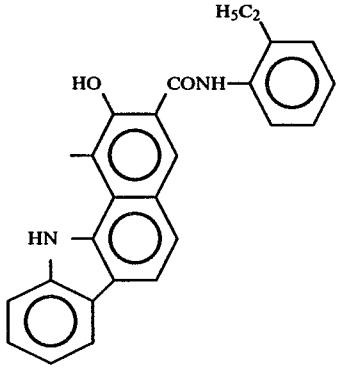 |
| 2-56 | 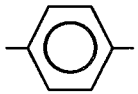 | 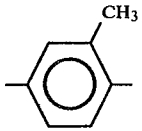 | 1 | 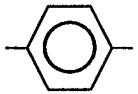 | 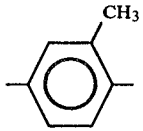 | 1 | 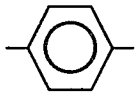 | 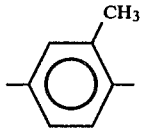 | 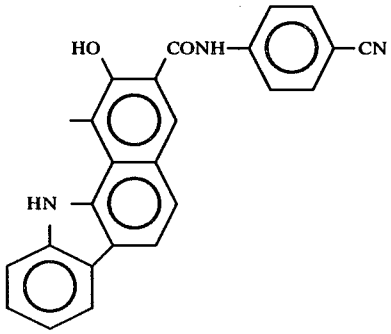 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-57 | 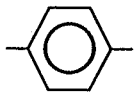 | 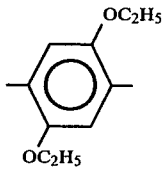 | 1 | 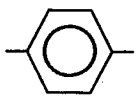 | 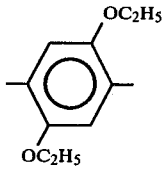 | 1 | 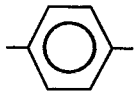 | 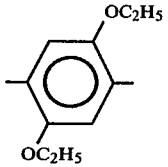 | 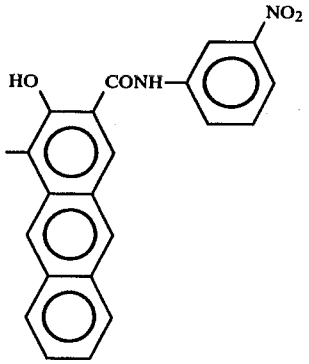 |
| 2-58 | 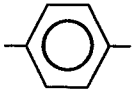 | 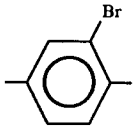 | 0 | 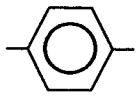 | 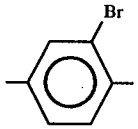 | 0 | 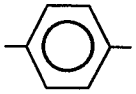 | 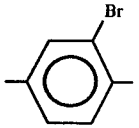 | 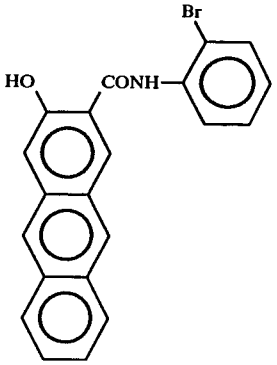 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-59 | 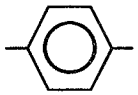 | 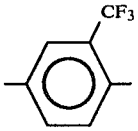 | 0 | 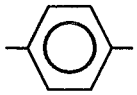 | 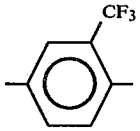 | 0 | 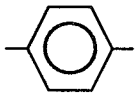 | 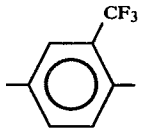 | 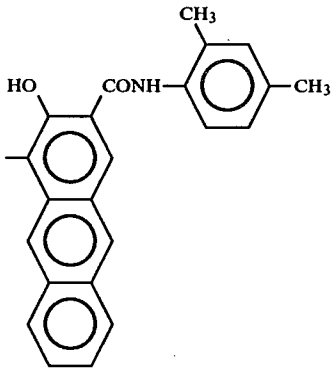 |
| 2-60 | 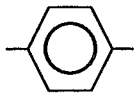 | 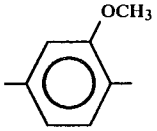 | 1 | 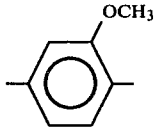 | 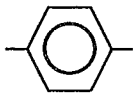 | 1 | 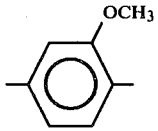 | 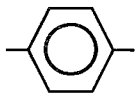 | 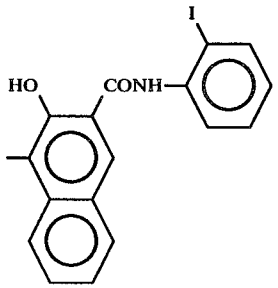 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-61 | 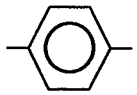 | 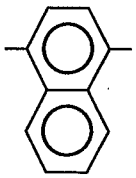 | 1 | 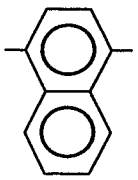 | 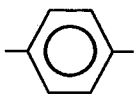 | 1 | 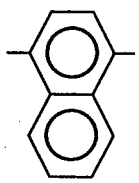 | 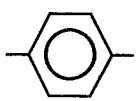 | 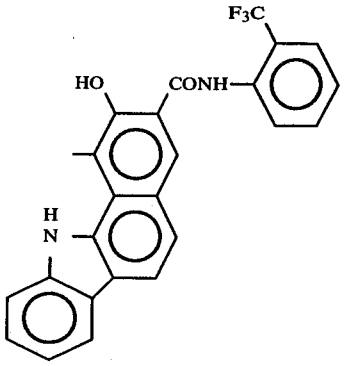  |
| 2-62 | 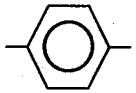 | 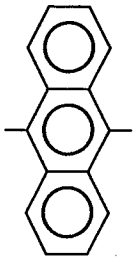 | 0 | None | 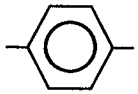 | 0 | None | 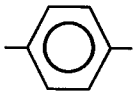 | 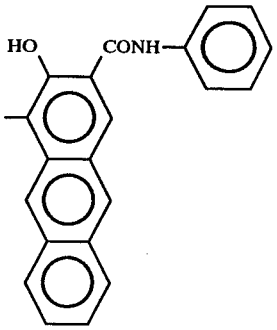  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-63 | 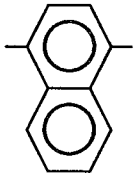 | 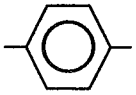 | 1 | 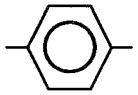 | 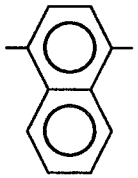 | 1 | 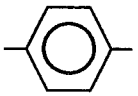 | 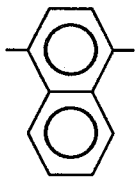 | 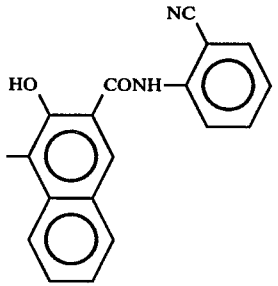 |
| 2-64 | 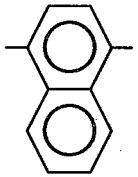 | 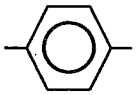 | 1 | 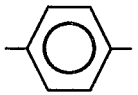 | 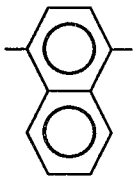 | 1 | 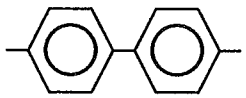 | 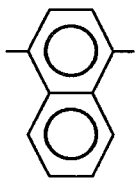 | 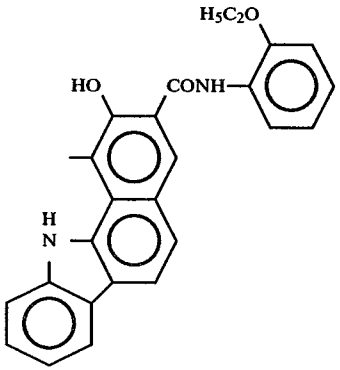 |
| 2-65 | 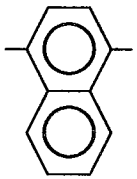 | 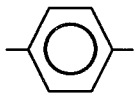 | 1 | 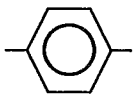 | 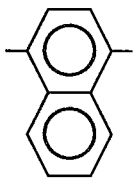 | 1 | 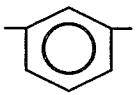 | 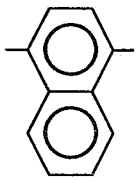 | 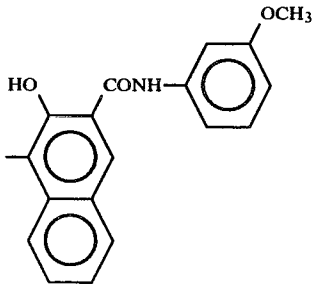 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-66 | 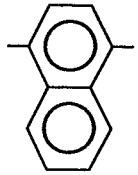 | 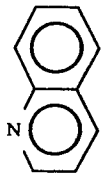 | 1 | 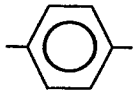 | 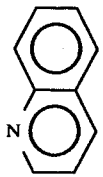 | 1 | 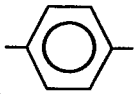 | 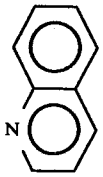 | 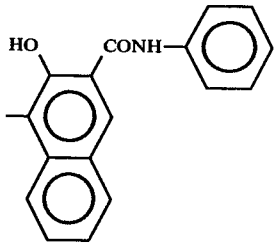 |
| 2-67 | 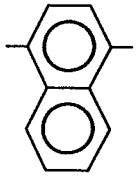 | 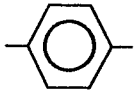 | 1 | 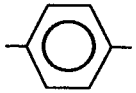 | 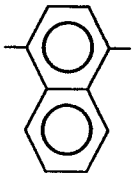 | 1 | 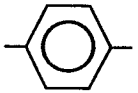 | 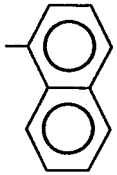 | 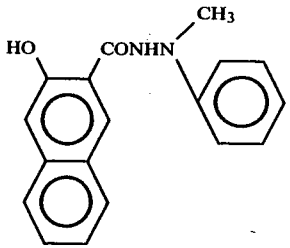 |
| 2-68 | 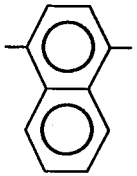 | 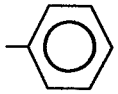 | 1 | 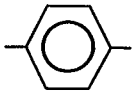 | 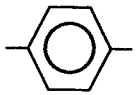 | 1 | 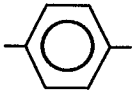 | 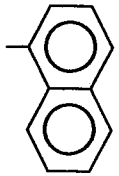 | 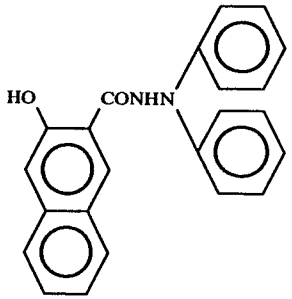 |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-69 | 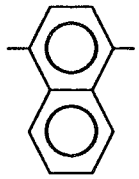 | 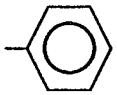 | 1 | 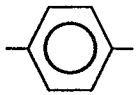 | 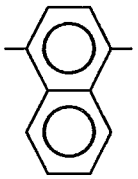 | 1 | 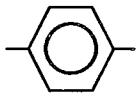 | 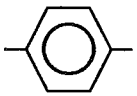 | 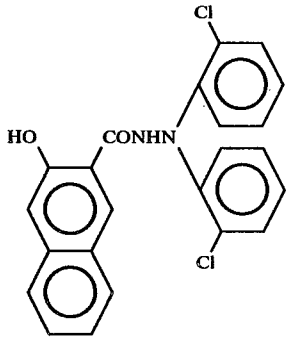  |
| 2-70 | 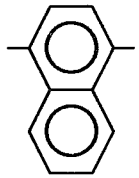 | 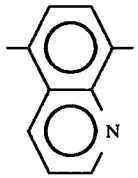  | 1 | 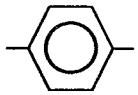 | 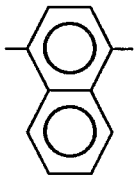 | 1 | 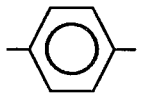 | 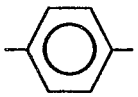 | 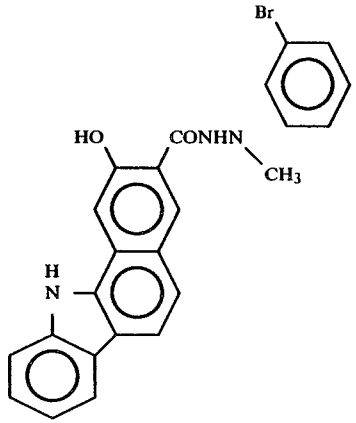  |

TABLE 2-continued
| Azo pigment No. | $Ar_1$ | $Ar_2$ | l | $Ar_3$ | $Ar_4$ | m | $Ar_5$ | $Ar_6$ | A |
|---|---|---|---|---|---|---|---|---|---|
| 2-71 | 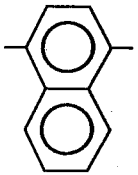 | 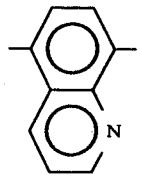 | 1 | 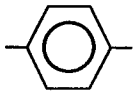 | 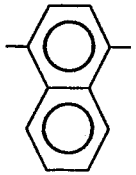 | 1 | 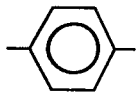 | 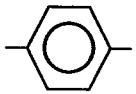 | 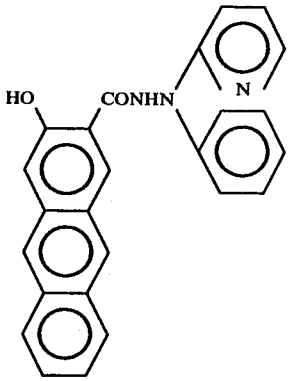 |

TABLE 3
| Azo pigment No. | $Ar_1$ | $Ar_2$ | $Ar_3$ | n | $Ar_4$ |
|---|---|---|---|---|---|
| 3-1 | 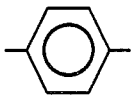 | 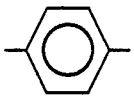 | 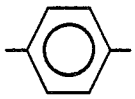 | 0 | — |
| 3-2 | 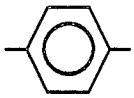 | 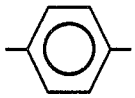 | 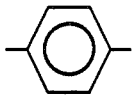 | 0 | — |
| 3-3 | 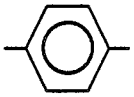 | 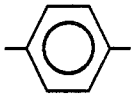 | 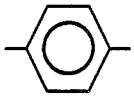 | 0 | — |
| 3-4 | 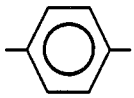 | 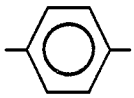 | 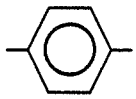 | 0 | — |
| 3-5 | 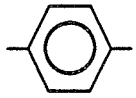 | 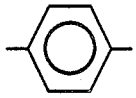 | 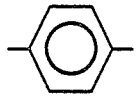 | 0 | — |
| 3-6 | 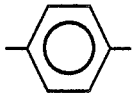 | 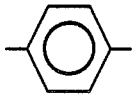 | 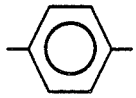 | 0 | — |
| 3-7 | 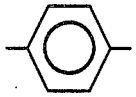 | 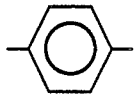 | 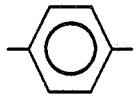 | 0 | — |
| 3-8 | 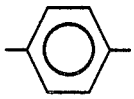 | 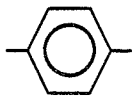 | 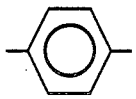 | 0 | — |
| 3-9 | 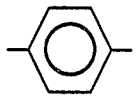 | 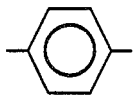 | 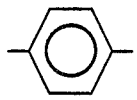 | 0 | — |
| 3-10 | 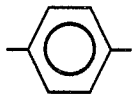 | 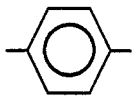 | 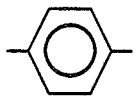 | 0 | — |
| 3-11 | 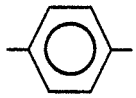 | 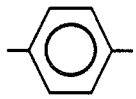 | 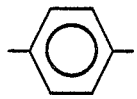 | 0 | — |
| 3-12 | 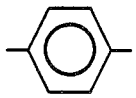 | 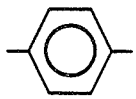 | 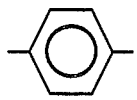 | 0 | — |
| 3-13 | 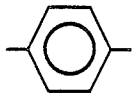 | 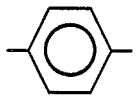 | 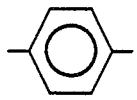 | 0 | — |

TABLE 3-continued
| | | | | | |
|---|---|---|---|---|---|
| 3-14 | 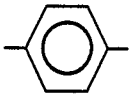 | 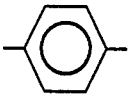 | 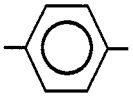 | 1 | 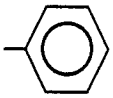 |
| 3-15 | 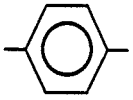 | 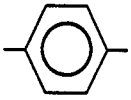 | 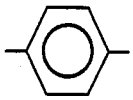 | 1 | 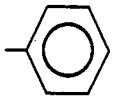 |
| 3-16 | 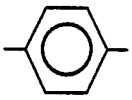 | 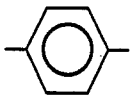 | 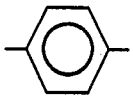 | 1 | 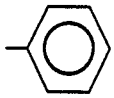 |
| 3-17 | 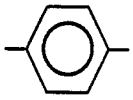 | 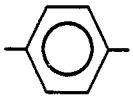 | 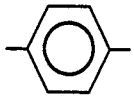 | 1 | 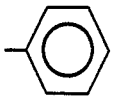 |
| 3-18 | 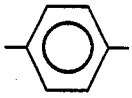 | 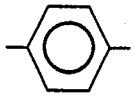 | 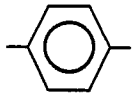 | 1 | 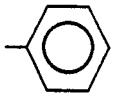 |
| 3-19 | 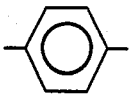 | 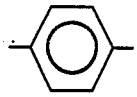 | 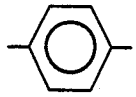 | 1 | 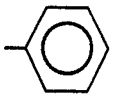 |
| 3-20 | 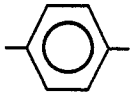 | 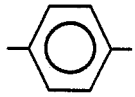 | 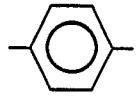 | 1 | 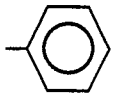 |
| 3-21 | 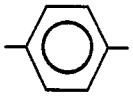 | 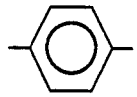 | 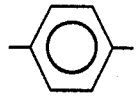 | 1 | 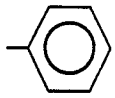 |
| 3-22 | 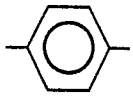 | 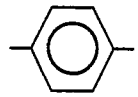 | 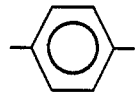 | 1 | 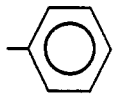 |
| 3-23 | 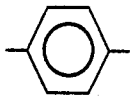 | 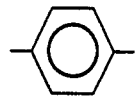 | 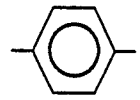 | 1 | 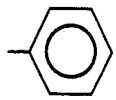 |
| 3-24 | 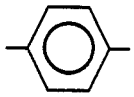 | 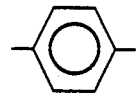 | 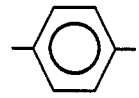 | 1 | 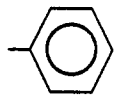 |
| 3-25 | 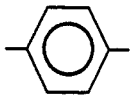 | 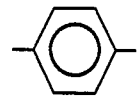 | 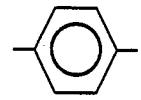 | 1 | 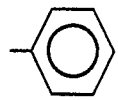 |
| 3-26 | 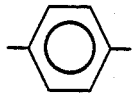 | 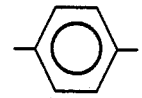 | 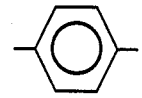 | 1 | 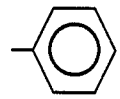 |

TABLE 3-continued
| | | | | | |
|---|---|---|---|---|---|
| 3-27 | 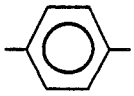 | 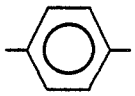 | 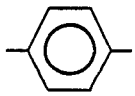 | 0 | — |
| 3-28 | 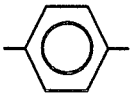 | 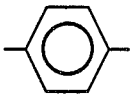 | 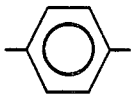 | 0 | — |
| 3-29 | 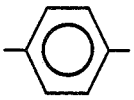 | 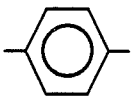 | 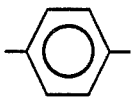 | 0 | — |
| 3-30 | 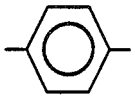 | 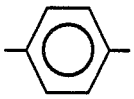 | 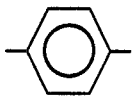 | 0 | — |
| 3-31 | 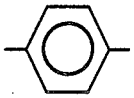 | 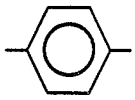 | 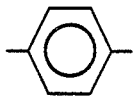 | 0 | — |
| 3-32 | 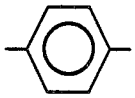 | 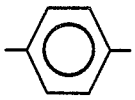 | 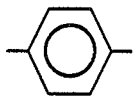 | 0 | — |
| 3-33 | 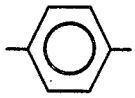 | 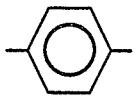 | 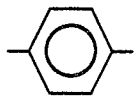 | 1 | 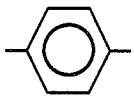 |
| 3-34 | 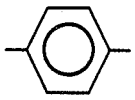 | 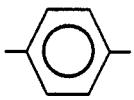 | 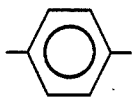 | 1 | 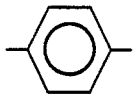 |
| 3-35 | 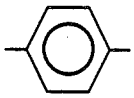 | 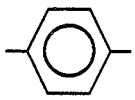 | 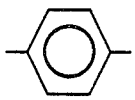 | 0 | — |
| 3-36 | 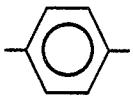 | 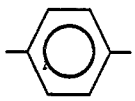 | 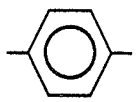 | 0 | — |
| 3-37 | 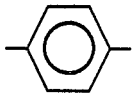 | 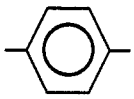 | 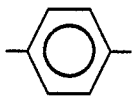 | 0 | — |
| 3-38 | 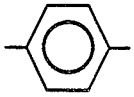 | 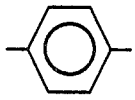 | 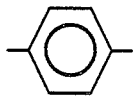 | 1 | 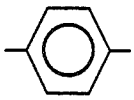 |
| 3-39 | 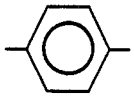 | 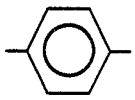 | 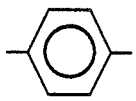 | 1 | 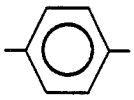 |

TABLE 3-continued
| | | | | | |
|---|---|---|---|---|---|
| 3-40 | 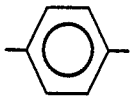 | 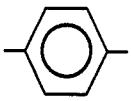 | 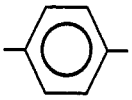 | 1 | 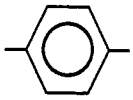 |
| 3-41 | 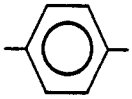 | 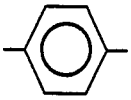 | 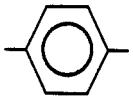 | 1 | 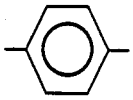 |
| 3-42 | 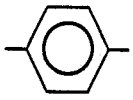 | 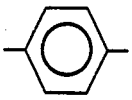 | 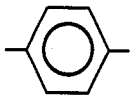 | 1 | 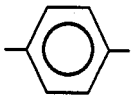 |
| 3-43 | 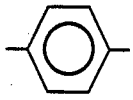 | 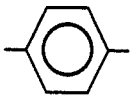 | 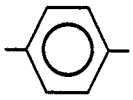 | 1 | 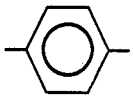 |
| 3-44 | 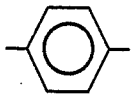 | 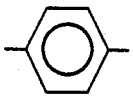 | 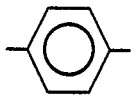 | 0 | — |
| 3-45 | 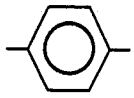 | 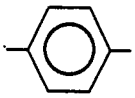 | 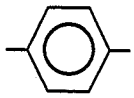 | 1 | 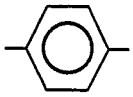 |
| 3-46 | 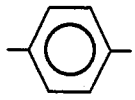 | 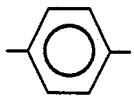 | 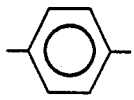 | 1 | 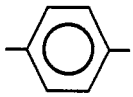 |
| 3-47 | 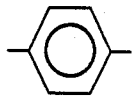 | 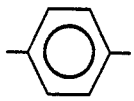 | 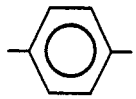 | 1 | 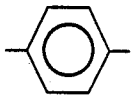 |
| 3-48 | 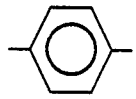 | 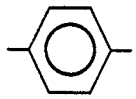 | 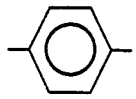 | 1 | 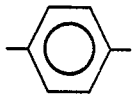 |
| 3-49 | 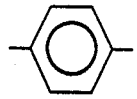 | 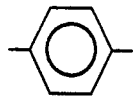 | 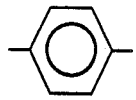 | 1 | 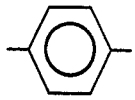 |
| 3-50 | 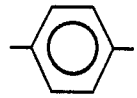 | 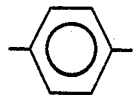 | 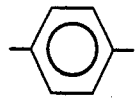 | 1 | 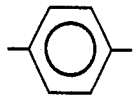 |
| 3-51 | 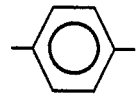 | 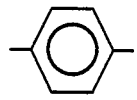 | 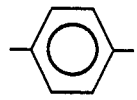 | 0 | — |
| 3-52 | 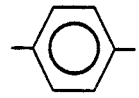 | 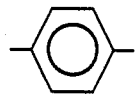 | 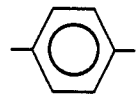 | 1 | 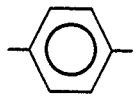 |

TABLE 3-continued
| | | | | | |
|---|---|---|---|---|---|
| 3-53 | 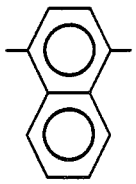 | 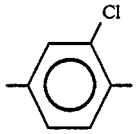 | 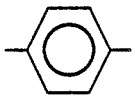 | 1 | 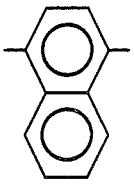 |
| 3-54 | 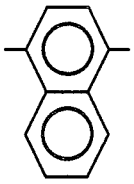 | 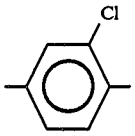 | 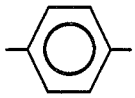 | 1 | 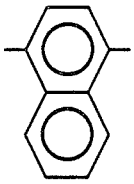 |
| 3-55 | 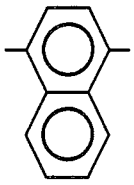 | 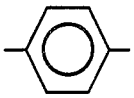 | 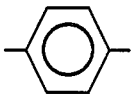 | 1 | 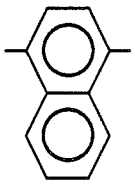 |
| 3-56 | 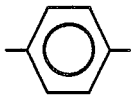 | 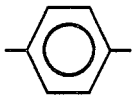 | 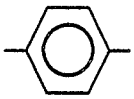 | 1 | 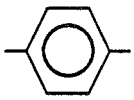 |
| 3-57 | 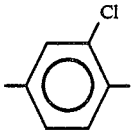 | 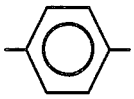 | 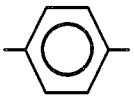 | 1 | 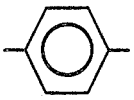 |
| 3-58 | 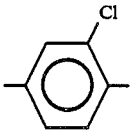 | 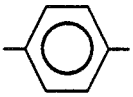 | 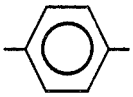 | 1 | 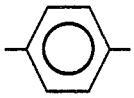 |
| 3-59 | 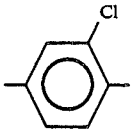 | 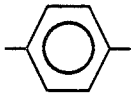 | 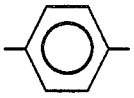 | 1 | 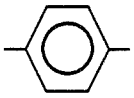 |
| 3-60 | 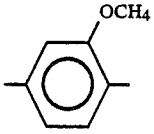 | 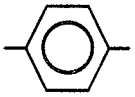 | 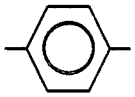 | 0 | — |
| 3-61 | 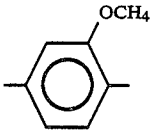 | 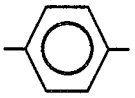 | 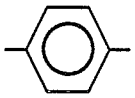 | 1 | 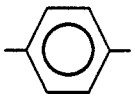 |
| 3-62 | 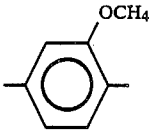 | 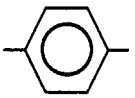 | 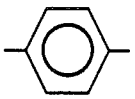 | 0 | — |

TABLE 3-continued
| | | | | | |
|---|---|---|---|---|---|
| 3-63 | 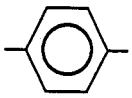 | 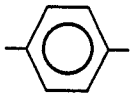 | 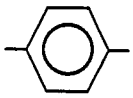 | 0 | — |
| 3-64 | 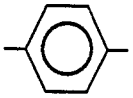 | 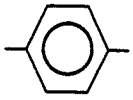 | 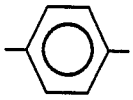 | 0 | — |
| 3-65 | 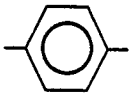 | 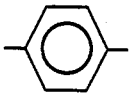 | 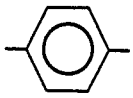 | 1 | — |
| 3-66 | 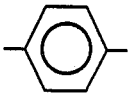 | 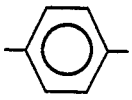 | 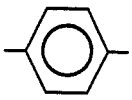 | 0 | — |
| 3-67 | 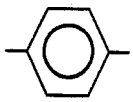 | 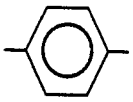 | 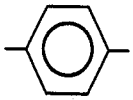 | 1 | 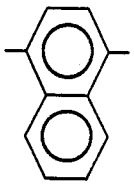 |
| 3-68 | 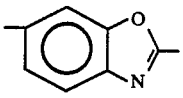 | 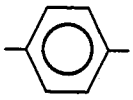 | 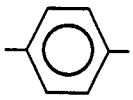 | 1 | 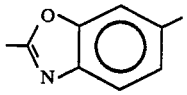 |
| 3-69 | 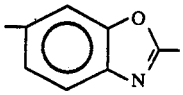 | 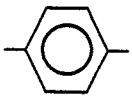 | 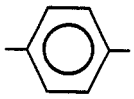 | 1 | 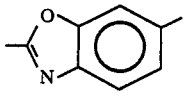 |
| 3-70 | 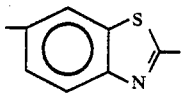 | 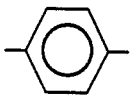 | 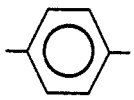 | 1 | 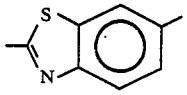 |
| 3-71 | 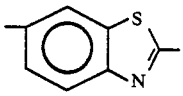 | 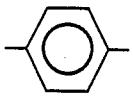 | 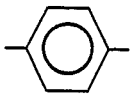 | 1 | 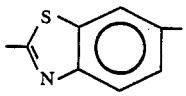 |
| 3-72 | 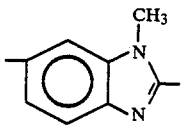 | 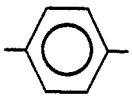 | 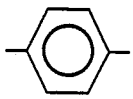 | 1 | 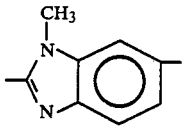 |
| 3-73 | 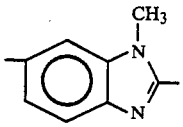 | 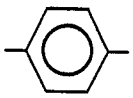 | 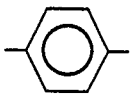 | 1 | 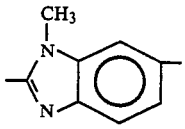 |
| 3-74 | 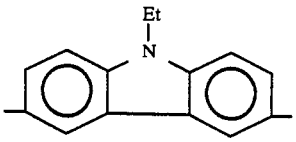 | 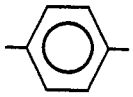 | 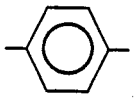 | 1 | 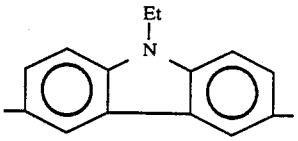 |

TABLE 3-continued
| | | | | | |
|---|---|---|---|---|---|
| 3-75 | 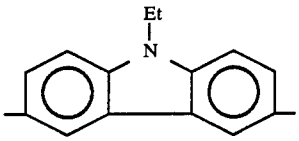 | 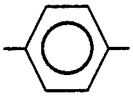 | 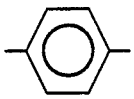 | 1 | 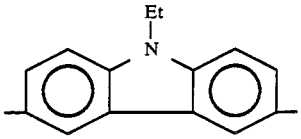 |
| 3-76 | 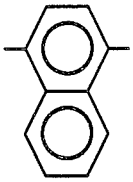 | 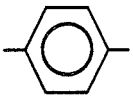 | 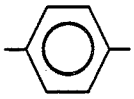 | 1 | 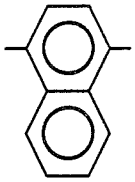 |
| 3-77 | 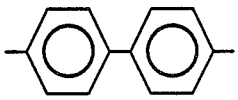 | 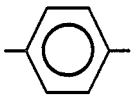 | 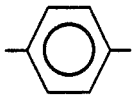 | 1 | 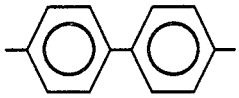 |
| 3-78 | 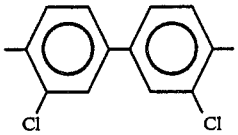 | 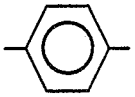 | 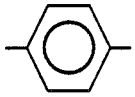 | 1 | 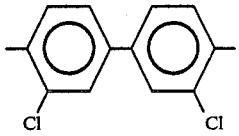 |
| Azo pigment No. | $Ar_5$ | m | $Ar_6$ | A |
|---|---|---|---|---|
| 3-1 | 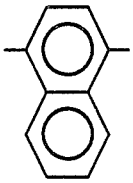 | 0 | — | 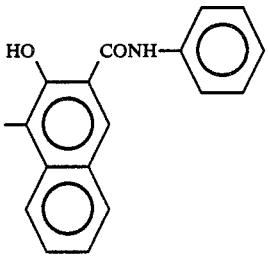 |
| 3-2 | 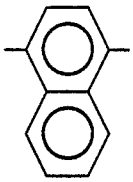 | 0 | — | 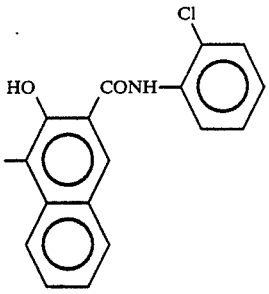 |
| 3-3 | 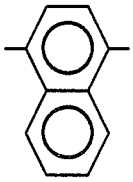 | 0 | — | 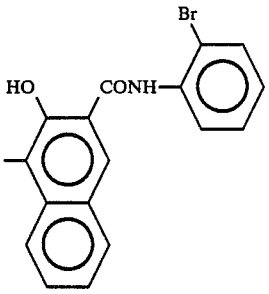 |

TABLE 3-continued
| | | | | |
|---|---|---|---|---|
| 3-4 | 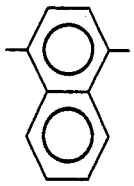 | 0 | — | 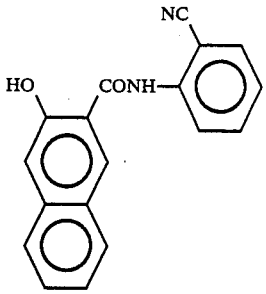  |
| 3-5 | 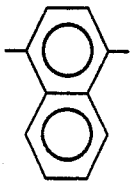 | 0 | — | 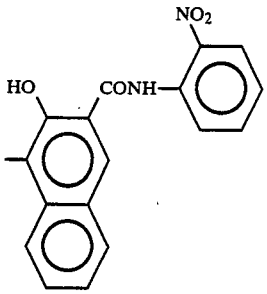  |
| 3-6 | 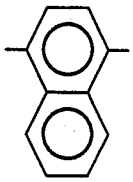 | 0 | — | 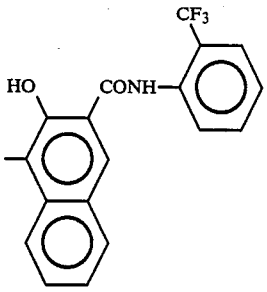  |
| 3-7 | 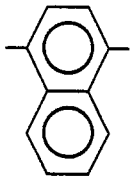 | 0 | — | 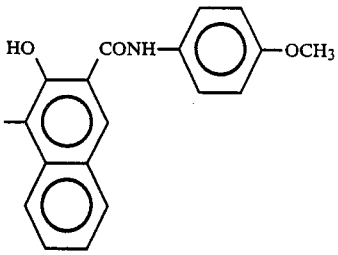  |
| 3-8 | 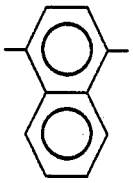 | 0 | — | 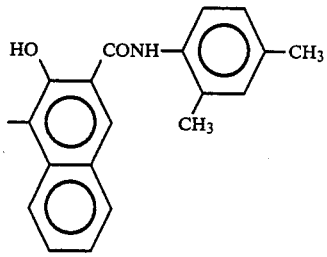  |

TABLE 3-continued
| | | | | |
|---|---|---|---|---|
| 3-9 | 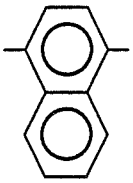 | 0 | — | 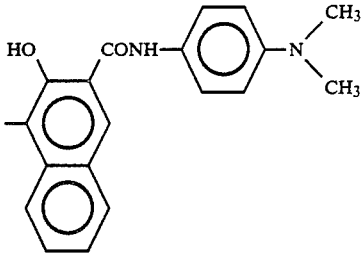 |
| 3-10 | 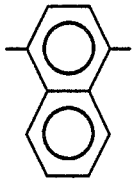 | 0 | — | 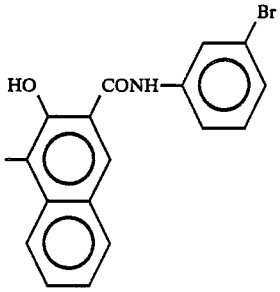 |
| 3-11 | 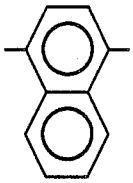 | 0 | — | 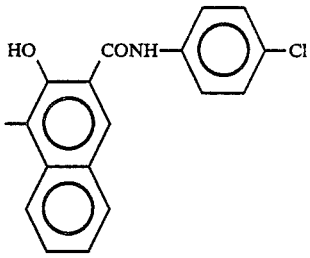 |
| 3-12 | 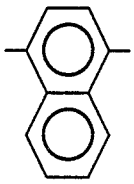 | 0 | — | 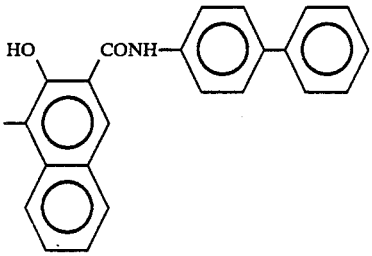 |
| 3-13 | 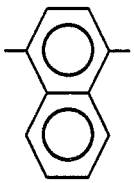 | 0 | — | 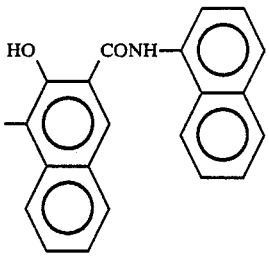 |
| 3-14 | 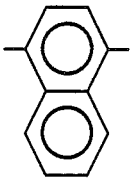 | 0 | — | 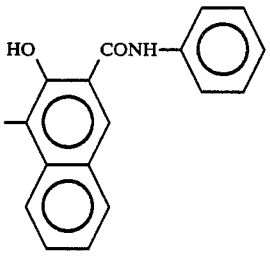 |

TABLE 3-continued
| | | | | |
|---|---|---|---|---|
| 3-15 | 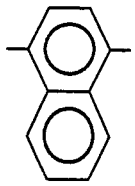 | 0 | — | 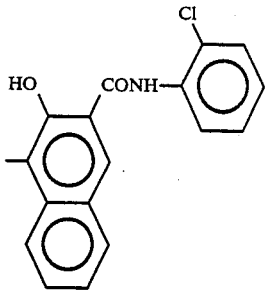 |
| 3-16 | 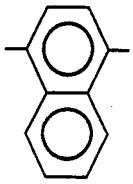 | 0 | — | 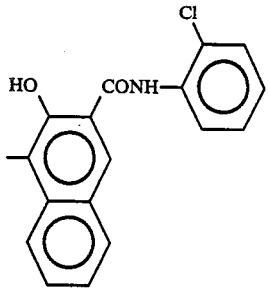 |
| 3-17 | 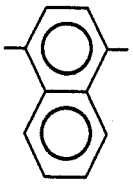 | 0 | — | 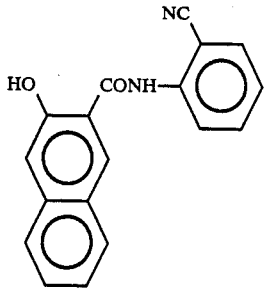 |
| 3-18 | 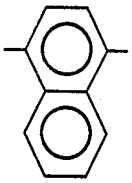 | 0 | — | 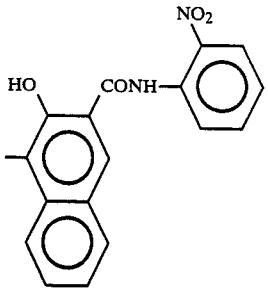 |
| 3-19 | 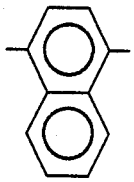 | 0 | — | 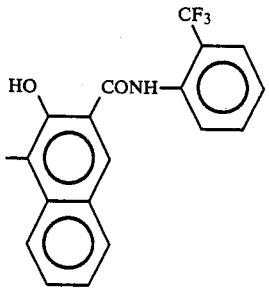 |

TABLE 3-continued
| | | | | |
|---|---|---|---|---|
| 3-20 | 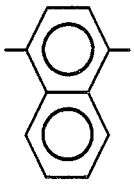 | 0 | — | 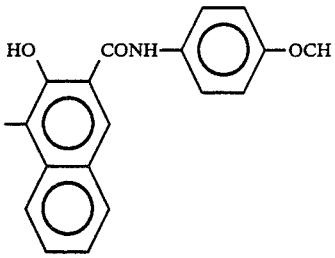 |
| 3-21 | 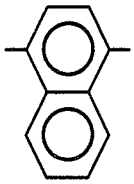 | 1 | 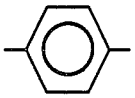 | 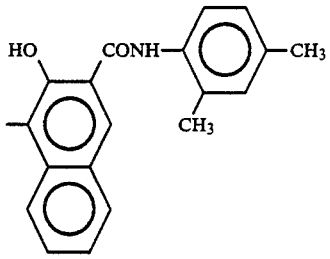 |
| 3-22 | 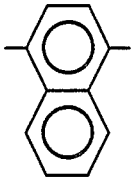 | 1 | 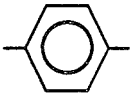 | 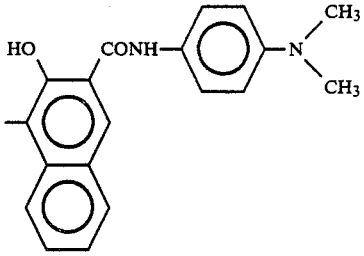 |
| 3-23 | 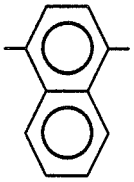 | 1 | 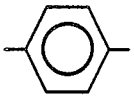 | 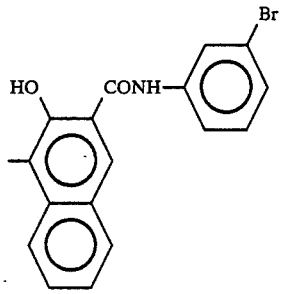 |
| 3-24 | 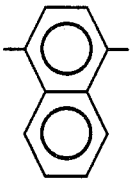 | 1 | 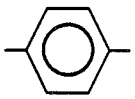 | 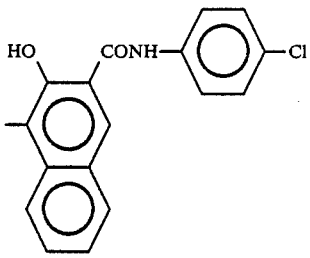 |
| 3-25 | 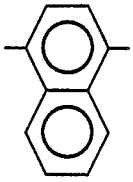 | 1 | 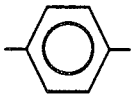 | 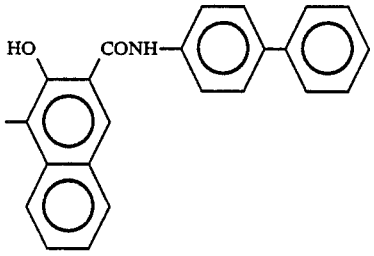 |

TABLE 3-continued
| | | | | |
|---|---|---|---|---|
| 3-26 | 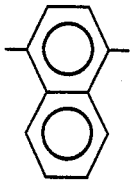 | 1 | 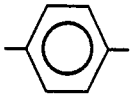 | 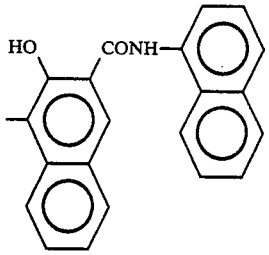 |
| 3-27 | 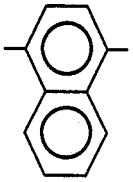 | 0 | — | 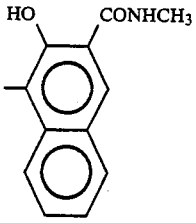 |
| 3-28 | 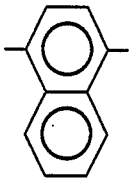 | 0 | — | 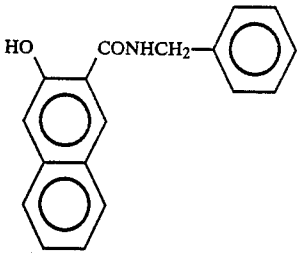 |
| 3-29 | 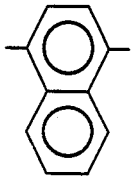 | 0 | — | 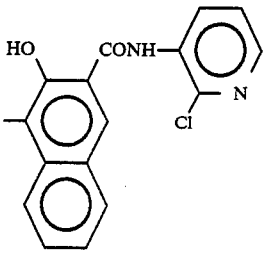 |
| 3-30 | 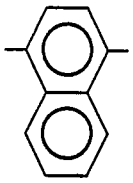 | 0 | — | 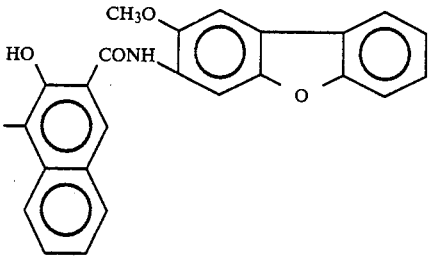 |
| 3-31 | 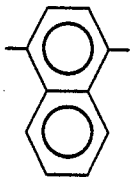 | 0 | — | 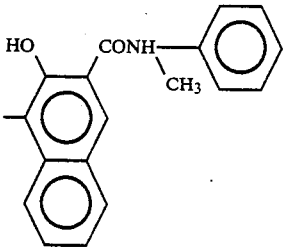 |

TABLE 3-continued
| | | | | |
|---|---|---|---|---|
| 3-32 | 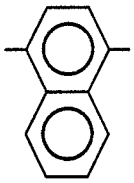 | 0 | — | 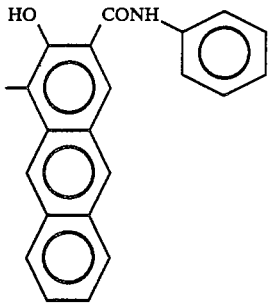  |
| 3-33 | 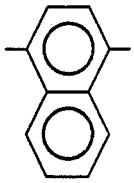 | 0 | — | 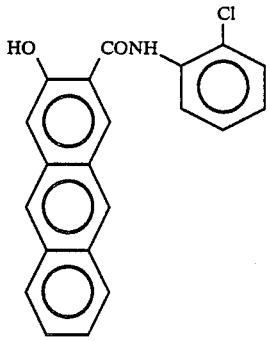  |
| 3-34 | 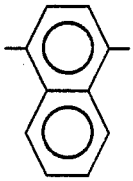 | 1 | 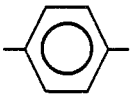 | 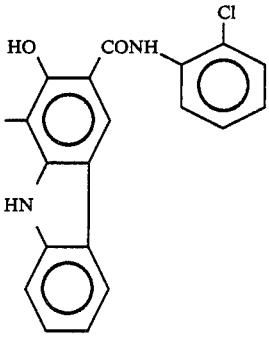  |
| 3-35 | 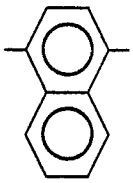 | 0 | — | 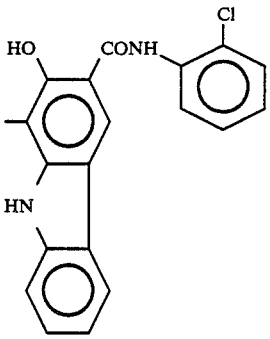  |

TABLE 3-continued
| | | | | |
|---|---|---|---|---|
| 3-36 | 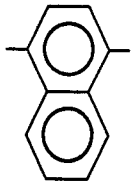 | 0 | — | 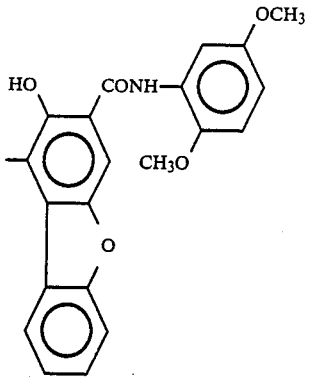 |
| 3-37 | 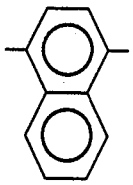 | 0 | — | 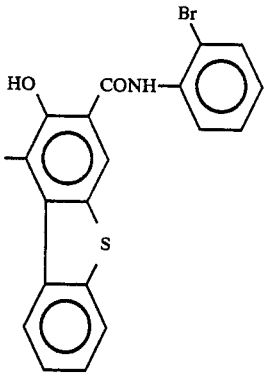 |
| 3-38 | 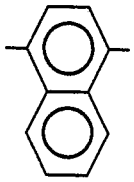 | 0 | — | 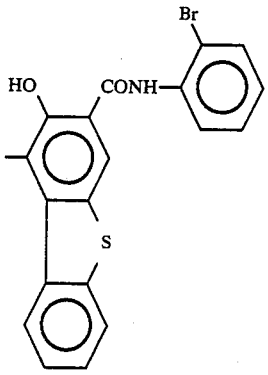 |
| 3-39 | 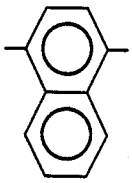 | 1 | 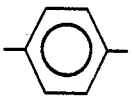 | 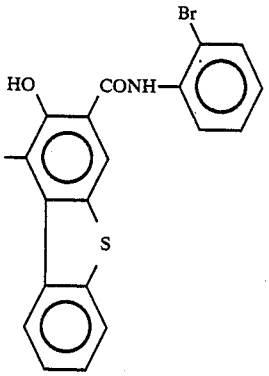 |

TABLE 3-continued
| | | | | |
|---|---|---|---|---|
| 3-40 | 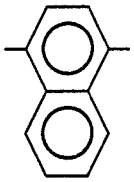 | 1 | — | 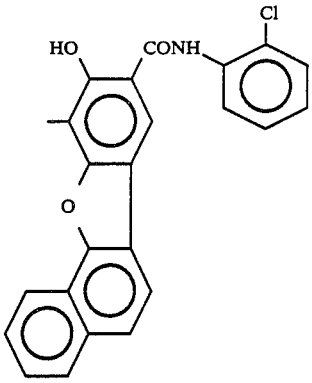 |
| 3-41 | 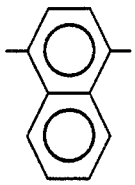 | 1 | 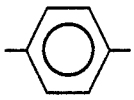 | 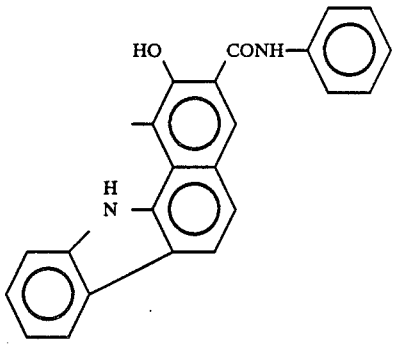 |
| 3-42 | 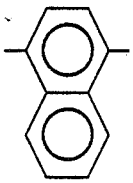 | 1 | 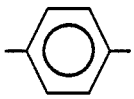 | 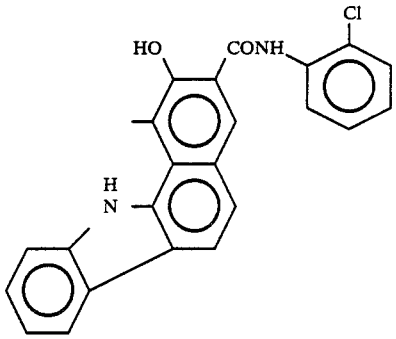 |
| 3-43 | 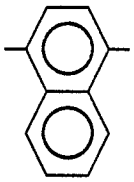 | 0 | — | 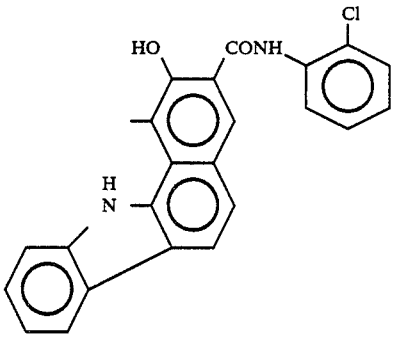 |

TABLE 3-continued
| | | | |
|---|---|---|---|
| 3-44 | 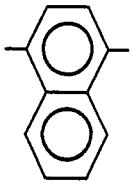 | 0 | — 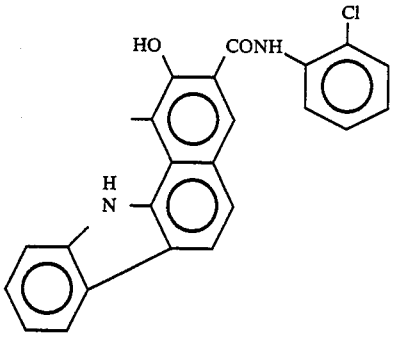 |
| 3-45 | 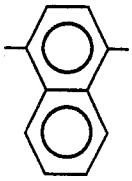 | 1 | 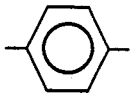 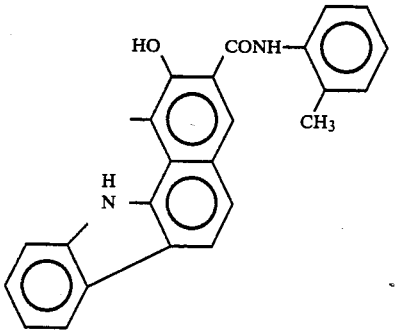 |
| 3-46 | 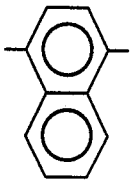 | 1 | 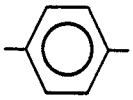 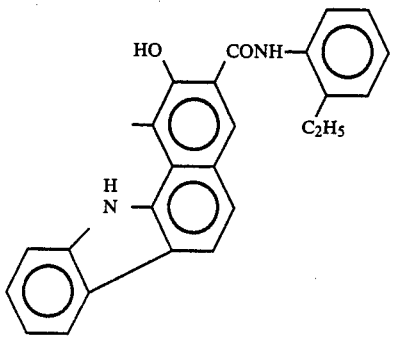 |
| 3-47 | 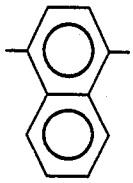 | 1 | 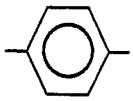 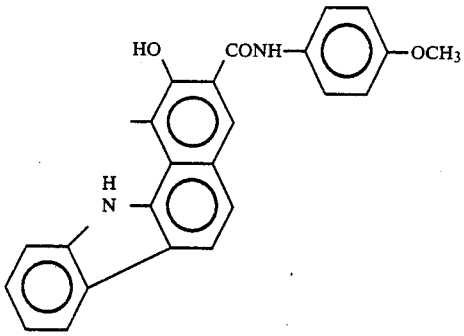 |
| 3-48 | 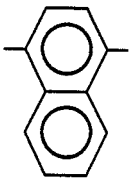 | 1 | 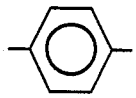 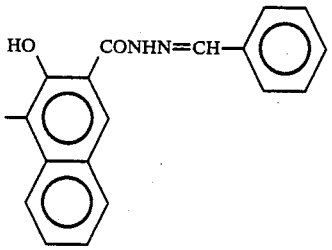 |

TABLE 3-continued
| | | | | |
|---|---|---|---|---|
| 3-49 | 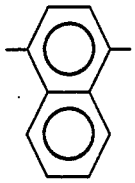 | 1 | 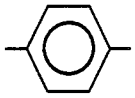 | 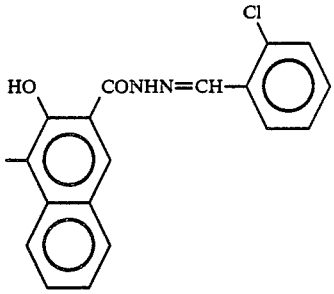  |
| 3-50 | 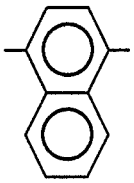 | 0 | — | 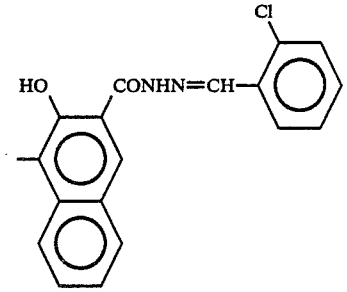  |
| 3-51 | 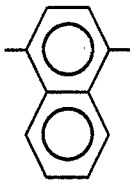 | 0 | — | 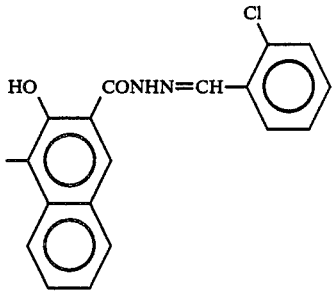  |
| 3-52 | 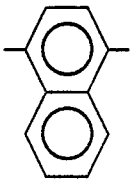 | 1 | 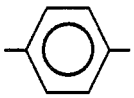 | 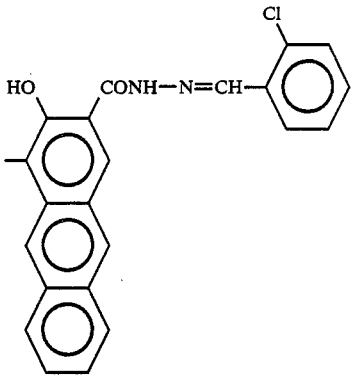  |
| 3-53 | 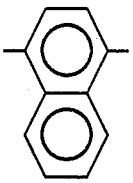 | 0 | — | 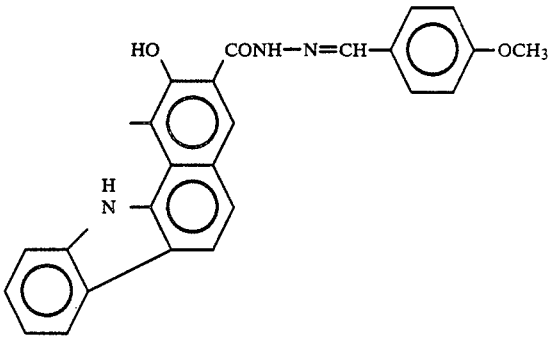  |

TABLE 3-continued
| | | | | |
|---|---|---|---|---|
| 3-54 | 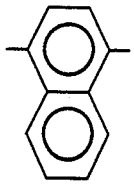 | 0 | — | 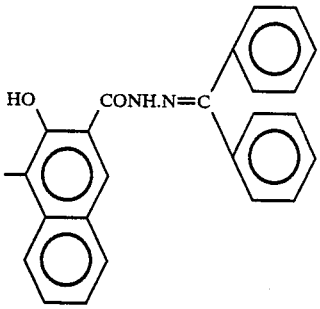  |
| 3-55 | 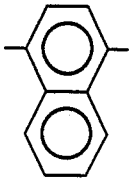 | 0 | — | 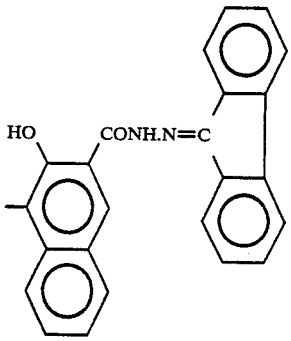  |
| 3-56 | 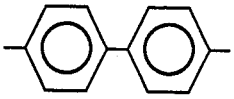 | 1 | 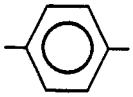 | 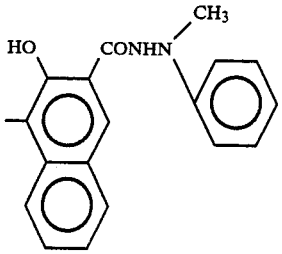  |
| 3-57 | 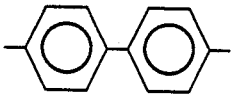 | 1 | 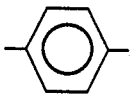 | 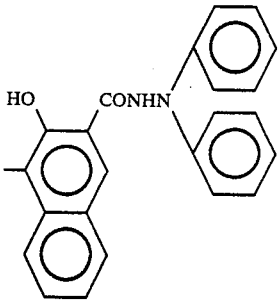  |
| 3-58 | 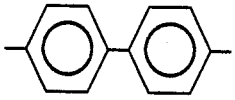 | 1 | 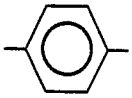 | 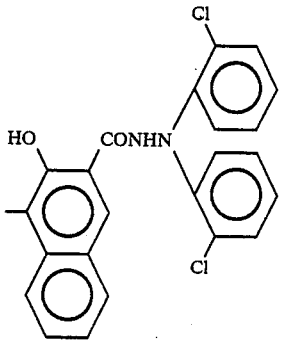  |

TABLE 3-continued
| | | | | |
|---|---|---|---|---|
| 3-59 | 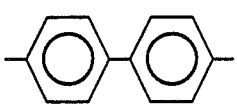 | 0 | — | 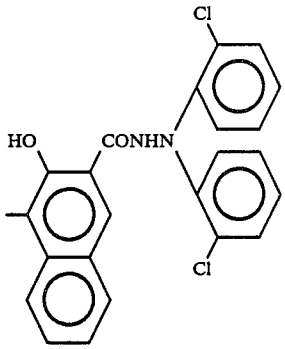 |
| 3-60 | 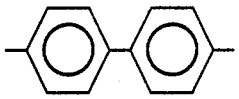 | 0 | — | 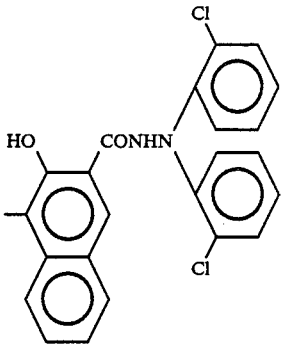 |
| 3-61 | 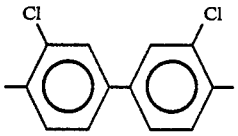 | 1 | 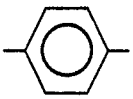 | 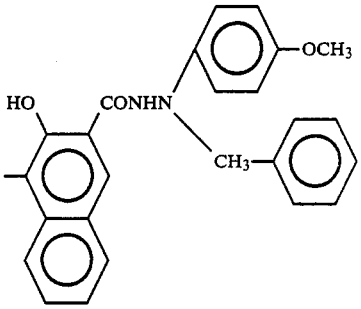 |
| 3-62 | 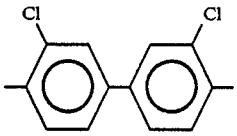 | 0 | — | 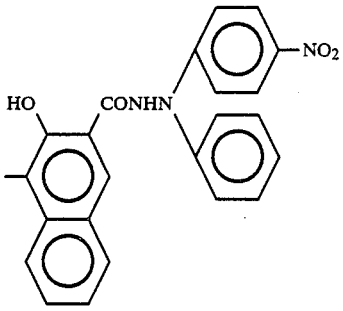 |

TABLE 3-continued
| | | | | |
|---|---|---|---|---|
| 3-63 | 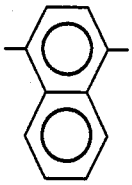 | 0 | — | 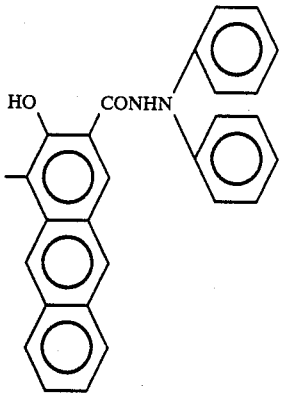 |
| 3-64 | 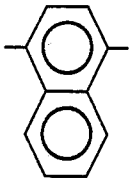 | 0 | — | 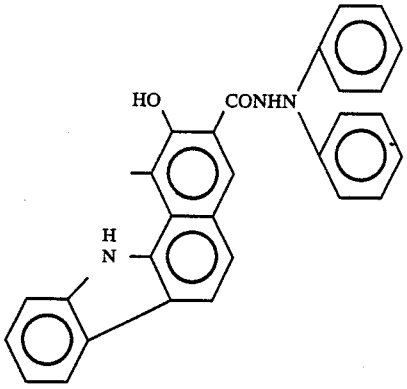 |
| 3-65 | 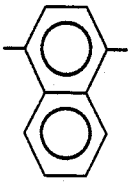 | 1 | 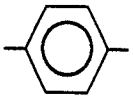 | 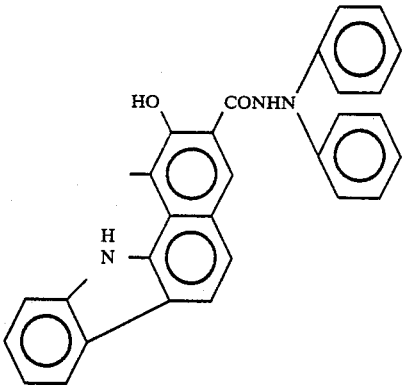 |
| 3-66 | 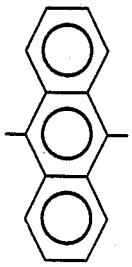 | 0 | — | 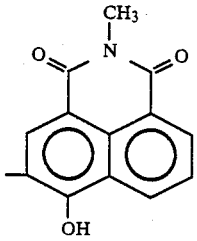 |

TABLE 3-continued
| | | | | |
|---|---|---|---|---|
| 3-67 | 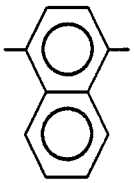 | 0 | — | 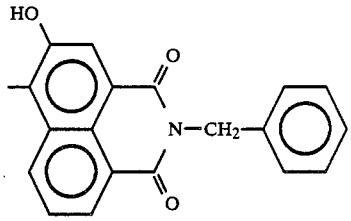 |
| 3-68 | 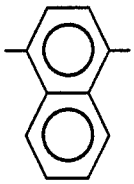 | 0 | — | 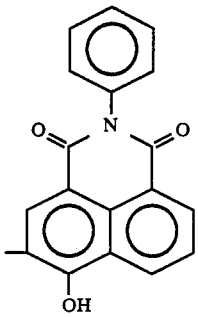 |
| 3-69 | 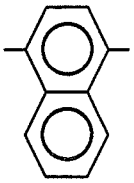 | 0 | — | 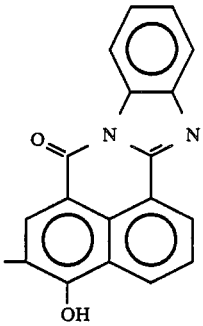 |
| 3-70 | 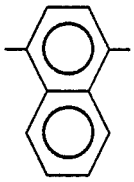 | 0 | — | 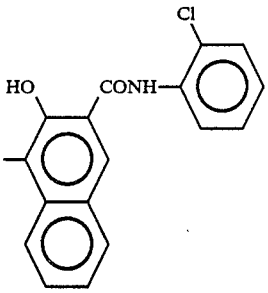 |
| 3-71 | 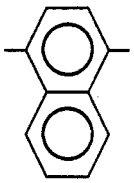 | 1 | 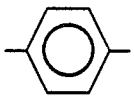 | 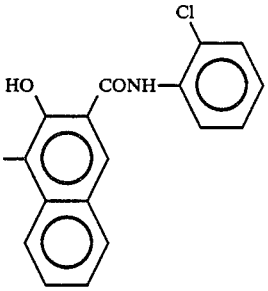 |

TABLE 3-continued
| | | | | |
|---|---|---|---|---|
| 3-72 | 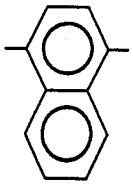 | 0 | — | 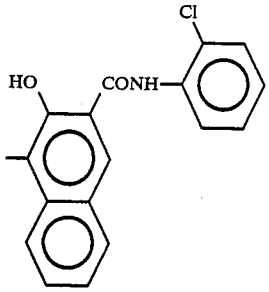 |
| 3-73 | 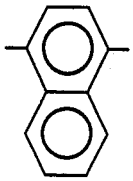 | 1 | 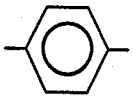 | 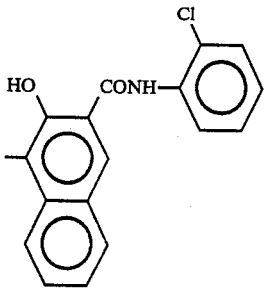 |
| 3-74 | 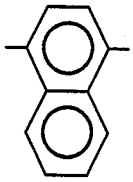 | 0 | — | 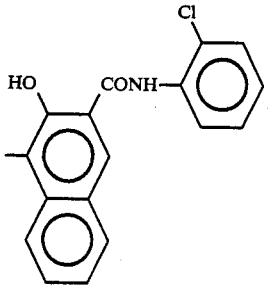 |
| 3-75 | 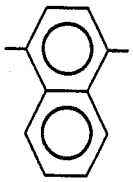 | 1 | 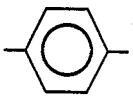 | 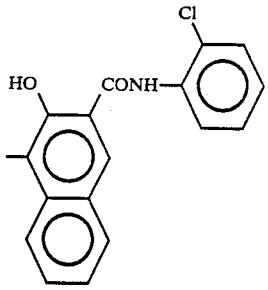 |
| 3-76 | 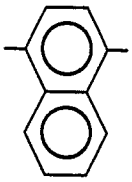 | 1 | 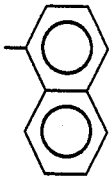 | 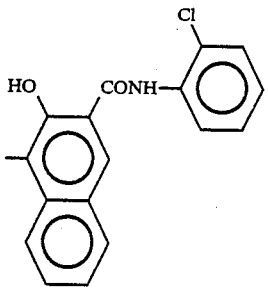 |

TABLE 3-continued
| | | | |
|---|---|---|---|
| 3-77 | 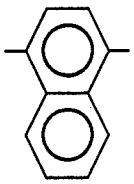 | 1 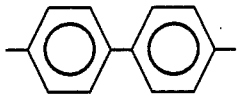 | 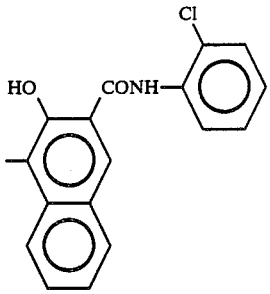  |
| 3-78 | 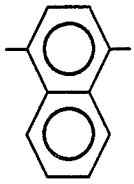 | 1 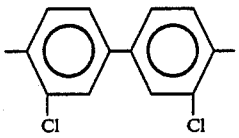  | 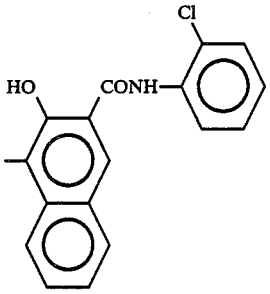  |

TABLE 4
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-1 | 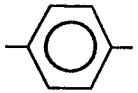 | 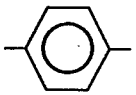 | 0 | — | 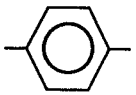 | 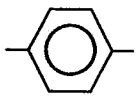 | 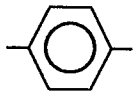 | 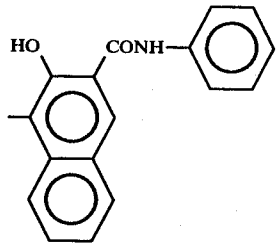 |
| 4-2 | 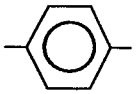 | 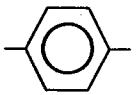 | 0 | — | 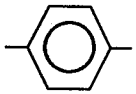 | 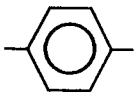 | 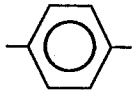 | 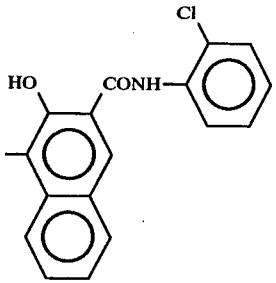 |
| 4-3 | 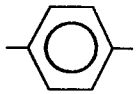 | 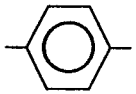 | 0 | — | 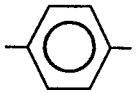 | 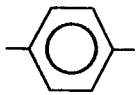 | 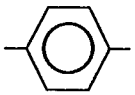 | 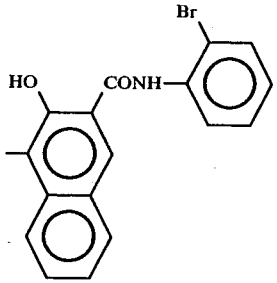 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-4 | 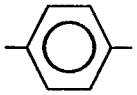 | 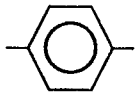 | 0 | — | 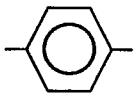 | 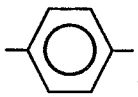 | 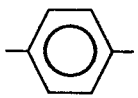 | 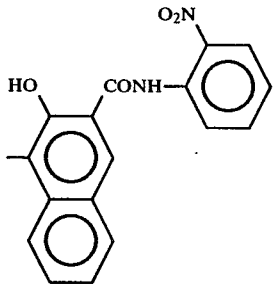  |
| 4-5 | 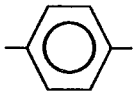 | 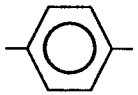 | 0 | — | 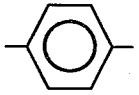 | 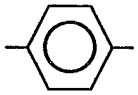 | 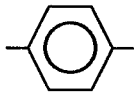 | 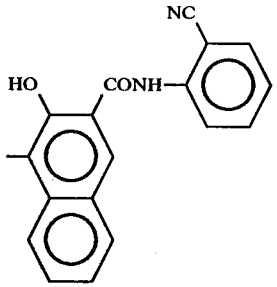  |
| 4-6 | 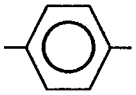 | 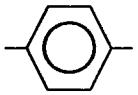 | 0 | — | 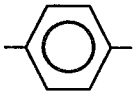 | 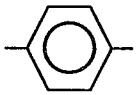 | 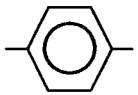 | 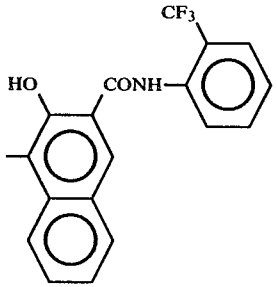  |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-7 | 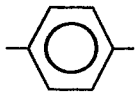 | 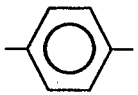 | 0 | — | 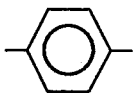 | 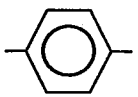 | 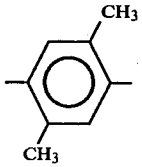  | 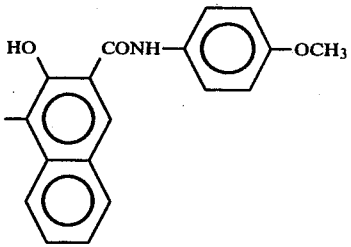  |
| 4-8 | 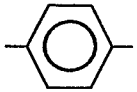 | 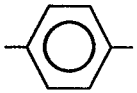 | 0 | — | 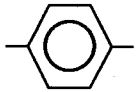 | 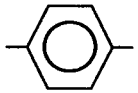 | 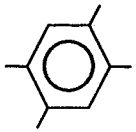 | 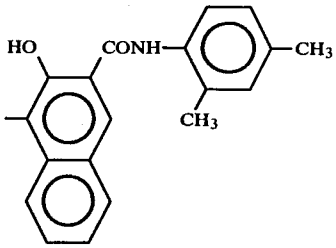  |
| 4-9 | 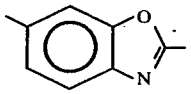  | 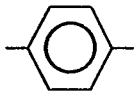 | 0 | — | 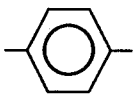 | 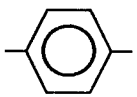 | 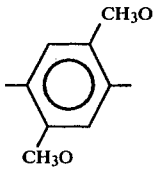  | 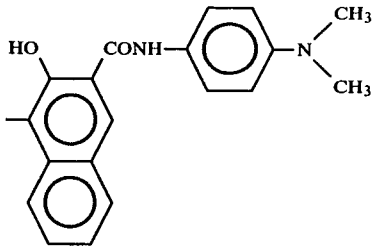  |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-10 | 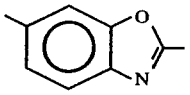 | 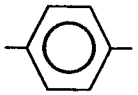 | 0 | — | 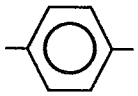 | 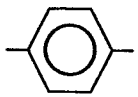 | 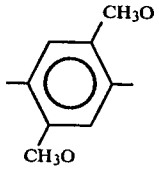 | 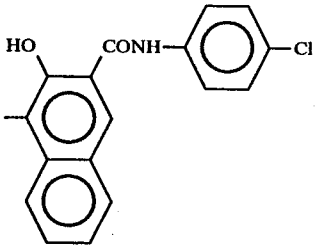 |
| 4-11 | 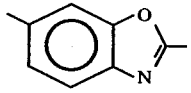 | 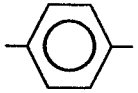 | 0 | — | 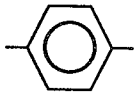 | 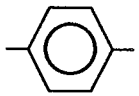 | 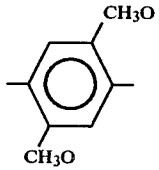 | 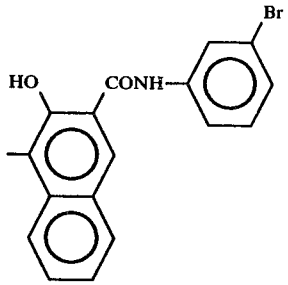 |
| 4-12 | 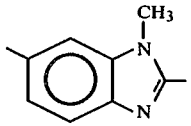 | 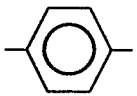 | 0 | — | 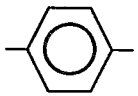 | 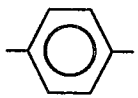 | 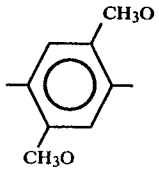 | 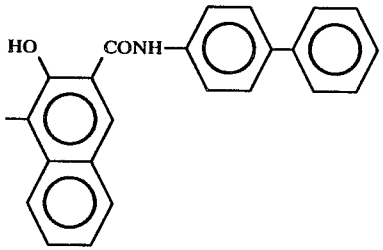 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-13 | 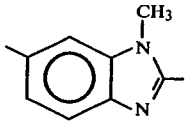 | 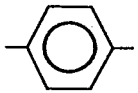 | 0 | — | 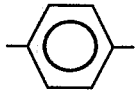 | 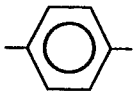 | 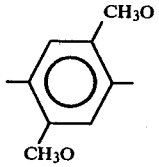 | 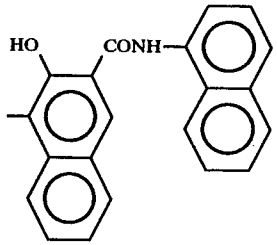 |
| 4-14 | 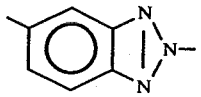 | 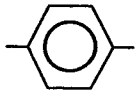 | 0 | — | 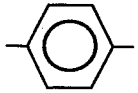 | 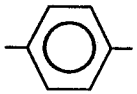 | 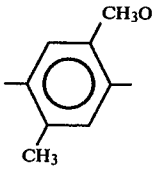 | 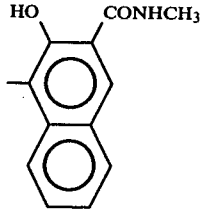 |
| 4-15 | 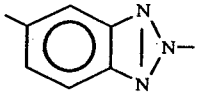 | 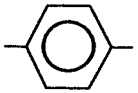 | 0 | — | 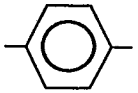 | 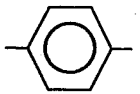 | 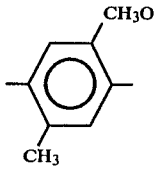 | 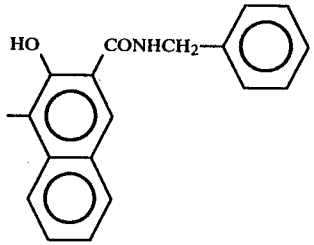 |
| 4-16 | 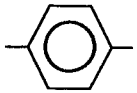 | 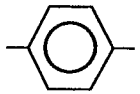 | 0 | — | 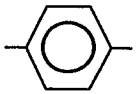 | 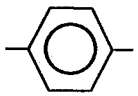 | 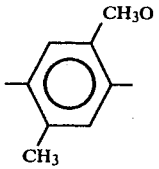 | 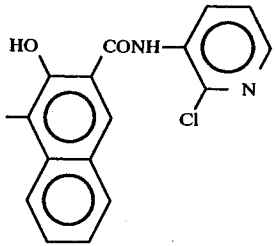 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-17 | 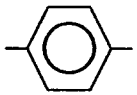 | 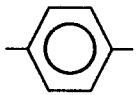 | 0 | — | 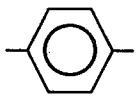 | 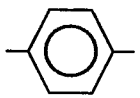 | 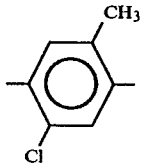 | 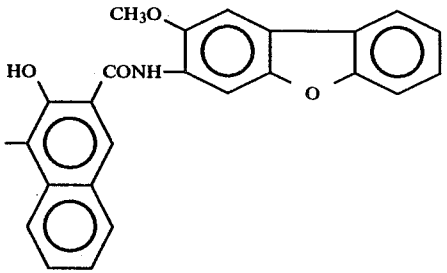 |
| 4-18 | 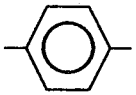 | 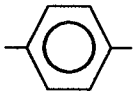 | 0 | — | 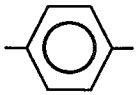 | 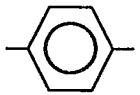 | 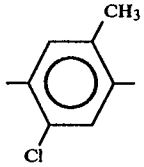 | 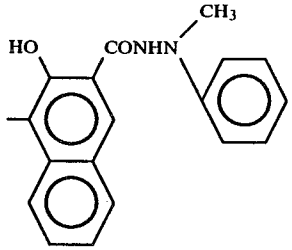 |
| 4-19 | 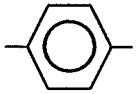 | 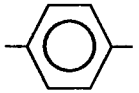 | 0 | — | 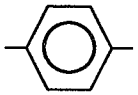 | 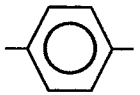 | 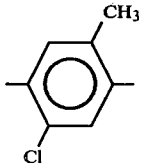 | 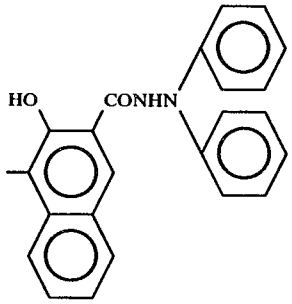 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-20 | 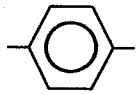 | 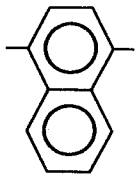 | 0 | — | 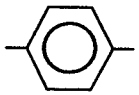 | 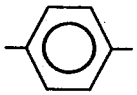 | 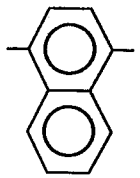 | 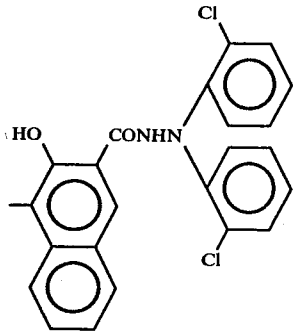 |
| 4-21 | 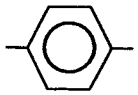 | 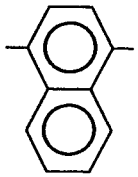 | 0 | — | 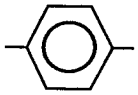 | 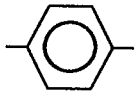 | 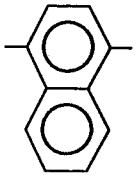 | 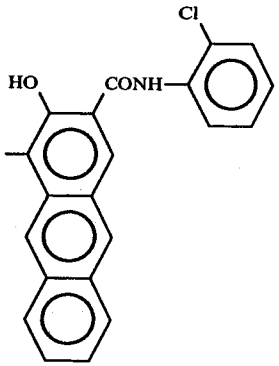 |
| 4-22 | 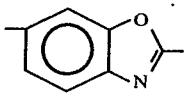 | 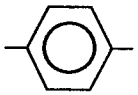 | 1 | 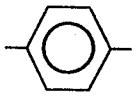 | 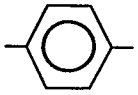 | 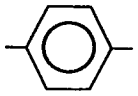 | 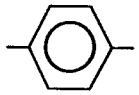 | 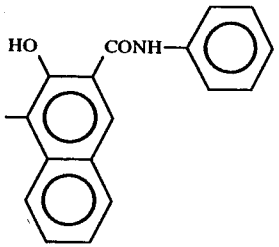 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-23 | 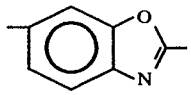 | 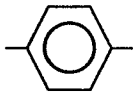 | 1 | 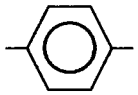 | 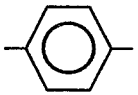 | 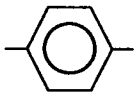 | 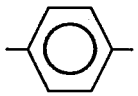 | 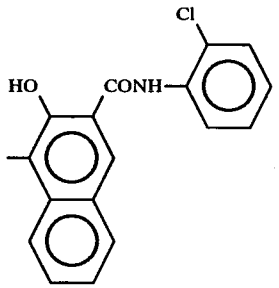 |
| 4-24 | 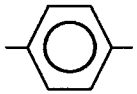 | 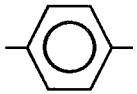 | 1 | 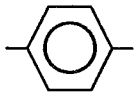 | 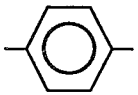 | 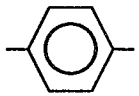 | 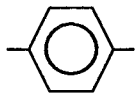 | 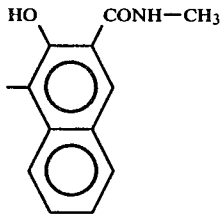 |
| 4-25 | 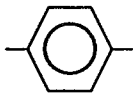 | 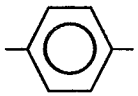 | 1 | 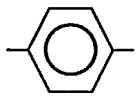 | 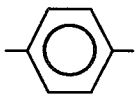 | 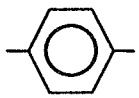 | 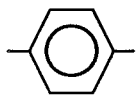 | 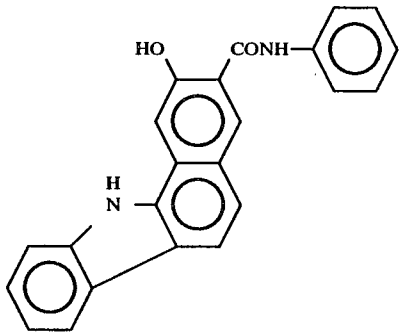 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-26 | 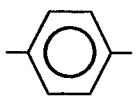 | 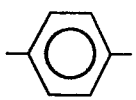 | 1 | 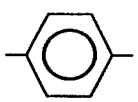 | 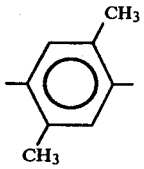 | 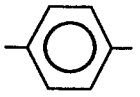 | 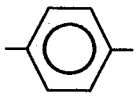 | 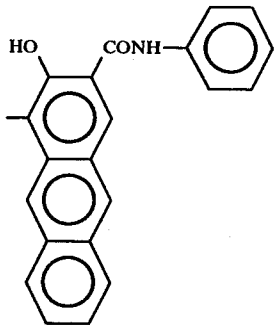 |
| 4-27 | 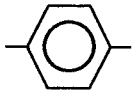 | 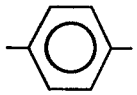 | 1 | 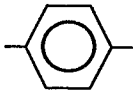 | 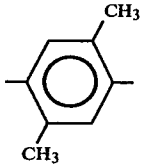 | 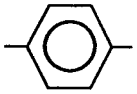 | 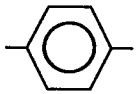 | 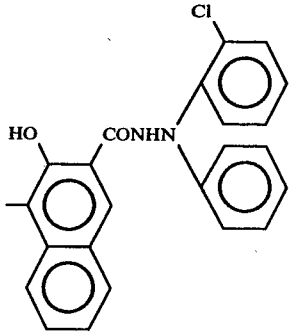 |
| 4-28 | 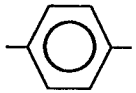 | 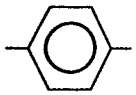 | 1 | 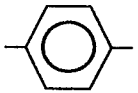 | 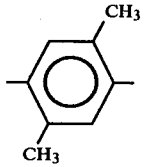 | 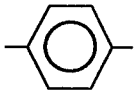 | 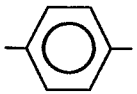 | 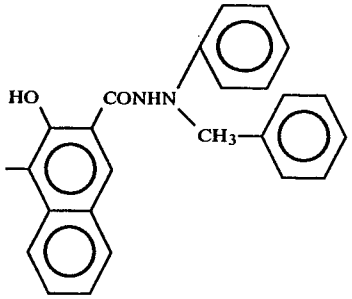 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-29 | 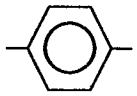 | 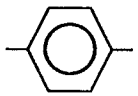 | 1 | 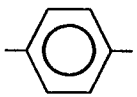 | 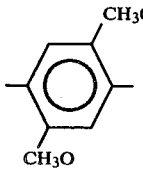 | 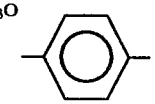 | 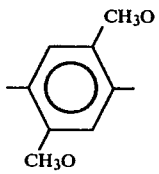 | 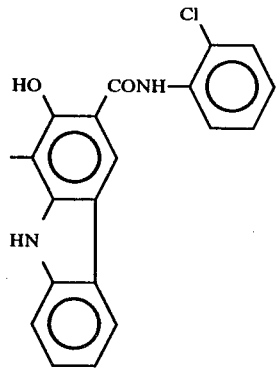 |
| 4-30 | 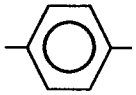 | 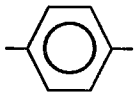 | 1 | 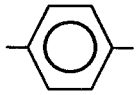 | 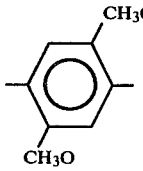 | 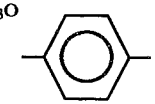 | 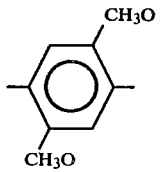 | 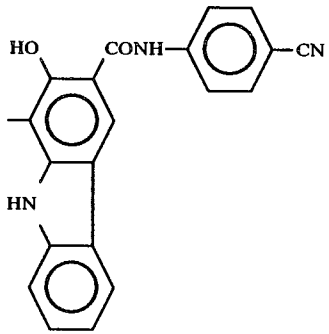 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-31 | 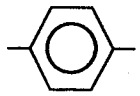 | 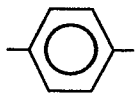 | 1 | 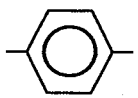 | 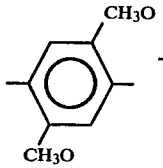 | 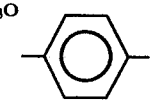 | 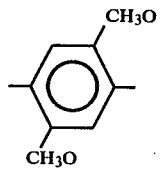 | 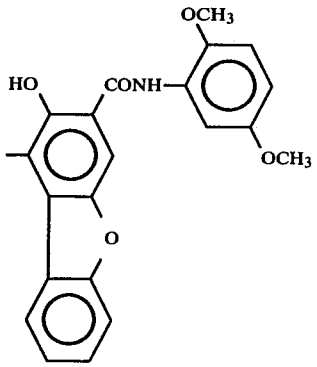 |
| 4-32 | 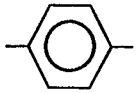 | 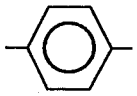 | 1 | 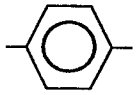 | 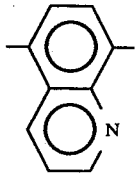 | 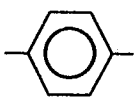 | 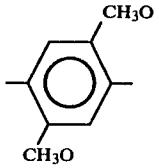 | 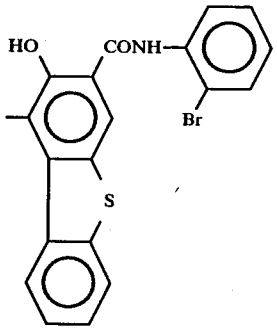 |
| 4-33 | 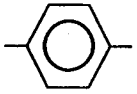 | 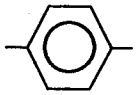 | 1 | 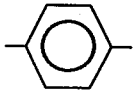 | 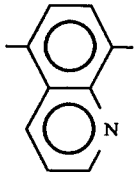 | 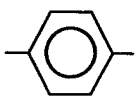 | 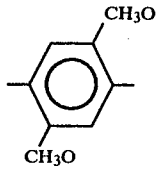 | 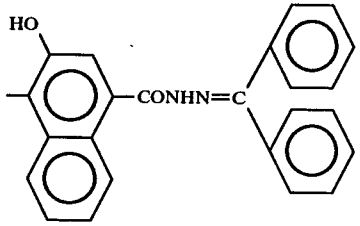 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-34 | 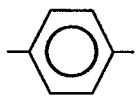 | 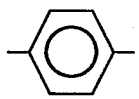 | 1 | 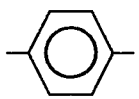 | 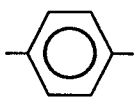 | 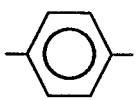 | 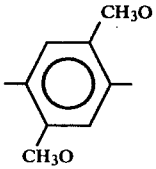 | 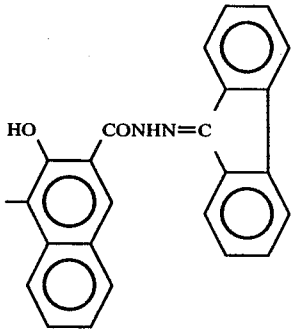 |
| 4-35 | 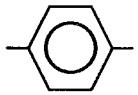 | 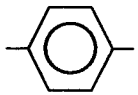 | 1 | 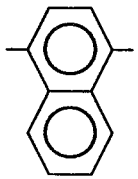 | 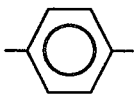 | 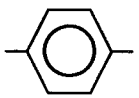 | 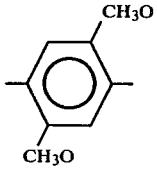 | 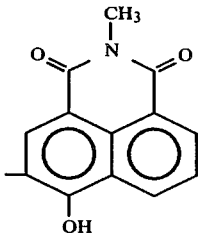 |
| 4-36 | 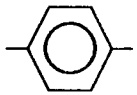 | 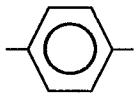 | 1 | 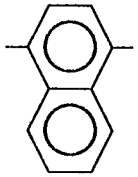 | 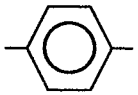 | 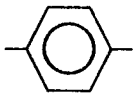 | 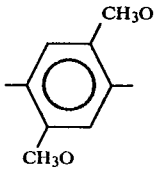 | 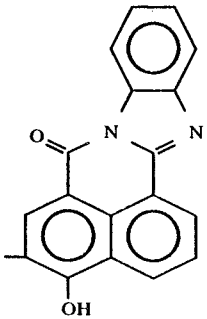 |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-37 | 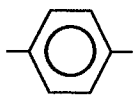 | 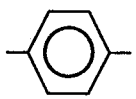 | 1 | 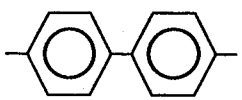 | 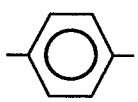 | 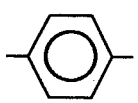 | 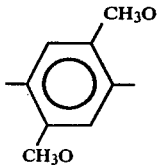  | 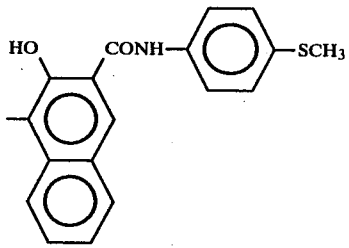  |
| 4-38 | 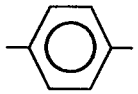 | 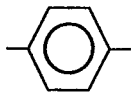 | 1 | 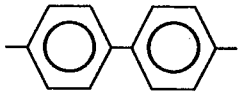 | 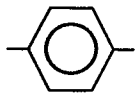 | 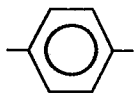 | 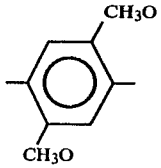  | 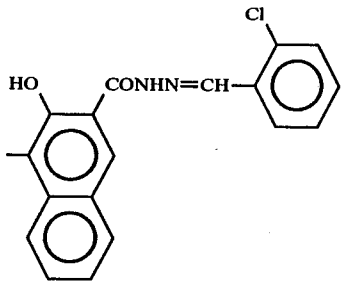  |
| 4-39 | 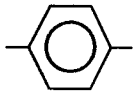 | 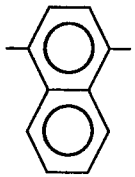 | 1 | 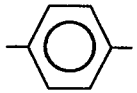 | 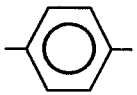 | 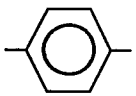 | 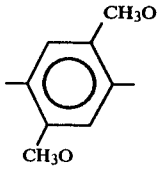  | 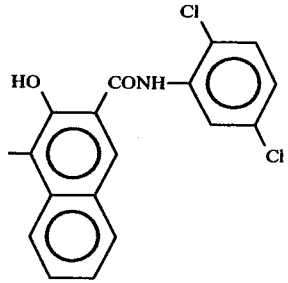  |

TABLE 4-continued
| Azo pigment No. | $Ar_1$ | $Ar_2$ | n | $Ar_3$ | $Ar_4$ | $Ar_5$ | $Ar_6$ | A |
|---|---|---|---|---|---|---|---|---|
| 4-40 | 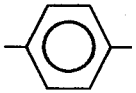 | 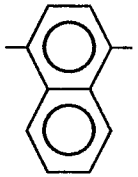 | 1 | 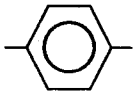 | 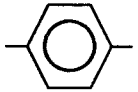 | 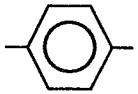 | 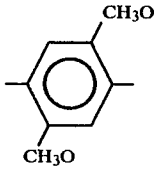  | 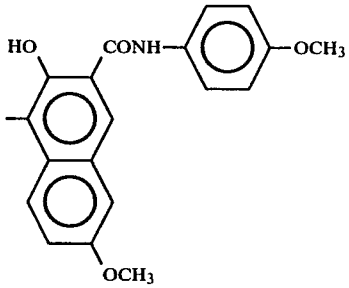  |

TABLE 5
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-1 | 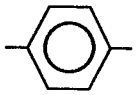 | 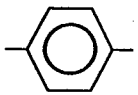 | 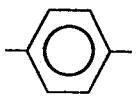 | 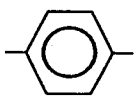 | 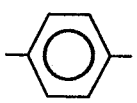 | 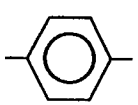 | 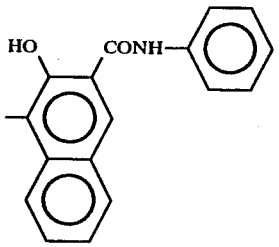  |
| 5-2 | 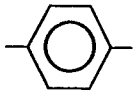 | 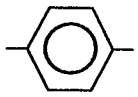 | 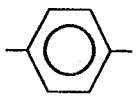 | 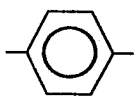 | 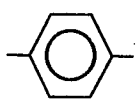 | 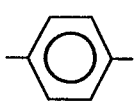 | 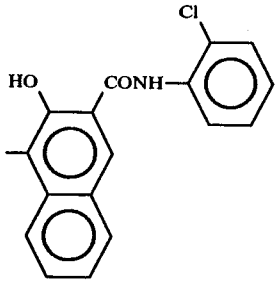  |
| 5-3 | 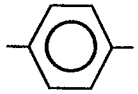 | 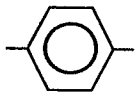 | 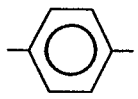 | 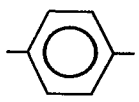 | 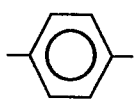 | 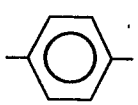 | 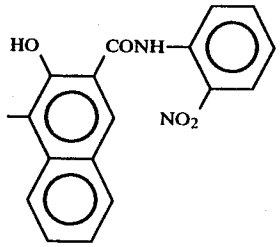  |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-4 | 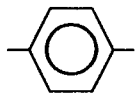 | 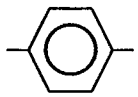 | 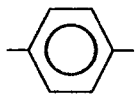 | 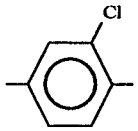 | 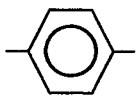 | 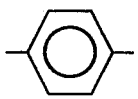 | 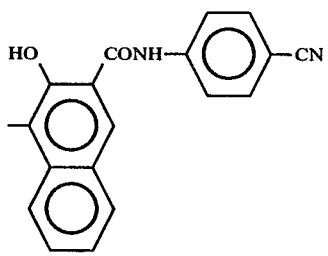 |
| 5-5 | 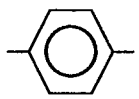 | 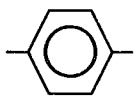 | 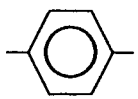 | 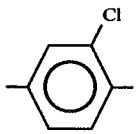 | 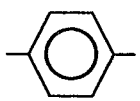 | 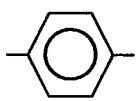 | 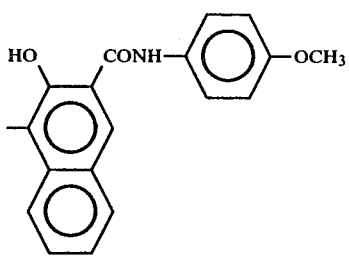 |
| 5-6 | 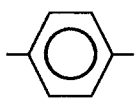 | 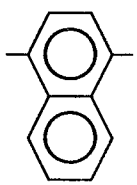 | 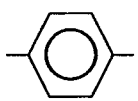 | 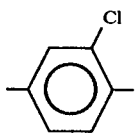 | 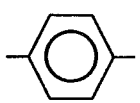 | 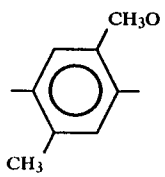 | 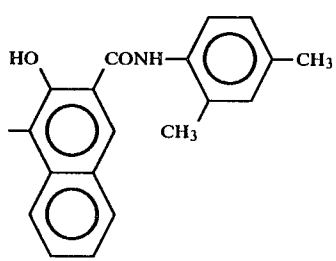 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-7 | 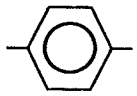 | 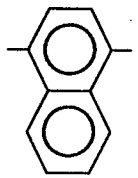 | 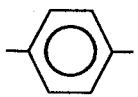 | 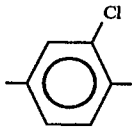 | 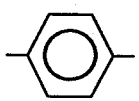 | 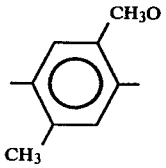 | 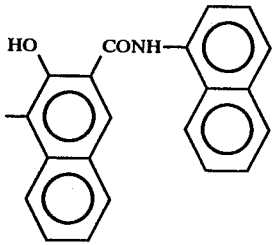 |
| 5-8 | 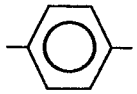 | 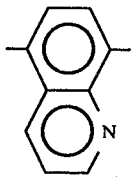 | 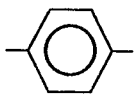 | 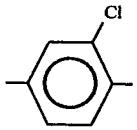 | 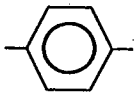 | 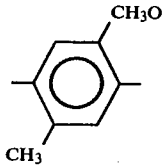 | 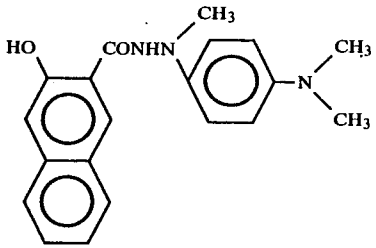 |
| 5-9 | 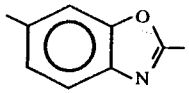 | 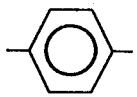 | 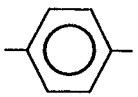 | 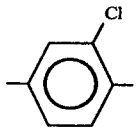 | 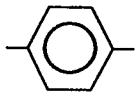 | 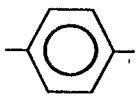 | 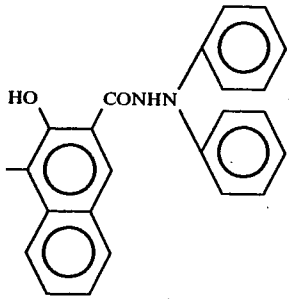 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-10 | 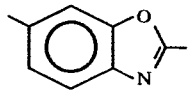 | 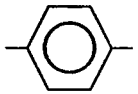 | 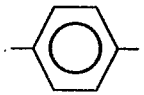 | 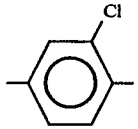 | 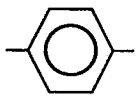 | 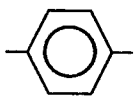 | 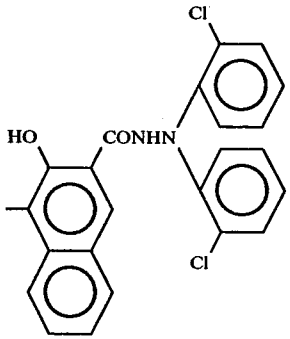 |
| 5-11 | 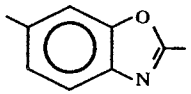 | 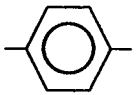 | 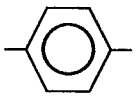 | 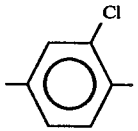 | 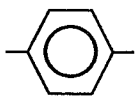 | 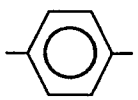 | 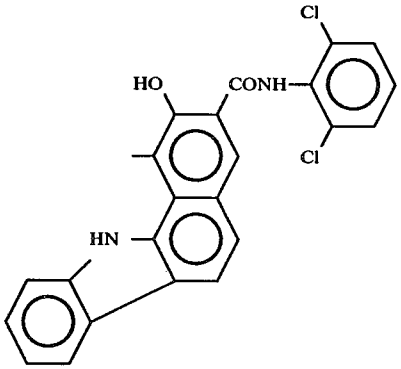 |
| 5-12 | 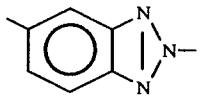 | 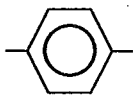 | 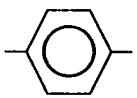 | 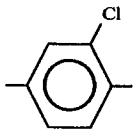 | 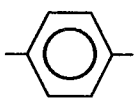 | 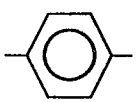 | 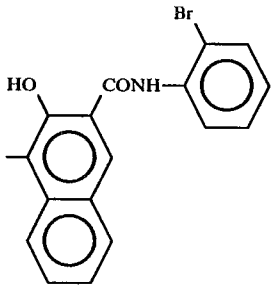 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-13 | 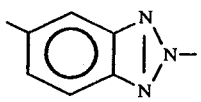 | 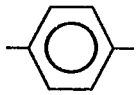 | 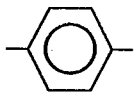 | 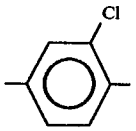 | 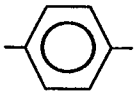 | 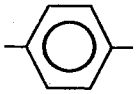 | 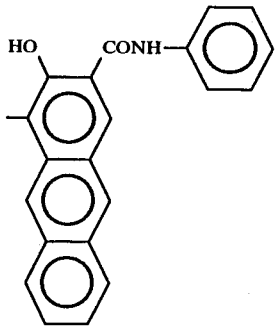 |
| 5-14 | 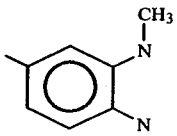 | 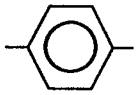 | 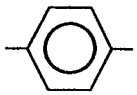 | 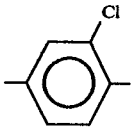 | 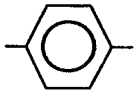 | 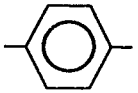 | 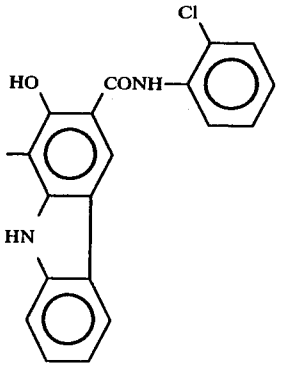 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-15 | 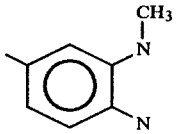 | 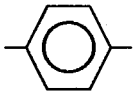 | 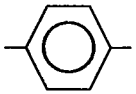 | 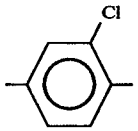 | 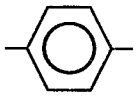 | 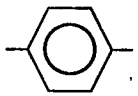 | 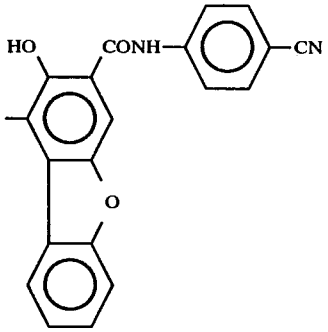 |
| 5-16 | 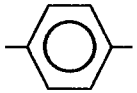 | 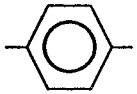 | 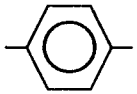 | 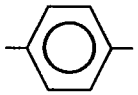 | 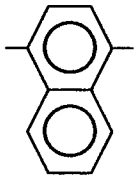 | 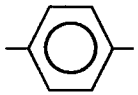 | 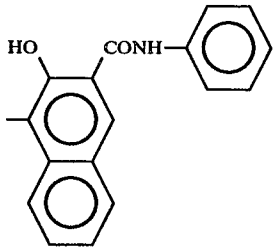 |
| 5-17 | 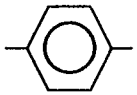 | 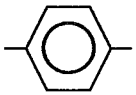 | 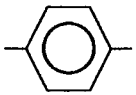 | 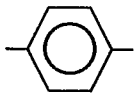 | 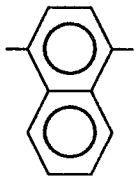 | 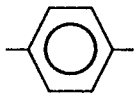 | 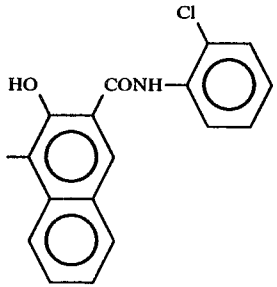 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-18 | 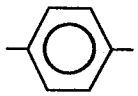 | 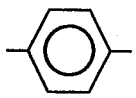 | 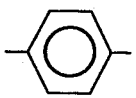 | 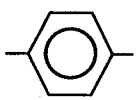 | 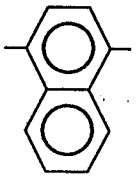 | 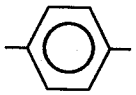 | 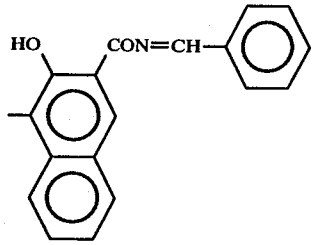  |
| 5-19 | 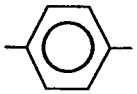 | 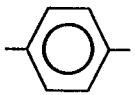 | 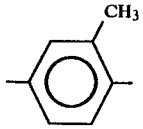  | 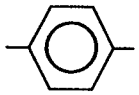 | 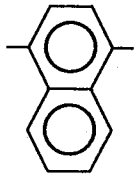 | 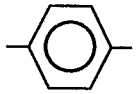 | 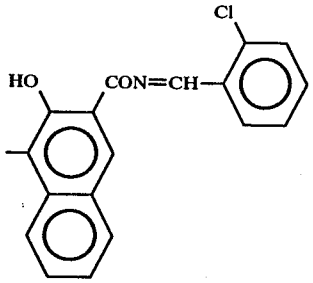  |
| 5-20 | 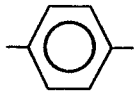 | 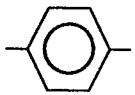 | 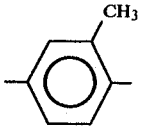  | 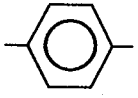 | 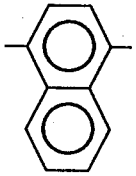 | 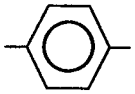 | 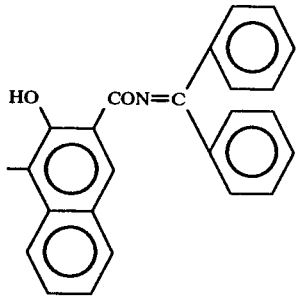  |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-21 | 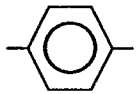 | 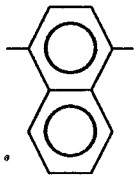 | 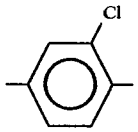 | 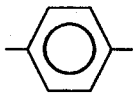 | 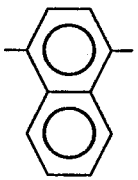 | 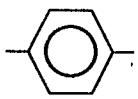 | 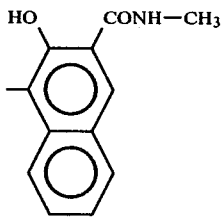 |
| 5-22 | 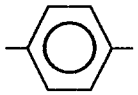 | 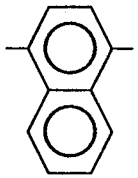 | 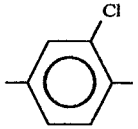 | 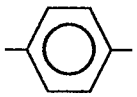 | 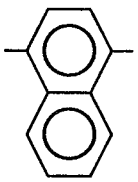 | 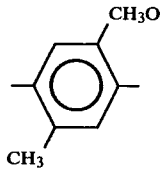 | 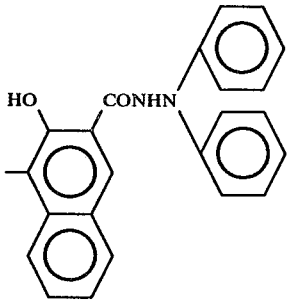 |
| 5-23 | 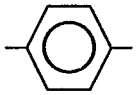 | 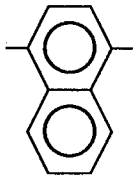 | 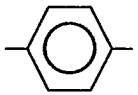 | 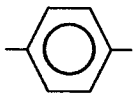 | 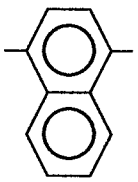 | 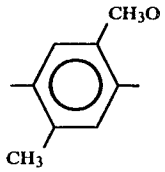 | 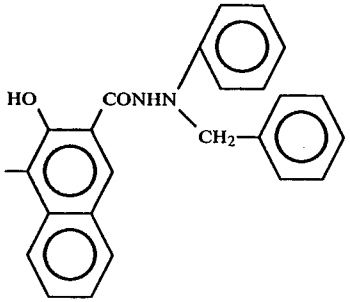 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-24 | 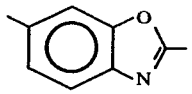 | 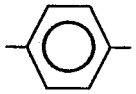 | 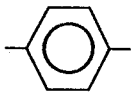 | 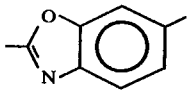 | 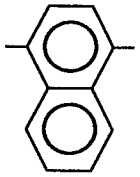 | 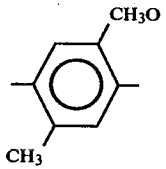 | 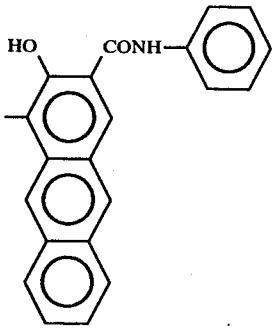 |
| 5-25 | 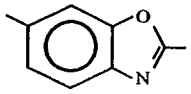 | 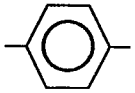 | 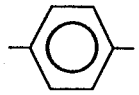 | 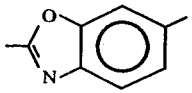 | 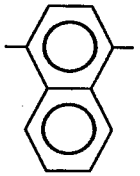 | 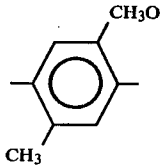 | 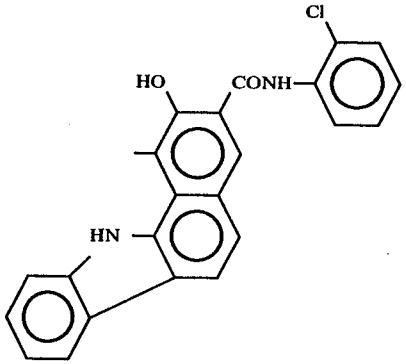 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-26 | 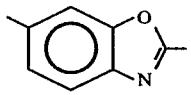 | 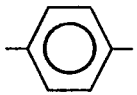 | 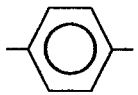 | 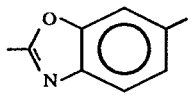 | 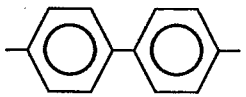 | 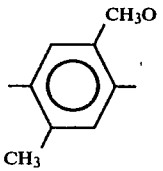 | 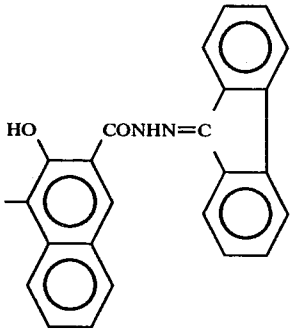 |
| 5-27 | 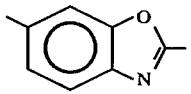 | 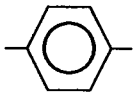 | 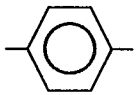 | 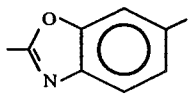 | 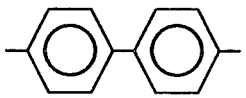 | 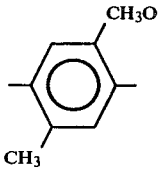 | 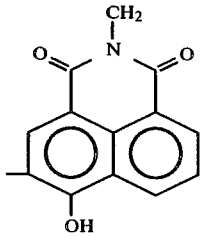 |
| 5-28 | 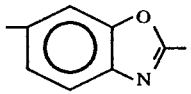 | 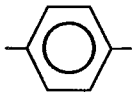 | 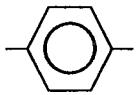 | 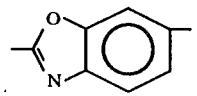 | 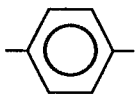 | 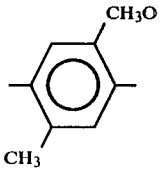 | 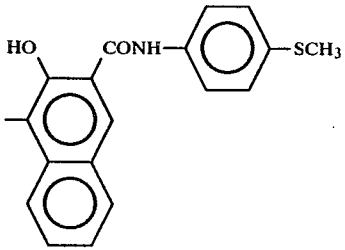 |

TABLE 5-continued
| Azo pigment No. | $Ar_7$ | $Ar_8$ | $Ar_9$ | $Ar_{10}$ | $Ar_{11}$ | $Ar_{12}$ | A |
|---|---|---|---|---|---|---|---|
| 5-29 | 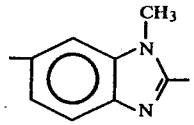 | 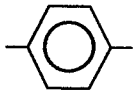 | 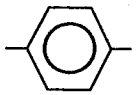 | 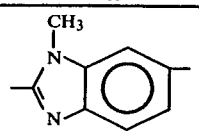 | 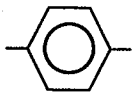 | 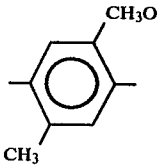 | 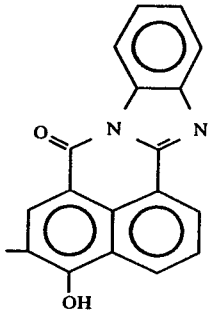 |
| 5-30 | 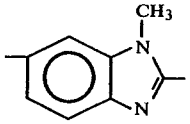 | 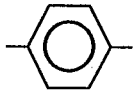 | 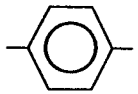 | 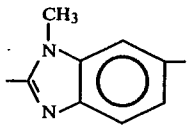 | 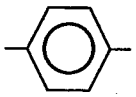 | 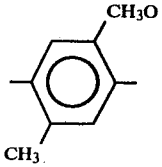 | 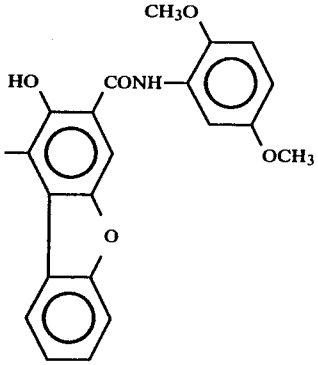 |

These pigments can be used alone or in combination of two or more thereof.

These pigments can be readily prepared by hexazozing a triamine represented, for example, by the following general formula

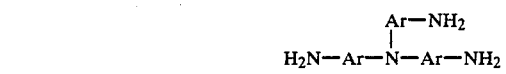

where Ar has the same meaning as defined before in case of the general formula (1), according to the conventional procedure, and then subjecting the resulting hexazonium salt of the triamine to aqueous coupling with a corresponding coupler in the presence of an alkali, or isolating the resulting hexazonium salt of the triamine in the form of a borofluoride or a zinc chloride complex salt, and then coupling it with a coupler in the presence of an alkali in a solvent such as N,N-dimethylformamide, dimethylsulfoxide, etc.

Typical synthesis examples of azo pigments for use in the present invention will be given below:

Synthesis Example 1 (synthesis of said trisazo pigment No. 1-1)

120 ml of water, 24.9 ml (0.29 moles) of concentrated hydrochloric acid and 9.98 g (0.029 moles) of compound having the following formula:

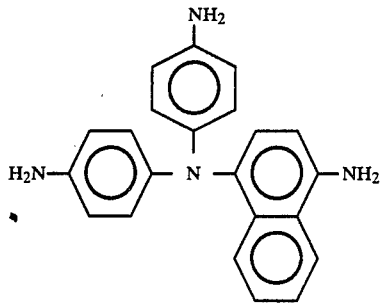

were charged into a 500-ml beaker, and cooled to a liquid temperature of 3° C. in an ice-water bath with stirring. Then, a solution of 6.4 g (0.093 moles) of sodium nitrite in 11 ml of water was dropwise added thereto over 10 minutes, while controlling the liquid temperature within a range of 3+ C. to 10° C. After the dropwise addition, the mixture was further stirred at the same temperature as above for 30 minutes. Then, the reaction mixture was admixed with carbon, and filtered. A solution of 38.2 g (0.35 moles) of sodium borofluoride in 65 ml of water was added to the filtrate, and the deposited precipitate was recovered by filtration, washed with water, filtered and thoroughly pressed on the filter, whereby hexazonium trifluoroborate was obtained in a wet state. Then, 1,800 ml of DMF was placed into a 2 l beaker, and 24.5 g (0.093 moles) of 3-hydroxy-2-naphthoic anilide as a coupling component and said hexazonium salt were dissolved therein. The resulting solution was cooled down to 7° C. Then, 61.7 g (0.61 mole) of triethylamine was dropwise added to the solution over 30 minutes with stirring, while keeping the liquid temperature at 5°-10° C. After the dropwise addition, the mixture was further stirred for 2 hours, and the reaction mixture was filtered after being left standing overnight. The thus obtained pigment was washed, and stirred in 1 l of water and filtered. This operation each was repeated three times. Then, washing, stirring and filtration were successively repeated 4 times each with 600 ml of DMF and twice with with 600 ml of MEK.

The resulting paste-like product was dried by aeration at room temperature, whereby 28.7 g of pigment was obtained (yield: 85%).

Melting point: 250° C. or higher.

Elemental analysis:

| | Calculated (%) | Found (%) |
|---|---|---|
| C | 75.24 | 75.01 |
| H | 4.33 | 4.13 |
| N | 10.82 | 10.73 |

Other trisazo pigments represented by said general formula (1) can be synthesized in the same manner as above.

Synthesis Example 2 (synthesis of polyazo pigment No. 2-1)

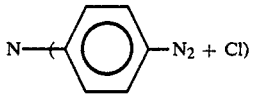

and 2,5-dimethoxyaniline was subjected to acidic coupling at a molar ratio of 1:1 according to the conventional procedure to synthesize the following compound.

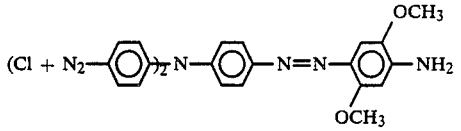

The thus obtained compound was further subjected to disazotization reaction, and then the resulting product was treated with $Na^+BF_4^-$, whereby the following trifluoroborate was readily obtained.

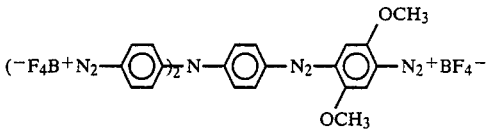

21.6 g (0.03 moles) of the thus obtained trifluoroborate was dissolved in 1.8 l of DMF in a 3-l beaker, and then 24.5 g (0.093 moles) of 3-hydroxy-2-naphthoic anilide as a coupler component was further dissolved therein. The solution was cooled to a liquid temperature of 7° C.

Then, 61.7 g (0.61 mole) of triethylamine was dropwise added to the solution over 30 minutes with stirring while keeping the liquid temperature at 5°-10° C. After the dropwise addition, the mixture was further stirred for 2 hours, and the reaction mixture was filtered after being left at room temperature overnight. The thus obtained pigment was washed, stirred and filtered three times each with 1 l of water, then four times each with 600 ml of DMF, and twice each with 600 ml of MEK successively.

The thus obtained, paste-like product was dried by aeration at room temperature, whereby 31.8 g of pigment was obtained (yield: 83%).

Melting point: 250° C. or higher.

Elemental analysis:

| | Calculated (%) | Found (%) |
|---|---|---|
| C | 72.39 | 72.31 |
| H | 4.43 | 4.46 |
| N | 13.16 | 13.08 |

Synthesis Example 3 (synthesis of said trisazo pigment No. 3-1)

120 ml of water, 24.9 ml (0.29 moles) of concentrated hydrochloric acid, and 12.83 g (0.029 moles) of compound having the following formula:

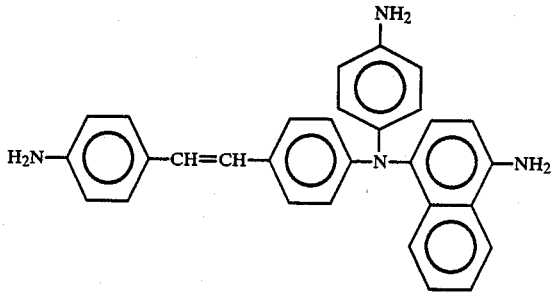

were charged into a 500-ml beaker, and cooled to a liquid temperature of 3° C. in an ice-water bath with stirring. Then, a solution of 6.4 g (0.093 moles) of sodium nitrite in 11 ml of water was dropwise added thereto over 10 minutes, while controlling the liquid temperature within a range of 3° to 10° C. After the dropwise addition, the mixture was further stirred at the same temperature for 30 minutes. The reaction mixture was admixed with carbon, and filtered.

A solution of 38.2 g (0.35 moles) of sodium borofluoride in 65 ml of water was added to the filtrate, and the deposited precipitate was recovered by filtration, washed with water, filtered, and thoroughly pressed on the filter, whereby hexazonium trifluoroborate was obtained in a wet state.

Then, 1,800 ml of DMF was placed in a 2 l beaker, and 24.5 g (0.093 moles) of 3-hydroxy-2-naphthoic anilide as a coupling component and said hexazonium salt were dissolved therein, and the mixture was cooled to a liquid temperature of 7° C.

Then, 61.7 g (0.61 mole) of triethylamine was dropwise added to the solution over 30 minutes with stirring, while keeping the liquid temperature at 5° to 10° C. After the dropwise addition, the mixture was further stirred for two hours, and the reaction mixture was filtered after being left standing at room temperature overnight.

The thus obtained pigment was washed, stirred and filtered three times each with 1 l of water, four times each with 600 ml of DMF and twice each with 600 ml of MEK, successively. The thus obtained, paste-like product was dried by aeration at room temperature, whereby 29.3 g of pigment was obtained (yield: 80.0%).

Melting point: 250° C. or higher.

Elemental analysis:

| | Calculated (%) | Found (%) |
|---|---|---|
| C | 77.13 | 77.33 |
| H | 4.16 | 4.09 |

-continued

| | Calculated (%) | Found (%) |
|---|---|---|
| N | 11.10 | 11.20 |

Synthesis Example 4 (synthesis of said azo pigment No. 4-1)

120 ml of water, 24.9 ml (0.29 moles) of concentrated hydrochloric acid, and 14.4 g (0.029 moles) of compound having the following formula:

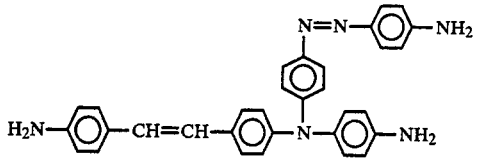

were charged into a 500-ml beaker, and cooled to a liquid temperature of 3° C. in an ice-water bath with stirring. Then, a solution of 6.4 g (0.093 moles) of sodium nitrite in 11 ml of water was dropwise added thereto over 10 minutes, while controlling the liquid temperature within a range of 3° to 10° C. After the dropwise addition, the mixture was further stirred at the same temperature for 30 minutes, and then the reaction mixture was admixed with carbon, and filtered.

Then, a solution of 38.2 g (0.35 moles) of sodium borofluoride in 65 ml of water was added to the filtrate, and the deposited precipitate was filtered, washed with water, filtered, and thoroughly pressed on the filter, whereby hexazonium trifluoroborate was obtained in a wet state.

Then, 1,800 ml of DMF was placed in a 2 l beaker, and 24.4 g (0.093 moles) of naphthol as as a coupling component and said hexazonium salt were dissolved therein. The mixture was cooled to a liquid temperature of 7° C.

Then, 61.7 g (0.61 mole) of triethylamine was dropwise added to the solution over 30 minutes with stirring, while keeping the liquid temperature at 5° to 10° C. After the dropwise addition, the mixture was further stirred for 2 hours, and the reaction mixture was filtered after being left standing at room temperature overnight.

The thus obtained pigment was washed, stirred and filtered three times each with 1 l of water, four times each with 600 ml of DMF and twice each with 600 ml of MEK, successively. The thus obtained, paste-like product was dried by aeration at room temperature, whereby 25.7 g of pigment was obtained (yield: 84%).

Melting point: 250° C. or higher.

Elemental analysis:

| | Calculated (%) | Found (%) |
|---|---|---|
| C | 74.99 | 75.12 |
| H | 4.39 | 4.33 |
| N | 14.57 | 14.50 |

Other azo pigments given in Table 1 can be likewise synthesized.

According to a preferable embodiment of the present invention, the triazo pigment represented by said general formula (1) can be used as a charge-generating substance in an electrophotographic photosensitive member whose photosensitive layer is functionally separated into a charge generation layer and a charge transport layer. The charge generation layer must contain as much said trisazo pigment as possible to obtain a sufficient absorbancy and also must be a thin film layer having a film thickness of 5 μm or less, preferably 0.01 to 1 μm to prevent the generated charge carriers from trapping in the charge generation layer. This is due to the fact that most of incident light quantity is absorbed in the charge generation layer to generate many charge carriers and further due to the necessity to inject the generated charge carriers into the charge transport layer without any deactivation by recombination or trapping.

The charge generation layer can be formed by dispersing said trisazo pigment into an appropriate binder, and coating a substrate with the dispersion or by forming a vapor-deposited film by means of a vacuum vapor-deposition apparatus. The binder for use in forming a charge generation layer by coating can be selected from a wide range of insulating resins and also from organic photoconductive polymers such as poly-N-vinylcarbazole, polyvinylanthracene, polyvinylpyrene, etc. Preferable insulating resins include polyvinylbutyral, polyarylate (polycondensate of bisphenol A and phthalic acid, etc.), polycarbonate (bisphenol A, Z type, etc.), polyester, phenoxy resin, polyvinyl acetate, acrylic resin, polyacryl amide resin, polyamide, polyvinylpyridine, cellulose-based resin, urethane resin, epoxy resin, casein, polyvinyl-alcohol, polyvinylpyrrolidone, etc. It is preferable to contain 80% or less by weight, preferably 40% or less by weight, of the resin in the charge generation layer.

The solvent for dissolving the resin depends upon the species of the resin and is preferably selected from those incapable of dissolving the following charge transport layer or undercoat layer. Specifically, the solvent is organic solvents including alcohols such as methanol, ethanol, isopropanol, etc.; ketones such as acetone, methylethylketone, cyclohexanone, etc.; amides such as N,N-dimethylformamide, N,N-dimethylacetamide, etc.; sulfoxides such as dimethylsulfoxide, etc.; ethers such as tetrahydrofuran, dioxane, ethyleneglycol monomethylether, etc.; esters such as methyl acetate, ethyl acetate, etc.; aliphatic halogenated hydrocarbons such as chloroform, methylene chloride, dichloroethylene, carbon tetrachloride, trichloroethylene, etc.; and aromatic hydrocarbons such as benzene, toluene, xylene, ligroin, monochlorobenzene, dichlorobenzene, etc.

Coating can be carried out by dip coating, spray coating, spinner coating, bead coating, Meyer bar coating, blade coating, roller coating, curtain coating, etc. Drying is carried out preferably by drying to the touch at room temperature and then by drying by heating. Drying by heating can be carried out at a temperature of 30° to 200° C. for 5 minutes to 2 hours at a standstill or using forced air.

The charge transport layer is electrically connected to said charge generation layer, and has a function to receive charge carriers injected from the charge generation layer with an application of an electric field and transport the charge carriers to the surface, where the charge transport layer may be laminated on the charge generation layer, that is, either at the top surface or the bottom surface of the charge generation layer.

When a charge transport layer is formed on the top of the charge generation layer, a material capable of transporting charge carriers in the charge transport layer, which will be hereinafter referred to merely as a charge transporting material, is preferably substantially non-sensitive to the wavelength range of electromagnetic wave to which said charge generation layer is sensitive, because of the need to prevent the charge transport layer from exerting a filter effect and the resulting decrease in the sensitivity. The electromagnetic wave herein referred to means "light beam" defined in a broad sense, including γ-rays, X-rays, ultraviolet rays, visible light beams, near-infrared rays, infrared rays, far-infrared rays, etc.

The charge transporting material includes an electron-transportable material and a hole transportable material. The electron transportable material includes electron-attracting substances such as chloroanil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone, etc. or polymerized products of these electron-attracting substances.

The hole-transportable material includes pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, hydrazones such as p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinonehydrazone, etc., pyrazolines, such as 2,5-bis(p-diethylaminophenyl)-1,3,4-oxadiazole, 1-phenyl-3-(p-diethylaminostyryl)-5-(p-diethylaminophenyl)-pyrazolino, 1-[quinolyl(2)]-3-(p-diethylaminostyryl)-5-(p-diethylaminophenyl)pyrazoline, 1-[pyridyl(2)]-3-(p-diethylaminostyryl)-5-(p-diethylaminophenyl) pyrazoline, 1-[6-methoxypyridyl(2)]-3-(p-diethylaminostyryl)-5-(p-diethylaminophenyl)pyrazoline, 1-[pyridyl(3)]-3-(p-diethylaminostyryl)-5-(p-diethylaminophenyl)-pyrazoline, 1-[pyridyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, etc., oxazole-based compounds such as 2-(p-diethylaminostyryl)-6-diethylaminobenzoxazole, 2-(p-diethylaminophenyl)-4-(p-dimethylaminophenyl)-5-(2-chlorophenyl)oxazole, etc., thiazole-based compounds such as 2-(p-diethylaminostryl)-6-diethylaminobenzothiazole, etc., triarylmethane-based compounds such as bis(4-diethylamino-2-methylphenyl)-phenylmethane, etc., polyarylalkanes such as 1,1-bis(4-N,N-diethylamino-2-methylphenyl)heptane, 1,1,2,2-tetrakis(4-N,N-dimethylamino-2-methylphenyl)ethane, etc., triphenylamine, stilbene derivatives, polycyclic aromatic compounds having a styryl group, heterocyclic compounds, poly-N-vinylcarbazole, polyvinylpyrene, polyvinylanthracene, polyvinylacridine, poly-9-vinylphenylanthracene, pyrene-formaldehyde resin, ethylcarbazole-formaldehyde resin, etc.

Besides these organic charge transportable materials, such inorganic materials as selenium, selenium-tellurium, amorphous silicon, cadmium sulfide, etc. can be also used.

These charge transportable materials can be used alone or in a combination of two or more thereof.

When the charge transportable material is incapable of forming a film, a film can be formed by selecting an appropriate binder. The resin applicable as a binder includes, for example, insulating resins such as acrylic resin, polyarylate, polyester, polycarbonate(bisphenol A, Z type, etc.), polystyrene, acrylonitrile-styrene copolymer, acrylonitrile-butadiene copolymer, polyvinylbutyral, polyvinylformal, polysulfone, polyacrylamide, polyamide, chlorinated rubber, etc., and organic photoconductive polymers such as poly-N-vinylcarbazole, polyvinylanthracene, polyvinylpyrene, etc.

The charge transport layer has a limit to the transport of charge carriers, and thus cannot have a larger thickness than required, and usually 5 to 30 μm, preferably 8 to 20 μm. The charge transport layer can be formed by coating according to said appropriate coating procedure.

The photosensitive layer in a laminate structure composed of the charge generation layer and the charge transport layer is provided on a substrate having an electroconductive layer. The substrate having an electroconductive layer includes electroconductive substrates themselves, for example, aluminum, aluminum alloy, copper, zinc, stainless steel, vanadium, molybdenum, chromium, titanium, nickel, indium, gold, platinum, etc.; plastics having a layer formed by vacuum vapor deposition of aluminum, aluminum alloy, indium oxide, tin oxide, indium oxide-tin oxide alloy, etc. (e.g. polyethylene, polypropylene, polyvinyl chloride, polyethylene tetephthalate, acrylic resin, polyfluoroethylene, etc.); plastics or said electroconductive substrates coated with electroconductive particles (e.g. aluminum powder, tin oxide, zinc oxide, titanium oxide, carbon black, silver particles, etc.) together with an appropriate binder; plastic or paper substrates impregnated with electroconductive particles; plastics having an electroconductive polymer, etc.

An undercoat layer having a barrier function and a bonding function can be provided between the electroconductive layer and the photosensitive layer. The undercoat layer can be formed from casein, polyvinyl alcohol, nitrocellulose, ethylene-acrylate copolymer, polyamide (Nylon 6, Nylon 66, Nylon 610, copolymerized Nylon, alkoxymethylated Nylon, etc.), polyurethane, gelatin, aluminum oxide, etc. The appropriate thickness of the undercoat layer is 0.1 to 5 μm, preferably 0.5 to 3 μm.

When a photosensitive member comprising an electroconductive layer, a charge generation layer and a charge transport layer, laminated in this order, is used, and when the charge transportable material is composed of an electron transportable material, it is necessary to charge the surface of the charge transport layer into a positive polarity, and, when exposed to light after the charging, the electrons formed in the charge generation layer are injected into the charge transport layer at the exposed parts to reach the surface and neutralize the positive charges. Thus, decaying of the surface potential takes place to form an electrostaic contrast between the exposed parts and the unexposed parts. When the thus formed electrostatic latent image is developed by negatively chargeable toners, a visible image can be obtained, and directly fixed, or the toner image can be transferred onto paper or a plastic film, then developed and fixed, or the electrostatic latent image on the photosensitive member can be transferred onto an insulating layer, then developed and fixed. The find of developing agents and procedures for development and fixation are not particularly limited, but well known developing agents and well known procedures can be utilized.

When the charge transportable material is composed of a hole transportable material on the other hand, it is necessary to charge the surface of a charge transport layer into a negative polarity, and then exposed to light of the charging, the holes formed in the charge generation layer are injected into the charge transport layer at the exposed parts to reach the surface and neutralized the negative charge. Decaying of the surface potential takes place and an electrostatic contrast is formed between the exposed parts and the unexposed parts. It is necessary to use positively chargeable toners, in contrast to the electron transportable material, at the development.

According to another embodiment of the present invention, an electrophotographic photosensitive member containing said azo pigment and the charge transportable material in the same layer can be given, where a charge-transfer complex compound composed of poly-N-vinylcarbazole and trinitrofluorenone can be used besides said charge transportable material.

The electrophotographic photosensitive member according to said embodiment can be prepared by dispersing a solution of said azo pigment and the charge-transfer complex compound in tetrahydrofuran into a polyester solution, and forming a film with the thus obtained coating dispersion.

The pigment for use in any of the photosensitive members is at least one pigment selected from the azo pigments given by the general formula (1) or (2), and the crystal form of the pigment may be amorphous or crystalline. It is also possible to use pigments of different light absorptions in combination, when required, to enhance the sensitivity of a photosensitive member, or to use at least two of the azo pigments given by the general formula (1) or (2) in combination to obtain a panchromatic photosensitive member, or to use it in combination with a charge generating material selected from the well known dyes and pigments.

The present electrophotographic photosensitive member is applicable not only to an electrophotographic copying machine, but also to a laser printer, a CRT printer, an LED printer and a liquid crystal printer. These azo pigments can be used alone or in combination of two or more thereof.

Examples 1-1 to 1-40

An aluminum plate was coated with an aqueous ammoniacal solution of casein (consisting of 11.2 g of casein, 1 g of 28% aqua ammonia, and 222 ml of water) by a Meyer bar to a film thickness of 1.0 μm after drying, and dried.

Then, 5 g of said trisazo pigment No. 1-1 was added to a solution containing 2 g of butyral resin (degree of butyralization: 63% by mole) in 95 ml of ethanol, and dispersed for 2 hours in a sand mill. The previously formed casein layer was coated with the dispersion to a film thickness of 0.5 μm after drying by a Meyer bar, and dried to form a change generation layer.

Then, 5 g of a hydrazone compound having the following structural formula:

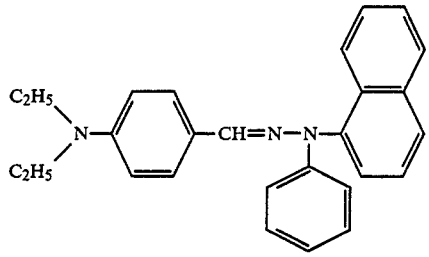

and 5 g of polymethyl methacrylate resin (number average molecular weight: 100,000) was dissolved in 70 ml of benzene, and the charge generation layer were coated with the solution to a film thickness of 12 μm after drying by a Meyer bar, and dried to form a charge transport layer. In this manner, a photosensitive member was prepared.

Likewise, photosensitive members of Examples 1-2 to 1-40 were prepared, using the azo pigments shown in Table 1 in place of the trisazo pigment No. 1-1.

The thus prepared electrophotographic photosensitive members were corona charged at −5 kV according to a static system with a testing apparatus for electrostatic copying paper, Model SP-428, made by Kawaguchi Denki K.K. retained in the dark for one second, and exposed to light with a light intensity of 2 luxes to determine the charging characteristics.

As the charging characteristics, a surface potential (Vo) and an amount of light exposure $E_{\frac{1}{2}}$ (lux.sec) necessary for decaying the potential to ½ when dark decayed for one second. The results are shown in Table 6.

TABLE 6

| Example | Present trisazo pigment No. | Vo(−V) | $E_{\frac{1}{2}}$ (lux.sec) |
|---|---|---|---|
| 1-1 | 1-1 | 600 | 4.3 |
| 1-2 | 1-2 | 570 | 2.3 |
| 1-3 | 1-3 | 580 | 2.0 |
| 1-4 | 1-4 | 600 | 2.2 |
| 1-5 | 1-5 | 560 | 2.4 |
| 1-6 | 1-6 | 620 | 1.9 |
| 1-7 | 1-7 | 600 | 3.6 |
| 1-8 | 1-8 | 610 | 4.6 |
| 1-9 | 1-9 | 600 | 5.0 |
| 1-10 | 1-10 | 580 | 3.9 |
| 1-11 | 1-11 | 570 | 4.7 |
| 1-12 | 1-13 | 610 | 4.0 |
| 1-13 | 1-15 | 590 | 4.2 |
| 1-14 | 1-16 | 590 | 2.6 |
| 1-15 | 1-17 | 610 | 3.9 |
| 1-16 | 1-19 | 620 | 4.7 |
| 1-17 | 1-20 | 610 | 2.3 |
| 1-18 | 1-21 | 570 | 2.0 |
| 1-19 | 1-24 | 580 | 4.9 |
| 1-20 | 1-25 | 620 | 2.4 |
| 1-21 | 1-27 | 610 | 2.6 |
| 1-22 | 1-28 | 580 | 2.4 |
| 1-23 | 1-29 | 610 | 2.0 |

TABLE 6-continued

| Example | Present trisazo pigment No. | Vo(−V) | $E_{\frac{1}{2}}$ (lux.sec) |
|---|---|---|---|
| 1-24 | 1-30 | 570 | 2.5 |
| 1-25 | 1-31 | 610 | 1.8 |
| 1-26 | 1-34 | 590 | 5.1 |
| 1-27 | 1-36 | 590 | 4.0 |
| 1-28 | 1-37 | 610 | 3.8 |
| 1-29 | 1-39 | 570 | 3.9 |
| 1-30 | 1-40 | 580 | 4.1 |
| 1-31 | 1-42 | 600 | 6.0 |
| 1-32 | 1-46 | 610 | 4.6 |
| 1-33 | 1-48 | 600 | 3.9 |
| 1-34 | 1-50 | 580 | 2.3 |
| 1-35 | 1-51 | 570 | 4.3 |
| 1-36 | 1-52 | 610 | 4.0 |
| 1-37 | 1-54 | 590 | 3.2 |
| 1-38 | 1-55 | 605 | 3.9 |
| 1-39 | 1-56 | 610 | 2.7 |
| 1-40 | 1-57 | 600 | 2.3 |

Comparative Examples 1-1 to 1-5

Trisazo pigments having a central skeleton structure of

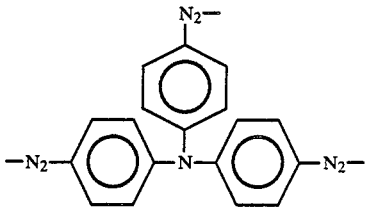

in the present invention trisazo pigments Nos. 1-1, 1-7, 1-19 and 1-30 were designated as comparative pigments Nos. 1-1 to 1-4, correspondingly.

Trisazo pigment having a central skeleton structure of

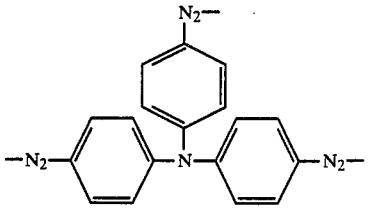

in the present trisazo pigment No. 1-48 was designated as comparative pigment No. 5.

Photosensitive members were prepared in the same manner as in Example 1, using comparative pigments Nos. 1-1 to 1-5 in place of the pigments of Example 1, and subjected to determination of charging characteristics. In Table 7, the charging characteristics of Comparative Examples are shown in contrast to the present invention.

TABLE 7

| Example* | Present trisazo pigment No. | Vo(−V) | $E_{\frac{1}{2}}$ (lux.sec) | Comparative Example | Comparative trisazo pigment No. | Vo(−V) | $E_{\frac{1}{2}}$ (lux.sec) |
|---|---|---|---|---|---|---|---|
| 1-1 | 1-1 | 600 | 4.3 | 1-1 | 1-1 | 580 | 7.4 |
| 1-7 | 1-7 | 600 | 3.6 | 1-2 | 1-2 | 570 | 8.0 |
| 1-16 | 1-19 | 620 | 4.7 | 1-3 | 1-3 | 600 | 8.3 |
| 1-24 | 1-30 | 570 | 2.5 | 1-4 | 1-4 | 570 | 6.0 |

TABLE 7-continued

| Example* | Present trisazo pigment No. | Vo(−V) | $E_{\frac{1}{2}}$ (lux.sec) | Comparative Example | Comparative trisazo pigment No. | Vo(−V) | $E_{\frac{1}{2}}$ (lux.sec) |
|---|---|---|---|---|---|---|---|
| 1-33 | 1-48 | 600 | 3.9 | 1-5 | 1-5 | 580 | 8.6 |

*Extracted from the data of Table 2

As is obvious from the results of Table 7, the electrophotographic sensitivity of the present photosensitive members is considerably improved by introducing an arylene group having a broad $\pi$-electron extension such as naphthylene or biphenylene into the central skeleton of the pigments.

Examples 1-41 to 1-45 and Comparative Examples 1-6 to 1-10

Fluctuations in the potential between the light part and the dark part of the photosensitive members of Examples 1-1, 1-7, 1-16, 1-24, and 1-33 and Comparative Examples 1-1 to 1-5 when used repeatedly were measured in the following manner.

The photosensitive member was pasted on the cylinder of an electrophotographic copying machine comprising a corona charger at −5.6 V, a light exposure optical system, a developer, a transfer charger, a discharging light exposure optical system and a cleaner, where an image could be obtained on a transfer sheet as the cylinder was driven. The initial light part potential ($V_L$) and the initial dark part potential ($V_D$) were set to about −100 V and about −600 V, respectively, in the copying machine, and after 5,000 copyings, the light part potential ($V_L$) and the dark part potential ($V_D$) were measured. The results are shown in Table 8.

TABLE 8

| Photosensitive member No. | | Initial | | After 5,000 copying | |
|---|---|---|---|---|---|
| | | $V_D$(−V) | $V_L$(−V) | $V_D$(−V) | $V_L$(−V) |
| Example | Example | | | | |
| 1-41 | 1-1 | 600 | 100 | 630 | 130 |
| 1-42 | 1-7 | 600 | 110 | 620 | 130 |
| 1-43 | 1-16 | 590 | 90 | 620 | 110 |
| 1-44 | 1-24 | 590 | 100 | 610 | 120 |
| 1-45 | 1-33 | 610 | 100 | 620 | 130 |
| Comp. Ex. | Comp. Ex. | | | | |
| 1-6 | 1-1 | 590 | 100 | 680 | 160 |
| 1-7 | 1-2 | 600 | 100 | 680 | 170 |
| 1-8 | 1-3 | 600 | 100 | 670 | 170 |
| 1-9 | 1-4 | 590 | 90 | 690 | 190 |
| 1-10 | 1-5 | 610 | 100 | 680 | 180 |

The present photosensitive members had a very good stability for both $V_D$ and VL, even when repeatedly used.

Example 1-46

A coating solution prepared by dissolving 5 g of 2,4,7-trinitro-9-fluorenone and 5 g of poly-4,4'-dioxydiphenyl-2,2'-propane carbonate (molecular weight: 300,000) in 70 ml of tetrahydrofuran was applied to the charge generation layer prepared in Example 1-1 to 10 g/m$^2$ after drying, and dried. The thus obtained electrophotographic photosensitive member was subjected to determination of charging characteristics in the same manner as in Example 1-1.

The charging polarity was positive ⊕. The results are given in Table 9.

TABLE 9

| Vo: ⊕ 580 volts<br>$E_{\frac{1}{2}}$: 6.3 lux.sec |
|---|

Example 1-47

A polyvinyl alcohol film having a thickness of 0.5 μm was formed on the aluminum surface of an aluminum-vapor deposited polyethylene terephthalate film. Then, the same dispersion of the trisazo pigment as used in Example 1-1 was applied to the previously formed polyvinyl alcohol layer by coating to a thickness of 0.5 μm after drying by means of a Meyer bar, and dried to form a charge generation layer.

Then, a solution of 2.5 g of stilbene derivative represented by the following structural formula:

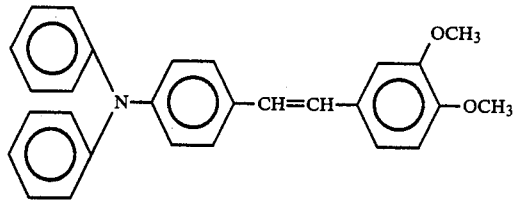

2.5 g of pyrazoline compound having the following structural formula:

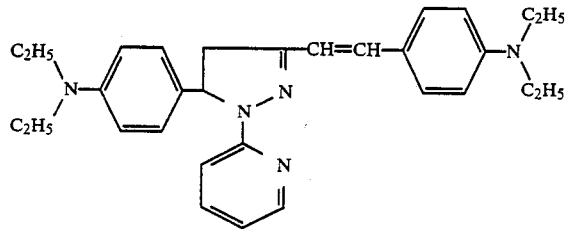

and 5 g of polyarylate resin (polycondensate of bisphenol A and terephthalic acid-isophthalic acid) in 70 ml of tetrahydrofuran was applied to the charge generation layer by coating to a thickness of 10 μm after drying, and dried to form a charge transport layer.

The charging characteristics and the durability of the thus prepared photosensitive member were determined in the same manner as in Examples 1-1 and 1-41. The results are shown in Table 10.

TABLE 10

| Vo: ⊖ 600 V<br>$E_{\frac{1}{2}}$: 4.9 lux.sec | | | |
|---|---|---|---|
| Durability: Initial | | After 5,000 copyings | |
| $V_D$ | $V_L$ | $V_D$ | $V_L$ |
| −600 V | −100 V | −620 V | −120 V |

As is obvious from Table 10, the present photosensitive member had a good sensitivity and a good potential stability when used repeatedly. Examples 1-43 to 1-48.

An aqueous ammoniacal solution of casein was applied to an aluminum sheet having a thickness of 100 μm and dried to form an undercoat layer having a thickness of 0.5 μm.

Then, 5 g of 2,4,7-trinitro-9-fluorenone and 5 g of poly-N-vinylcarbazole (number average molecular weight: 300,000) were dissolved in 70 ml of tetrahydrofuran to form a charge-transfer complex compound. The thus prepared charge-transfer complex compound and 1 g of said trisazo pigment No. 1-26 were dispersed into a solution containing 5 g of polyester resin (Vylon, made by Toyobo K.K.) in 70 ml of tetrahydrofuran. The dispersion was applied to the undercoat layer by coating to a thickness of 12 μm after drying, and dried.

The charging characteristics and the durability of the thus prepared photosensitive member were determined in the same manner as in Examples 1-1 and 1-41. The results are shown in Table 11. The charging polarity was ⊕.

TABLE 11

| Vo: ⊕ 590 V<br>$E_{\frac{1}{2}}$: 5.6 lux.sec | | | |
|---|---|---|---|
| Durability: Initial | | After 5,000 copyings | |
| $V_D$ | $V_L$ | $V_D$ | $V_L$ |
| +600 V | +110 V | +615 V | +125 V |

Example 1-49

The same charge transport layer and charge generation layer as in Example 1-1 were successively laminated on the casein layer of the same aluminum substrate having the casein layer as in Example 1-1 in the same manner as in Example 1-1 except for the order of lamination to prepare a photosensitive member. The charging characteristics of the thus prepared photosensitive member were determined in the same manner as in Example 1-1. The charging polarity was ⊕. The charging characteristics are shown in Table 12.

TABLE 12

| Vo: ⊕ 590 V<br>$E_{\frac{1}{2}}$: 5.0 lux.sec |
|---|

Examples 2-1 to 2-44

A photosensitive member of Example 2-1 was prepared in the same manner as in Example 1-1, except that the azo pigment No. 2-1 shown in Table 2 was used in place of the azo pigment No. 1-1.

Furthermore, photosensitive members of Examples 2-2 to 2-44 were prepared in the same manner as in Example 1-1, except that azo pigments shown in Table 2 were used in place of the azo pigment No. 2-1.

The charging characteristics of the thus prepared electrophotographic photosensitive members were determined in the same manner as in Example 1-1. The results are shown in Table 13.

TABLE 13

| Example | Present azo pigment No. | Vo(−V) | $E_{\frac{1}{2}}$ (lux.sec) |
|---|---|---|---|
| 2-1 | 2-1 | 560 | 3.0 |
| 2-2 | 2-2 | 600 | 1.8 |
| 2-3 | 2-3 | 580 | 1.6 |

TABLE 13-continued

| Example | Present azo pigment No. | Vo(−V) | $E_{\frac{1}{2}}$ (lux.sec) |
|---|---|---|---|
| 2-4 | 2-4 | 570 | 1.9 |
| 2-5 | 2-5 | 600 | 3.9 |
| 2-6 | 2-6 | 580 | 3.9 |
| 2-7 | 2-7 | 600 | 4.1 |
| 2-8 | 2-8 | 610 | 3.7 |
| 2-9 | 2-9 | 600 | 2.3 |
| 2-10 | 2-10 | 580 | 3.9 |
| 2-11 | 2-11 | 610 | 2.0 |
| 2-12 | 2-13 | 590 | 4.8 |
| 2-13 | 2-15 | 590 | 5.0 |
| 2-14 | 2-16 | 610 | 3.9 |
| 2-15 | 2-17 | 570 | 2.0 |
| 2-16 | 2-19 | 620 | 1.8 |
| 2-17 | 2-21 | 580 | 4.3 |
| 2-18 | 2-22 | 570 | 1.8 |
| 2-19 | 2-23 | 610 | 3.2 |
| 2-20 | 2-24 | 620 | 2.2 |
| 2-21 | 2-27 | 610 | 4.6 |
| 2-22 | 2-28 | 570 | 1.8 |
| 2-23 | 2-29 | 610 | 1.7 |
| 2-24 | 2-30 | 580 | 3.6 |
| 2-25 | 2-31 | 610 | 1.8 |
| 2-26 | 2-32 | 580 | 1.6 |
| 2-27 | 2-33 | 570 | 1.8 |
| 2-28 | 2-34 | 610 | 2.4 |
| 2-29 | 2-35 | 590 | 2.7 |
| 2-30 | 2-38 | 390 | 2.3 |
| 2-31 | 2-42 | 570 | 3.8 |
| 2-32 | 2-45 | 580 | 4.3 |
| 2-33 | 2-46 | 600 | 3.0 |
| 2-34 | 2-49 | 610 | 3.1 |
| 2-35 | 2-53 | 600 | 2.6 |
| 2-36 | 2-55 | 600 | 2.3 |
| 2-37 | 2-57 | 600 | 2.6 |
| 2-38 | 2-61 | 600 | 2.8 |
| 2-39 | 2-62 | 600 | 3.6 |
| 2-40 | 2-63 | 580 | 2.3 |
| 2-41 | 2-64 | 570 | 2.8 |
| 2-42 | 2-67 | 600 | 2.7 |
| 2-43 | 2-68 | 610 | 3.0 |
| 2-44 | 2-70 | 590 | 2.4 |

Comparative Examples 2-1 to 2-4

Photosensitive members were prepared in the same manner as in Example 2-1, except that the following comparative trisazo pigments Nos. 2-1 to 2-4, corresponding to the present pigments Nos. 2-1, 2-23, 2-31, and 2-57, respectively, were used in place of the pigment of Example 2-1, and the charging characteristics thereof were likewise determined.

Comparative pigments:

2-1

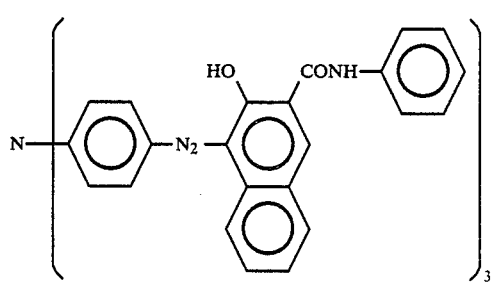

-continued 2-2

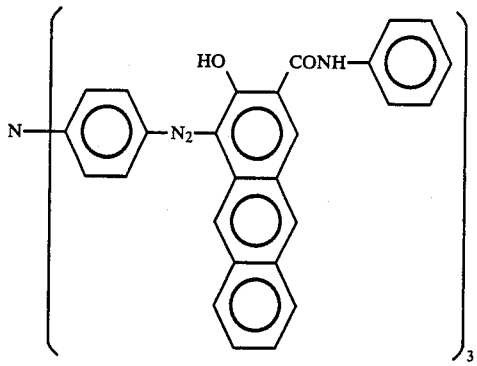

2-3

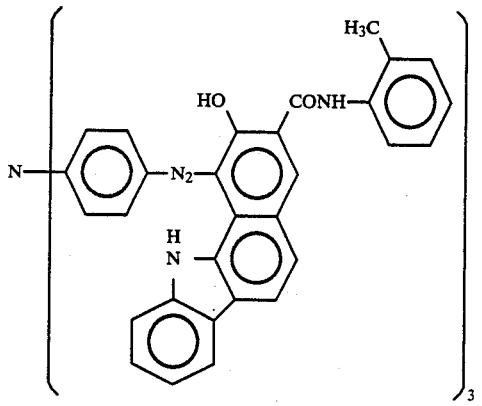

2-4

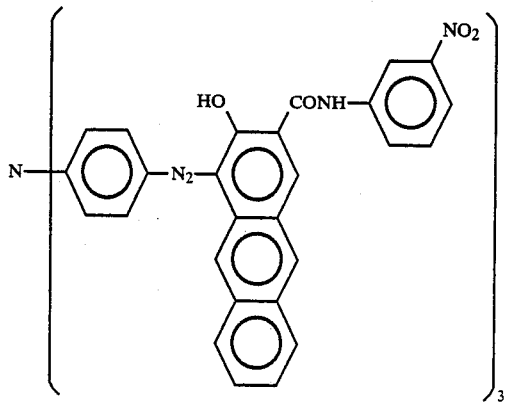

The charging characteristics of Comparative Examples are shown in Table 14 in contrast to those of the present invention.

TABLE 14

| Example* | Present azo pigment No. | Vo(−V) | $E_{\frac{1}{2}}$ (lux.sec) | Comparative Example | Comparative pigment No. | Vo(−V) | $E_{\frac{1}{2}}$ (lux.sec) |
|---|---|---|---|---|---|---|---|
| 2-1 | 2-1 | 560 | 3.0 | 2-1 | 2-1 | 580 | 7.4 |
| 2-19 | 2-23 | 610 | 3.2 | 2-2 | 2-2 | 600 | 8.3 |
| 2-25 | 2-31 | 610 | 1.8 | 2-3 | 2-3 | 590 | 4.8 |
| 2-37 | 2-57 | 600 | 2.6 | 2-4 | 2-4 | 600 | 6.3 |

*Extracted from the data of Table 20

As is obvious from the results of Table 14, the present photosensitive members had a much broader extention of the pigments for $\pi$-electron than that of the pigments disclosed in Japanese Laid Open Patent Application No. 53-132347, and thus had a considerably better electrophotographic sensitivity. Examples 2-45 to 2-48 and Comparative Examples 2-5 to 2-8

Fluctuations in the potential between the light part and the dark part of the photosensitive members of Examples 2-1, 2-19, 2-25 and 2-37 and Comparative Examples 2-1 to 2-4 when used repeatedly were measured in the following manner.

The photosensitive member was pasted on the cylinder of an electrophotographic copying machine comprising a corona charger at −5.6 V, a light exposure optical system, a developer, a transfer charger, a discharging light exposure optical system and a cleaner, where an image could be obtained on a transfer paper as the cylinder was driven. The initial light part potential ($V_L$) and the initial dark part potential ($V_D$) were set to about −100 V and −600 V, respectively, in the copying machine, and after 5,000 copyings, the light part potential ($V_L$) and the dark part potential ($V_D$) were measured. The results are shown in Table 15.

TABLE 15

| Photosensitive member No. | | Initial | | After 5,000 copyings | |
|---|---|---|---|---|---|
| | | $V_D$(−V) | $V_L$(−V) | $V_D$(−V) | $V_L$(−V) |
| Example | Example | | | | |
| 2-45 | 2-1 | 600 | 100 | 620 | 120 |
| 2-46 | 2-19 | 600 | 100 | 630 | 130 |
| 2-47 | 2-25 | 590 | 100 | 630 | 120 |
| 2-48 | 2-37 | 590 | 90 | 620 | 110 |
| Comparative Example | Comparative Example | | | | |
| 2-5 | 2-1 | 600 | 90 | 670 | 150 |
| 2-6 | 2-2 | 600 | 100 | 680 | 170 |
| 2-7 | 2-3 | 590 | 100 | 670 | 160 |
| 2-8 | 2-4 | 590 | 90 | 690 | 180 |

The present photosensitive members had a very good stability for both $V_D$ and $V_L$ even when repeatedly used.

Example 2-49

A coating solution prepared by dissolving 5 g of 2,4,7-trinitro-9-fluorenone and 5 g of a poly-4,4'-dioxydiphenyl-2,2'-propane carbonate (molecular weight: 300,000) in 70 ml of tetrahydrofuran was applied to the charge generation layer prepared in Example 2-1 to 10 g/cm$^2$ after drying, and dried. The thus obtained electrophotographic photosensitive member was subjected to determination of charging characteristics in the same manner as in Example 2-1. The charging polarity was ⊕. The results are given in Table 16.

TABLE 16

Vo: ⊕ 570 volts $E_{\frac{1}{2}}$: 5.7 lux.sec

Example 2-50

A photosensitive member was prepared in the same manner as in Example 1-47, except that the same dispersion of azo pigment as in Example 2-1 was used. The charging characteristics and the durability of the thus prepared photosensitive member were determined in the same manner as in Examples 2-1 and 2-45. The results are shown in Table 17.

TABLE 17

| Vo: ⊖ 590 V<br>$E_{\frac{1}{2}}$: 3.4 lux · sec | | | |
|---|---|---|---|
| Durability: Initial | | After 5,000 copyings | |
| $V_D$ | $V_L$ | $V_D$ | $V_L$ |
| −600 V | −100 V | −630 V | −120 V |

As is obvious from the results of Table 17, the present photosensitive member had a good sensitivity and a good potential stability when used repeatedly.

Example 2-51

An aqueous ammoniacal solution of casein was applied to an aluminum sheet having a thickness of 100 μm by coating and dried to form an undercoat layer having a thickness of 0.5 μm.

Then, 5 g of 2,4,7-trinitro-9-fluorenone and 5 g of poly-N-vinylcarbazole (number average molecular weight: 300,000) were dissolved in 70 ml of tetrahydrofurane to form a charge-transfer complex compound. The thus prepared charge-transfer complex compound and 1 g of the present azo pigment No. 2-26 were dispersed in a solution containing 5 g of polyester resin (Vylon made by Toyobo K.K.) in 70 ml of tetrahydrofurane. The dispersion was applied to the undercoat layer by coating to a thickness of 12 μm after drying, and dried.

The charging characteristics and the durability of the thus prepared photosensitive member were determined in the same manner as in Examples 2-1 and 2-45. The results are shown in Table 18. The charging polarity was ⊕.

TABLE 18

| Vo: ⊕ 570 V<br>$E_{\frac{1}{2}}$: 5.8 lux · sec | | | |
|---|---|---|---|
| Durability: Initial | | After 5,000 copyings | |
| $V_D$ | $V_L$ | $V_D$ | $V_L$ |
| +595 V | +100 V | +615 V | +115 V |

Example 2-52

The same charge transport layer and charge generation layer as in Example 2-1 were successively laminated on the casein layer of the same aluminum substrate having the casein layer as in Example 2-1 in the same manner as in Example 2-1 except for the order of lamination to prepare a photosensitive member. The charging characteristics of the thus prepared photosensitive member were determined in the same manner as in Example 2-1. The charging polarity was ⊕. The charging characteristics are shown in Table 19.

TABLE 19

| Vo: ⊕ 610 V<br>$E_{\frac{1}{2}}$: 4.0 lux · sec |
|---|

Examples 3-1 to 3-49 and Comparative Examples 3-1 to 3-5

Photosensitive member of Example 3-1 was prepared in the same manner as in Example 1-1 except that the azo pigment No. 3-1 was used.

Likewise, photosensitive member of Examples 3-2 to 3-40 were prepared using azo pigments shown in Table 3 in place of the azo pigment No. 3-1.

The thus prepared electrophotographic photosensitive members were evaluated in the same manner as in Example 1-1. The results are shown in Table 20.

TABLE 20

| Example | Present trisazo pigment No. | $V_D$(−V) | $E_{\frac{1}{2}}$ (lux · sec) |
|---|---|---|---|
| 3-1 | 3-1 | 605 | 4.0 |
| 3-2 | 3-2 | 590 | 2.1 |
| 3-3 | 3-3 | 585 | 2.1 |
| 3-4 | 3-4 | 610 | 2.3 |
| 3-5 | 3-5 | 570 | 2.4 |
| 3-6 | 3-6 | 610 | 2.9 |
| 3-7 | 3-7 | 620 | 3.3 |
| 3-8 | 3-8 | 605 | 3.0 |
| 3-9 | 3-9 | 625 | 3.9 |
| 3-10 | 3-10 | 585 | 2.8 |
| 3-11 | 3-11 | 595 | 2.0 |
| 3-12 | 3-13 | 600 | 2.3 |
| 3-13 | 3-15 | 585 | 1.9 |
| 3-14 | 3-16 | 595 | 1.9 |
| 3-15 | 3-21 | 615 | 2.5 |
| 3-16 | 3-23 | 620 | 2.0 |
| 3-17 | 3-25 | 600 | 2.3 |
| 3-18 | 3-26 | 595 | 2.2 |
| 3-19 | 3-27 | 600 | 3.4 |
| 3-20 | 3-29 | 575 | 3.0 |
| 3-21 | 3-30 | 580 | 4.0 |
| 3-22 | 3-33 | 590 | 1.8 |
| 3-23 | 3-34 | 610 | 2.0 |
| 3-24 | 3-35 | 605 | 1.8 |
| 3-25 | 3-37 | 600 | 2.3 |
| 3-26 | 3-38 | 600 | 2.0 |
| 3-27 | 3-39 | 610 | 1.8 |
| 3-28 | 3-42 | 600 | 1.6 |
| 3-29 | 3-43 | 590 | 1.9 |
| 3-30 | 3-44 | 595 | 2.1 |
| 3-31 | 3-46 | 610 | 1.5 |
| 3-32 | 3-49 | 600 | 2.3 |
| 3-33 | 3-50 | 600 | 2.1 |
| 3-34 | 3-51 | 610 | 2.0 |
| 3-35 | 3-53 | 590 | 2.7 |
| 3-36 | 3-58 | 610 | 2.3 |
| 3-37 | 3-59 | 605 | 2.4 |
| 3-38 | 3-60 | 605 | 2.6 |
| 3-39 | 3-63 | 570 | 2.9 |
| 3-40 | 3-64 | 600 | 2.2 |
| 3-41 | 3-65 | 610 | 1.7 |
| 3-42 | 3-66 | 600 | 3.4 |
| 3-43 | 3-68 | 580 | 2.9 |
| 3-44 | 3-70 | 600 | 2.0 |
| 3-45 | 3-71 | 615 | 1.7 |
| 3-46 | 3-73 | 605 | 1.9 |
| 3-47 | 3-75 | 610 | 2.3 |
| 3-48 | 3-76 | 600 | 1.6 |
| 2-49 | 3-78 | 610 | 1.4 |

Comparative Examples 3-1 to 3-5

Trisazo pigments having a central skeleton structure of

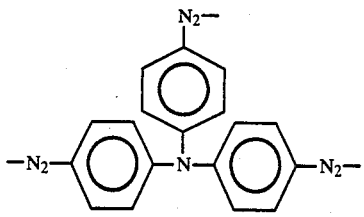

in the present trisazo pigments Nos. 3-1, 3-13, 3-33 and 3-42, and 3-58 were designated as comparative pigments Nos. 3-1 to 3-5.

Photosensitive members were prepared in the same manner as in Example 3-1 except that the comparative pigments Nos. 3-1 to 3-5 were used in place of the pigment of Example No. 3-1, and their charging characteristics were determined. The results are shown in Table 21 in contrast to the present photosensitive members.

As is obvious from the results of Table 21, the present photosensitive members had a considerably improved electrophotographic sensitivity owing to the introduction of an arylene group having a broad $\pi$-electron extension such as naphthylene, biphenylene, etc. into the central skeleton of the pigment and to the introduction of an arylvinylene group thereinto.

TABLE 21

| Example* | Present trisazo pigment No. | $V_D(-V)$ | $E_{\frac{1}{2}}$ (lux · sec) | Comparative Example | Comparative trisazo pigment No. | $V_D(-V)$ | $E_{\frac{1}{2}}$ (lux · sec) |
|---|---|---|---|---|---|---|---|
| 3-1 | 3-1 | 605 | 4.0 | 1 | 1 | 590 | 8.0 |
| 3-12 | 3-13 | 600 | 2.3 | 2 | 2 | 590 | 5.2 |
| 3-23 | 3-33 | 610 | 2.0 | 3 | 3 | 605 | 7.1 |
| 3-28 | 3-42 | 600 | 1.6 | 4 | 4 | 595 | 4.9 |
| 3-36 | 3-58 | 610 | 2.3 | 5 | 5 | 605 | 7.7 |

*Extracted from the data of Table 20

Examples 3-50 to 3-54 and Comparative Examples 3-6 to 3-10

Fluctuations in the potential between the light part and the dark part of the photosensitive members of Examples 3-1, 3-12, 3-23, 3-28 and 3-36, and Comparative Examples 3-1 to 3-5 when used repeatedly were measured in the following manner.

The photosensitive member was pasted on the cylinder of an electrophotographic copying machine comprising a corona charger at −5.6 kV, a light exposure optical system, a developer, a transfer charger, a discharging light exposure optical system and a cleaner, where an image could be obtained on a transfer paper as the cylinder was driven. The initial light part potential ($V_L$) and the initial dark part potential ($V_D$) were set to about −100 V and −600 V, respectively, in the copying machine, and after 5,000 copyings, the light part potential ($V_L$) and the dark part potential ($V_D$) were measured. The results are shown in Table 22.

As is obvious from Table 22, the present photosensitive members had a very good stability for both $V_D$ and $V_L$ when used repeatedly.

TABLE 22

| Example | Photosensitive member No. | Initial $V_D$ (−V) | Initial $V_L$ (−V) | After 5,000 copyings $V_D(-V)$ | After 5,000 copyings $V_L(-V)$ |
|---|---|---|---|---|---|
| 50 | 1 | 605 | 100 | 625 | 120 |
| 51 | 13 | 600 | 100 | 625 | 125 |
| 52 | 33 | 590 | 95 | 615 | 120 |
| 53 | 42 | 585 | 80 | 610 | 110 |
| 54 | 58 | 605 | 100 | 625 | 125 |
| Comparative Example | Comparative Example | | | | |
| 6 | 1 | 600 | 100 | 670 | 160 |
| 7 | 2 | 600 | 100 | 690 | 165 |
| 8 | 3 | 600 | 100 | 670 | 165 |
| 9 | 4 | 590 | 100 | 670 | 190 |
| 10 | 5 | 610 | 105 | 680 | 170 |

Example 3-55

A coating solution containing 5 g of 2,4,7-trinitro-9-fluorenone and 5 g of poly-4,4'-dioxydiphenyl-2,2'-propanecarbonate (molecular weight: 300,000) in 70 ml of tetrahydrofuran was applied to the same charge generation layer as prepared in Example 3-1 by coating to a weight of 10 g/m$^2$ after drying, and dried.

The thus prepared electrophotographic photosensitive member was subjected to determination of charging characteristics in the same manner as in Example 3-1. The charging polarity was ⊕. The results are shown in Table 23.

TABLE 23

| |
|---|
| $V_D$: ⊕ 600 volts |
| $E_{\frac{1}{2}}$: 5.0 lux · sec |

Example 3-56

A photosensitive member was prepared in the same manner as in Example 1-47, using the same dispersion of azo pigment as in Example 3-1, and the charging characteristics and the durability of the thus prepared photosensitive member were determined in the same manner as in Examples 3-1 and 3-50. The results are shown in Table 24.

TABLE 24

| $V_D$: ⊖ 590 V, $E_{\frac{1}{2}}$: 4.3 lux · sec | | | |
|---|---|---|---|
| Durability: Initial | | After 5,000 copyings | |
| $V_D$ | $V_L$ | $V_D$ | $V_L$ |
| −600 V | −100 V | −615 V | −125 V |

As is obvious from the results of Table 24, the present photosensitive member had a good sensitivity and a good potential stability when used repeatedly.

Example 3-57

An aqueous ammoniacal solution of casein was applied to an aluminum sheet having a thickness of 100 μm by coating, and dried to form an undercoat layer having a thickness of 0.5 μm.

Then, 5 g of 2,4,7-trinitro-9-fluorenone and 5 g of poly-N-vinylcarbazole (number average molecular weight: 300,000) were dissolved in 70 ml of tetrahydrofuran to form a charge-transfer complex compound. Then, the thus prepared charge-transfer complex compound and 1 g of the present trisazo pigment No. 3-26 were dispersed in a solution containing 5 g of polyester resin (Vylon, made by Toyobo K.K.). The dispersion was applied to the undercoat layer by coating to a thickness of 12 μm after drying, and dried.

The charging characteristics and durability of the thus prepared photosensitive member were determined in the same manner as in Example 3-1. The results are shown in Table 25. The charging polarity was positive ⊕.

TABLE 25

| | Durability Initial | | After 5,000 copyings | |
|---|---|---|---|---|
| $V_D$: ⊕ 600 V | $V_D$ | $V_L$ | $V_D$ | $V_L$ |
| $E_{\frac{1}{2}}$: 4.7 lux · sec | +600 | +100 | +640 | +135 |

Example 3-58

The same charge transport layer and charge generation layer as in Example 3-1 were successively laminated on the casein layer of the same aluminum substrate having the casein layer as in Example 3-1 in the same manner as in Example 3-1 except for the order of lamination to prepare a photosensitive member. The charging characteristics of the thus prepared photosensitive member were determined in the same manner as in Example 3-1. The charging polarity was positive ⊕. The charging characteristics are shown in Table 26.

TABLE 26

| |
|---|
| $V_D$: ⊕ 600 V |
| $E_{\frac{1}{2}}$: 4.2 lux · sec |

Examples 4-1 to 4-25 and 5-1 to 5-15

A photosensitive member was prepared in the same manner as in Example 1-1, except that the present azo pigment No. 4-1 was used. Furthermore, photosensitive members of Examples 4-2 to 4-25 and 5-1 to 5-15 were likewise prepared, using the azo pigments shown in Tables 4 and 5 in place of the azo pigment No. 4-1.

The thus prepared electrophotographic photosensitive members were evaluated in the same manner as in Example 1-1. The results are shown in Table 27.

TABLE 27

| Example | Present azo pigment No. | Vo(−V) | $E_{\frac{1}{2}}$ (lux · sec) |
|---|---|---|---|
| 4-1 | 4-1 | 605 | 4.3 |
| 4-2 | 4-2 | 600 | 2.1 |
| 4-3 | 4-7 | 580 | 3.6 |
| 4-4 | 4-9 | 580 | 3.0 |
| 4-5 | 4-10 | 560 | 2.2 |
| 4-6 | 4-12 | 590 | 2.8 |
| 4-7 | 4-14 | 600 | 2.9 |
| 4-8 | 4-16 | 565 | 3.6 |
| 4-9 | 4-17 | 605 | 4.0 |
| 4-10 | 4-19 | 590 | 2.5 |

TABLE 27-continued

| Example | Present azo pigment No. | Vo(−V) | $E_{\frac{1}{2}}$ (lux · sec) |
|---|---|---|---|
| 4-11 | 4-20 | 610 | 2.0 |
| 4-12 | 4-21 | 600 | 1.8 |
| 4-13 | 4-22 | 595 | 3.0 |
| 4-14 | 4-23 | 595 | 2.2 |
| 4-15 | 4-25 | 610 | 2.6 |
| 4-16 | 4-27 | 590 | 2.0 |
| 4-17 | 4-29 | 580 | 1.8 |
| 4-18 | 4-30 | 615 | 3.3 |
| 4-19 | 4-32 | 605 | 2.9 |
| 4-20 | 4-34 | 610 | 4.6 |
| 4-21 | 4-35 | 615 | 2.1 |
| 4-22 | 4-36 | 580 | 4.2 |
| 4-23 | 4-37 | 605 | 1.9 |
| 4-24 | 4-38 | 600 | 2.0 |
| 4-25 | 4-39 | 615 | 4.0 |
| 5-1 | 5-1 | 600 | 5.0 |
| 5-2 | 5-2 | 605 | 2.2 |
| 5-3 | 5-4 | 615 | 2.7 |
| 5-4 | 5-6 | 590 | 3.4 |
| 5-5 | 5-7 | 600 | 2.6 |
| 5-6 | 5-8 | 605 | 5.1 |
| 5-7 | 5-10 | 610 | 2.0 |
| 5-8 | 5-11 | 600 | 1.7 |
| 5-9 | 5-14 | 590 | 2.5 |
| 5-10 | 5-16 | 605 | 3.9 |
| 5-11 | 5-17 | 610 | 2.4 |
| 5-12 | 5-18 | 605 | 2.1 |
| 5-13 | 5-24 | 590 | 2.0 |
| 5-14 | 5-27 | 615 | 2.6 |
| 5-15 | 5-30 | 600 | 4.6 |

As is obvious from the results of Table 27, the present photosensitive members had a very distinguished electrophotographic sensitivity owing to the elongation of the conjugated chain by introduction of the azo group and the vinylene group into the central skeleton of the pigment.

Examples 4-26 to 4-30

Fluctuations in the potential between the light part and the dark part of the photosensitive members using the present pigments Nos. 4-1, 4-25, 4-27, 5-1 and 5-18 used in Examples 4-1, 4-15, 4-16, 5-1 and 5-12, respectively, when used repeatedly, were measured in the following manner.

The photosensitive member was applied to on the cylinder of an electrophotographic copying machine comprising a corona discharger, at −5.6 V, a light exposure optical system, a developer, a transfer charger, a discharging and light exposure optical system and a cleaner, where an image could be obtained on a transfer sheet as the cylinder is driven. The initial light part potential ($V_L$) and the initial dark part potential ($V_D$) were set to about −100 V and −600 V, respectively, in the copying machine, and after 5,000 copyings, the light part potential ($V_L$) and the dark part potential ($V_D$) were measured. The results are shown in Table 28.

TABLE 28

| Example No. | Present pigment No. | Initial | | After 5,000 copyings | |
|---|---|---|---|---|---|
| | | $V_D$(−V) | $V_L$(−V) | $V_D$(−V) | $V_L$(−V) |
| 4-26 | 4-1 | 605 | 105 | 620 | 135 |
| 4-27 | 4-25 | 610 | 90 | 630 | 125 |
| 4-28 | 4-27 | 600 | 90 | 630 | 120 |
| 4-29 | 5-1 | 595 | 115 | 610 | 140 |
| 4-30 | 5-18 | 605 | 90 | 620 | 125 |

The present photosensitive members had a very good stability for $V_D$ and $V_L$ even after used repeatedly.

Example 4-31

A coating solution prepared by dissolving 5 g of 2,4,7-trinitro-9-fluorenone and 5 g of poly-4,4'-dioxydiphenyl-2,2'-propane carbonate (molecular weight: 300,000) in 70 ml of tetrahydrofuran was applied to the same charge generation layer as prepared in Example 4-1 by coating to a weight of 10 g/m$^2$ after drying, and dried.

The thus prepared electrophotographic photosensitive member was subjected to determination of charging characteristics in the same manner as in Example 4-1. The charging polarity was ⊕. The results are shown in Table 29.

TABLE 29

| Vo: ⊕ 585 volts<br>$E_{\frac{1}{2}}$: 4.3 lux · sec |
|---|

Example 4-32

A photosensitive member was prepared in the same manner as in Example 1-47, except that the same dispersion of azo pigment as used in Example 4-1 was used.

The charging characteristics and durability of the thus prepared photosensitive member were determined in the same manner as in Examples 4-1 and 4-26. The results are shown in Table 30.

TABLE 30

| Vo: ⊖ 610 V<br>$E_{\frac{1}{2}}$: 2.3 lux · sec | | | |
|---|---|---|---|
| Durability: Initial | | After 5,000 copyings | |
| $V_D$ | $V_L$ | $V_D$ | $V_L$ |
| −600 V | −100 V | −620 V | −120 V |

As is obvious from the results of Table 30, the present photosensitive member had a good sensitivity and a good potential stability when used repeatedly.

Example 5-16

An aqueous ammoniacal solution of casein was applied to an aluminum sheet having a thickness of 100 μm by coating, and dried to form an undercoat layer having a thickness of 0.5 μm.

Then, 5 g of 2,4,7-trinitro-9-fluorenone and 5 g of poly-N-vinylcarbazole (number average molecular weight: 300,000) were dissolved in 70 ml of tetrahydrofuran to form a charge-transfer complex compound. Then, the thus prepared charge-transfer complex compound and 1 g of the present azo pigment No. 5-53 were dispersed in a solution containing 5 g of polyester resin (Vylon made by Toyobo K.K.). The dispersion was applied to the undercoat layer by coating to a thickness of 12 μm after drying, and dried.

The charging characteristics and durability of the thus prepared photosensitive member was determined in the same manner as in Example 4-1, and the results are shown in Table 31. The charging polarity was ⊕.

TABLE 31

| Vo: ⊕ 600 V<br>$E_{\frac{1}{2}}$ 3.7 lux · sec | | | |
|---|---|---|---|
| Durability Initial | | After 5,000 copyings | |
| $V_D$ | $V_L$ | $V_D$ | $V_L$ |
| +600 V | +100 V | +620 V | +125 V |

Example 4-33

The same charge transport layer and charge generation layer as in Example 4-1 were successively laminated on the casein layer of the same aluminum substrate having the casein layer as in Example 4-1 in the same manner as in Example 4-1 except for the order of lamination to prepare a photosensitive member. The charging characteristics of the thus prepared photosensitive member were determined in the same manner as in Example 4-1. The charging polarity was ⊕. The charging characteristics are shown in Table 32.

TABLE 32

| Vo: ⊕ 590 V<br>$E_{\frac{1}{2}}$: 4.6 lux · sec |
|---|

We claim:

1. An electrophotographic photosensitive member comprising a photosensitive layer containing an azo pigment selected from the group consisting of the following general formulae (1) to (5):

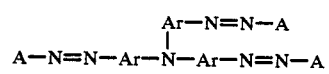
(1)

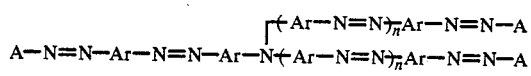
(2)

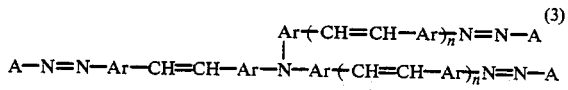
(3)

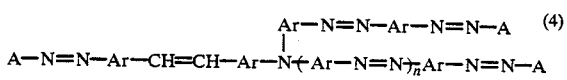
(4)

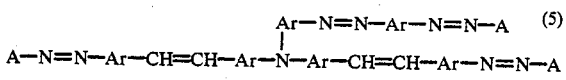
(5)

wherein groups Ar are each arylene groups or divalent heterocyclic groups, each of which may contain a substituent; n is 0 or 1; and group A is a coupler residue group having a phenolic group; wherein at least one of the three groups Ar combined with the amine

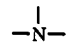

in the general formula (1) and (3) is a group selected from the group consisting of biphenylene, naphthylene or anthrylene, each of which may have a substituent and a binder.

2. An electrophotographic photosensitive member according to claim 1, wherein the group A in the general formulae (1) to (5) is a coupler residue selected from the group consisting of the following general formulae (6) to (12).

(6)

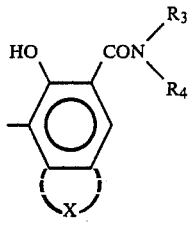

(7)

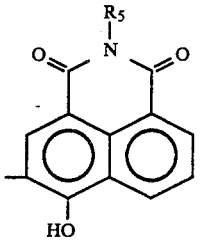

(8)

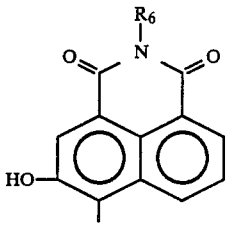

(9)

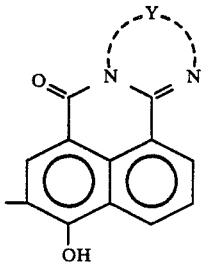

(10)

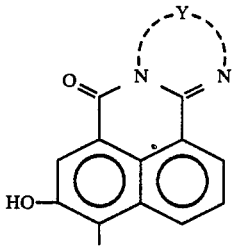

-continued (11)

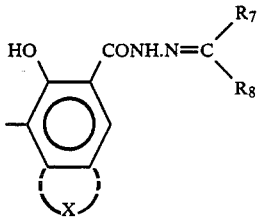

(12)

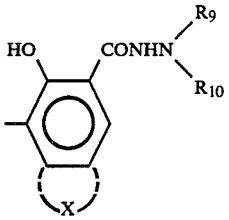

wherein X is a residue forming a polycyclic aromatic ring or a heterocyclic ring through condensation with a benzene ring; $R_3$ and $R_4$ are hydrogen atoms and alkyls, aralkyls, aryls or heterocyclic groups each of which may have a substituent, or forms a cyclic amino group therefrom together with a nitrogen atom; $R_5$ and $R_6$ are alkyls, aralkyls, or aryls, each of which may have a substituent; Y is a divalent group of aromatic hydrocarbon or forms a divalent group of heterocycle therefrom together with a nitrogen atom; $R_7$ and $R_8$ are aryls or heterocyclic groups, each of which may have a substituent; or a residue forming a 5 or 6-membered ring therefrom together with a central carbon, the 5 or 6-membered ring being capable of having a condensed aromatic ring; or $R_7$ may be a hydrogen atom; and $R_9$ and $R_{10}$ are hydrogen atoms, alkyls, aralkyls, aryls or heterocyclic groups, each of which may have a substituent.

3. An electrophotographic photosensitive member according to any one of claims 1 or 2, wherein the photosensitive layer is of a functionally separated type composed of a charge generation layer and a charge transport layer, the charge generation layer containing an azo pigment represented by said general formulae (1) to (5).

4. An electrophotographic photosensitive member according to claim 2, wherein in the general formula (6) $R_3$ is a hydrogen atom and $R_4$ is a substituted phenyl represented by the following general formula:

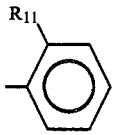

wherein $R_{11}$ is a substituent selected from a halogen atom, nitro, cyano, trifluoromethyl or acyl.

* * * * *

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

ON THE TITLE PAGE ITEM [54]

"PHOTSENSITIVE" should read --PHOTOSENSITIVE--.

ON THE TITLE PAGE ITEM [56] IN THE REFERENCES

U.S Patent Documents, "Ishikowa et al." should read --Ishikawa et al.--.

COLUMN 1

Line 1, "PHOTSENSITIVE" should read --PHOTOSENSITIVE--.
Line 14, "zince" should read --zinc--.

COLUMN 3

Line 64, "5 or" should read --5- or--.
Line 64, "centeral" should read --central--.
Line 65, "5 or" should read --5- or--.

COLUMN 4

Line 32, "5 or" should read --5- or--.
Line 49, "5 or" should read --5- or--.
Line 50, "5 or" should read --5- or--.

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 88

Lines 2-70, " 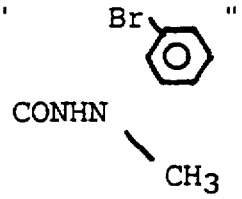 "

should read -- 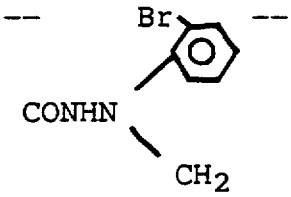 --

COLUMNS 93-94

Pigment 3-16 should be deleted.

COLUMNS 109-110

Pigment 3-16 should be deleted.

COLUMN 187

Line 46, "3+ C." should read --3°C.--.

COLUMN 188

Line 1, "with with" should read --with--.

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 190

Line 36, "as as" should read --as--.
Line 64, "triazo" should read --trisazo--.

COLUMN 193

Line 34, "tetephthalate," should read --terephthalate,--.
Line 63, "electrostaic" should read --electrostatic--.

COLUMN 194

Line 10, "then" should read --when--.
Line 13, "neutralized" should read --neutralize--.
Line 66, "change" should read --charge--.

COLUMN 196

Line 36, "invention" should be deleted.

COLUMN 197

Line 54, "VL," should read --$V_L$,--.

COLUMN 199

Line 3, "Examples 1-43 to 1-48." should be deleted.
Line 4, --Examples 1-43 to 1-48.-- should be inserted and centered as a heading.

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 200

Table 13, Line 29, "390" should read --590--.

COLUMN 201

Line 65, "extention" should read --extension--.
Line 67, "Laid Open" should read --Laid-Open--.

COLUMN 202

Line 1, "Examples 2-45 to 2-48 and" should be deleted.
Line 2, "Comparative Examples 2-5 to 2-8" should be deleted.
Line 3, --Examples 2-45 to 2-48 and Comparative Examples 2-5 to 2-8-- should be inserted as a heading.

COLUMN 203

Line 27, "tetrahhy-" should read --tetrahy---.

COLUMN 204

Line 9, "3-40" should read --3-49--.
Table 20, line 62, "2-49" should read --3-49--.

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 205

Table 21, "

| Comparative Example | Comparative" trisazo pigment No. |
|---|---|
| 1 | 1 |
| 2 | 2 |
| 3 | 3 |
| 4 | 4 |
| 5 | 5 |

should read --

| Comparative Example | Comparative-- trisazo pigment No. |
|---|---|
| 3-1 | 3-1 |
| 3-2 | 3-2 |
| 3-3 | 3-3 |
| 3-4 | 3-4 |
| 3-5 | 3-5 |

Table 22, "

| Example | Photosensitive" member No. |
|---|---|
| 50 | 1 |

should read --

| Example | Photosensitive-- member No. |
|---|---|
| 3-50 | 3-1 |

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 206

Table 22, "

| | |
|---|---|
| 51 | 13 |
| 52 | 33 |
| 53 | 42 |
| 54 | 58 |

| Comparative Example | Comparative Example |
|---|---|
| 6 | 1 |
| 7 | 2 |
| 8 | 3 |
| 9 | 4 |
| 10 | 5 |

should read --

| | |
|---|---|
| 3-51 | 3-13 |
| 3-52 | 3-33 |
| 3-53 | 3-42 |
| 3-54 | 3-58 |

| Comparative Example | Comparative Example |
|---|---|
| 3-6 | 3-1 |
| 3-7 | 3-2 |
| 3-8 | 3-3 |
| 3-9 | 3-4 |
| 3-10 | 3-5 |

UNITED STATES PATENT AND TRADEMARK OFFICE

CERTIFICATE OF CORRECTION

PATENT NO. : 4,735,882

DATED : April 5, 1988

INVENTOR(S) : MASATAKA YAMASHITA, ET AL.

It is certified that error appears in the above-indentified patent and that said Letters Patent is hereby corrected as shown below:

COLUMN 209

Line 59, "pigment No. 5-53" should read --pigment No. 5-16--.

COLUMN 211

Line 2, "(12)." should read --(12):--.

COLUMN 212

Line 31, "5 or" should read --5- or--.
Line 32, "5 or" should read --5- or--.

Signed and Sealed this

Eighteenth Day of October, 1994

Bruce Lehman

*Attest:*

BRUCE LEHMAN

*Attesting Officer*

*Commissioner of Patents and Trademarks*